US007132226B2

(12) United States Patent
Yamane

(10) Patent No.: US 7,132,226 B2
(45) **Date of Patent: *Nov. 7, 2006**

(54) PHOTOTHERMOGRAPHIC MATERIAL AND IMAGE FORMING METHOD

(75) Inventor: Katsutoshi Yamane, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/231,974

(22) Filed: Sep. 22, 2005

(65) Prior Publication Data

US 2006/0068345 A1 Mar. 30, 2006

(30) Foreign Application Priority Data

Sep. 27, 2004 (JP) ..... 2004-280627

(51) Int. Cl.

| | |
|---|---|
| ***G03C 5/16*** | (2006.01) |
| ***G03C 1/00*** | (2006.01) |
| ***G03C 1/005*** | (2006.01) |
| ***G03C 1/494*** | (2006.01) |

(52) U.S. Cl. ..... 430/348; 430/349; 430/350; 430/617; 430/618; 430/619; 430/620; 430/644; 430/631; 430/633

(58) Field of Classification Search ..... 430/617–620, 430/348–350, 631, 633, 644
See application file for complete search history.

(56) References Cited

U.S. PATENT DOCUMENTS

2004/0185389 A1* 9/2004 Yoshioka et al. ..... 430/348

FOREIGN PATENT DOCUMENTS

| | | |
|---|---|---|
| JP | A 10-69023 | 3/1998 |
| JP | A 2000-112062 | 4/2000 |
| JP | A 2001-5137 | 1/2001 |
| JP | A 2001-5138 | 1/2001 |

* cited by examiner

*Primary Examiner*—Geraldine Letscher
(74) *Attorney, Agent, or Firm*—Margaret A. Burke; Sheldon J. Moss

(57) ABSTRACT

A photothermographic material comprising a support, and an image-forming layer and a non-image-forming layer provided on the support, wherein the image-forming layer comprises a photosensitive silver halide, a non-photosensitive organic silver salt, a reducing agent, and a binder; the non-image-forming layer includes a slipping agent having a melting point of 80° C. to 120° C.; the coefficient (K1) of dynamic friction measured at a velocity of 0.1 cm/sec and the coefficient (K2) of dynamic friction measured at a velocity of 10 cm/sec have a relation represented by formula (1): Formula (1) $1.20>K1/K2>0.90$. Also provided is an image-forming method using the photothermographic material.

15 Claims, No Drawings

PHOTOTHERMOGRAPHIC MATERIAL AND IMAGE FORMING METHOD

CROSS-REFERENCE TO RELATED APPLICATION

This application claims priority under 35 USC 119 from Japanese patent Application No. 2004-280627, the disclosure of which is incorporated by reference herein.

BACKGROUND OF THE INVENTION

1. Field of the Invention

The present invention relates to photothermographic materials and image forming methods.

2. Description of the Related Art

Reduction of waste solutions to be treated has been strongly desired in recent years in the medical field from the viewpoints of environmental protection and space saving. Under such circumstances, there have been needs for technologies on photosensitive photothermographic photographic materials for medical diagnosis and photography which can be exposed to light efficiently with a laser image setter or a laser imager, and can form a clear black image having high resolution and sharpness. With these photosensitive photothermographic photographic materials, it is possible to supply to customers a heat development treatment system which has eliminated the necessity of using solvent system processing chemicals, and is simpler and does not impair the environment.

The similar requirements also exist in the field of general image forming materials. However, the image for medical use is required to have a high image quality excellent in sharpness and graininess, because fine details of the image are required. In addition, the medical image is characterized by that a cold tone of an image is preferred from the viewpoint of ease of medical diagnosis. Currently, various hard copy systems utilizing pigments or dyes such as inkjet printers and apparatuses for electrophotography are prevailing as general image forming systems. However, there is no system which is satisfactory as a medical image-output system.

A thermal image formation system utilizing an organic silver salt is described in a large number of documents. In particular, the photothermographic material generally has an image-forming layer in which a catalytically active amount of a photocatalyst (e.g., silver halide), a reducing agent, a reducible silver salt (e.g., organic silver salt), and, if required, a toning agent for controlling the color tone of silver are dispersed in a binder matrix. The photothermographic materials are, after being imagewise exposed, heated to a high temperature (for example, to 80° C. or higher) to form black silver images through the oxidation-reduction reaction between the silver halide or the reducible silver salt (which functions as an oxidizing agent) and the reducing agent therein. The oxidation-reduction reaction is accelerated by the catalytic action of the latent image of the silver halide generated through exposure. For this reason, the black silver images are formed in the exposed areas. Fuji Medical Dry Imager FM-DP L has been distributed as a medical image formation system using a photothermographic material.

In photothermographic materials, substances have been used for lubricating the photothermographic materials, for improving the transferability in the production process, and for improving handling property when stacked. Examples of such substances are liquid slipping agents such as liquid paraffin disclosed in Japanese Patent Application Laid-Open (JP-A) No. 10-69023 and silicone oil disclosed in JP-A No. 2001-5138, and solid esters such as carnauba waxes disclosed in JP-A Nos. 2000-112062 and 2001-5137. These "slipping agents" are used preferably in a surface protective layer on the image-forming layer side or in a surface protective layer on the back side, particularly preferably in an outermost layer. However, the outermost layer directly contacts conveying devices, and the added substance cause transfer defects and adversely affects the output image. Accordingly, it is an important issue to find out an appropriate slipping agent. Therefore, there have been needs for improved slipping agents and photothermographic materials containing the improved slipping agents.

SUMMARY OF THE INVENTION

The present invention has been made in consideration of the above problems of the conventional techniques.

The present invention provides a photothermographic material comprising a support, and an image-forming layer and a non-image-forming layer provided on the support. The image-forming layer comprises a photosensitive silver halide, a non-photosensitive organic silver salt, a reducing agent, and a binder. The non-image-forming layer includes a slipping agent having a melting point of 80° C. to 120° C. The coefficient (K1) of dynamic friction measured at a velocity of 0.1 cm/sec and the coefficient (K2) of dynamic friction measured at a velocity of 10 cm/sec satisfy the relation represented by the formula (1).

$$1.20 > K1/K2 > 0.90 \qquad \text{Formula (1)}$$

The melting point of the slipping agent may be 85° C. to 110° C. The slipping agent may be selected from fatty acid esters and microcrystalline waxes. The slipping agent contained in the photothermographic material may be in the form of a solid particle dispersion. The rate of evaporation of the slipping agent may be 0.5 mass % or lower.

The photothermographic material may include a fluorine-containing compound having an alkyl fluoride group having at least two carbon atoms and 12 or less fluorine atoms. The alkyl fluoride group may be a group represented by the formula (A).

$$\text{-Rc-Re-W} \qquad \text{Formula (A)}$$

In the formula (A), Rc represents an alkylene group having 1 to 4 carbon atoms, Re represents a perfluoroalkylene group having 2 to 6 carbon atoms, and W represents a hydrogen atom, a fluorine atom, or an alkyl group.

The fluorine-containing compound may have two or more alkyl fluoride groups represented by formula (A). The photothermographic material may further include a matting agent on the same side of the support as the side having the non-image-forming layer containing the fluorine-containing compound. The matting agent may be a polymer.

The photothermographic material may further include a non-photosensitive intermediate layer between the image-forming layer and the non-image-forming layer, and the non-photosensitive intermediate layer may contain 50 mass % or more of a polymer latex. The polymer latex may include 10 mass % to 70 mass % of a monomer component represented by formula (M).

$$CH_2{=}CR^{01}{-}CR^{02}{=}CH_2 \qquad \text{Formula (M)}$$

In the formula (M), $R^{01}$ and $R^{02}$ each independently represent a hydrogen atom, an alkyl group having 1 to 6 carbon atoms, a halogen atom, or a cyano group. The monomer component may be a monomer in which $R^{01}$ and $R^{02}$ both represent hydrogen atoms, or in which one of $R^{01}$ and $R^{02}$ represents a hydrogen atom and the other represents a methyl group.

The invention further provides an image-forming method comprising heating any of the above photothermographic materials at 100° C. to 140° C. for 5 sec to 18 sec. At the time of heat development, the photothermographic material may be conveyed at a velocity of at least 23 mm/sec.

In the photothermographic material of the invention, all of the chemical substances necessary for forming an image are contained in the photothermographic material. Even after formation of an image, the chemical substances (in the original form or in the form of chemical reaction products) remain in the photothermographic material. Accordingly, these chemical substances exert influence on conceivability of the photographic material or the physical quality of the outputted image, in addition to their functions in image formation. Thus, in the development of photothermographic materials, it is important to design the chemical reactivity and to select appropriate additives in consideration of their physical characteristics. Among the additives, the present inventor focused on the slipping agent and made investigations.

Liquid paraffin has been used as a slipping agent. Liquid paraffin is a mixture of a linear paraffin, a branched paraffin and naphthene and is produced by refining petroleum fractions. Liquid paraffin products having different compositions and grades are sold by various companies. Since liquid paraffin is a mixture of components having different molecular weights, liquid paraffin is in the liquid state. For this reason, a certain amount of low-molecular components are contained in liquid paraffin, and the amount of low-molecular components varies brand to brand, depending on the origin of crude oil as the raw material, the manner of refining, and the like. The inventor has found that low-molecular components evaporate during heat development gradually and contaminate the heat developing unit and its surroundings in a long-term use, thereby causing a problem of deteriorated conveying property. It is a new discovery that this problem is caused by liquid paraffin.

On the other hand, when an ester-based slipping agent is used, the ester-based slipping agent is usually a substance which is in a solid state. The ester-based slipping agent is molten at a high temperature and dispersed by using a large quantity of surfactant. The inventor has found that such an ester-based slipping agent used in a photothermographic material in a large quantity creates a problem of increase in fogging during storage of the photothermographic material. It is a new discovery that the increase in fogging is caused by the surfactant contained in the slipping agent.

There is also the following problem. When a liquid slipping agent is used and the conveyance velocity of the photothermographic material is increased, the slipping property and evaporation property change. A similar problem occurs even when a solid slipping agent is used since the solid slipping agent liquefies when friction pressure or friction heat is applied.

Based on these findings, the inventor has advanced development of photothermographic materials. As the result, the inventor has developed a solid slipping agent which can form a stable solid dispersion in the presence of a small amount of surfactant and which enables production of a photothermographic material that shows a difference in coefficient of dynamic friction within a specific range between two measurement velocities.

DESCRIPTION OF THE PRESENT INVENTION

1. Photothermographic Material:

The photothermographic material of the invention comprises a support, an image-forming layer, and a non-image-forming layer. The image-forming layer and the non-image-forming layer are provided on at least one side of the support. The image-forming layer comprises a photosensitive silver halide, a non-photosensitive organic silver salt, a reducing agent, and a binder. The non-image-forming layer may be a surface protective layer on the image-forming layer, or may be a layer on the opposite side of the support, such as a back layer or a back protective layer.

The construction of each layer and preferable components thereof will be hereunder described in detail.

(Slipping Agent)

In the photothermographic material of the invention, the non-image-forming layer includes a slipping agent. The slipping agent has a melting point of 80° C. to 120° C. The coefficient (K1) of dynamic friction measured at a velocity of 0.1 cm/sec and the coefficient (K2) of dynamic friction measured at a velocity of 10 cm/sec satisfy the relationship of the following expression (1).

$$1.20 > K1/K2 > 0.90 \qquad \text{Expression (1)}$$

In the invention, the measurement of the coefficient of dynamic friction is conducted at 25° C. by a surface state measuring instrument Type 14FW manufactured by Shinto Scientific Co., Ltd. A ball indenter is used as a measurement tool. In the invention, the term "coefficient of dynamic friction" used herein refers to a coefficient of dynamic friction between a stainless-steel bead having a diameter of 5 mm and a photographic material. In the measurement of the coefficient of dynamic friction, the photographic material is placed on a smooth plane, and the stainless-steel bead is placed on the photothermographic material, and then a weight of 250 g is applied to the stainless-steel bead, and then the photographic material was moved at a rate of 0.1 cm/sec or 10 cm/sec while the force exerted on the stainless steel bead is measured.

The ratio of the coefficient (K1) of dynamic friction to the coefficient (K2) of dynamic friction is preferably within the range of the following expression (2), and more preferably within the range of the following expression (3).

$$1.10 > K1/K2 > 0.90 \qquad \text{Expression (2)}$$

$$1.10 > K1/K2 > 0.95 \qquad \text{Expression (3)}$$

The melting point of the slipping agent is preferably 85° C. to 110° C., more preferably 85° C. to 100° C.

The rate of evaporation of the slipping agent is preferably not more than 0.5 mass %, more preferably not more than 0.2 mass %, further preferably not more than 0.1 mass %.

In the invention, the term "rate of evaporation" used herein refers to a rate of reduction of the mass during one-hour storage of the compound to be tested in nitrogen atmosphere at 120° C. In other words, the initial mass of the test compound is measured, and then the test compound is left in nitrogen atmosphere at 120° C. for one hour, and then the mass of the test compound is measured again. The difference between the initial mass and the mass after the one-hour storage is calculated, and the difference is divided by the initial mass to give the rate of reduction of the mass.

1) Specific Examples of Slipping Agent:

The slipping agent having the required characteristic described above may be a slipping agent selected from the group consisting of fatty acid esters, microcrystalline waxes, and fatty acid amide compounds. Among them, fatty acid esters are preferable.

<<Explanation of Fatty Acid Esters>>

Examples of fatty acid esters usable in the invention include linear higher fatty acid esters, trimethylolpropane-containing fatty acid esters, pentaerythritol fatty acid esters, and dipentaerythritol fatty acid esters.

Specific examples thereof include carnauba wax, pentaerythritol tetrastearate, pentaerythritol tetrabehanate, and dipentaerythritol hexabehenate.

<<Explanation of Microcrystalline Waxes and Fatty Acid Amide Compounds>>

As a high-melting slipping agent, microcrystalline waxes and fatty acid amide compounds can be used advantageously. Specific examples thereof include microcrystalline waxes HI-MIC-2095, HI-MIC-1090 and HI-MIC-1080 and an emulsified product EMUSTAR-042X, all of which are manufactured by Nippon Seiro Co., Ltd. Examples of the fatty acid amide include stearic acid amide and ethylene bisstearic acid amide.

2) Dispersant (Emulsifying Agent) of Slipping Agent:

In a preferable embodiment, the slipping agent is used together with a dispersant. The scope of the term "dispersant" used herein also covers emulsifying agents. The dispersant usable in the invention can be selected from various conventionally-known dispersants. In the invention, the dispersant is preferably a dispersant represented by the following formula (2).

$$(R^3)_a\text{-G-}(D)_d \qquad \text{Formula (2)}$$

In the formula (2), $R^3$ represents an alkyl, alkenyl, aralkyl or aryl group having 10 to 60 carbon atoms which may be substituted; G represents a connecting group having a valence of 2 to 7; D represents $(B)_n$-E (wherein B represents —$CH_2CH_2O$—, —$CH_2CH_2CH_2O$—, —$CH(CH_3)CH_2O$—, or —$CH_2CH(OH)CH_2O$—; n represents an integer of 1 to 50; E represents a hydrogen atom or an alkyl, aryl, alkylcarbonyl or arylcarbonyl group having 1 to 8 carbon atoms which may be substituted; a and d each independently represent an integer of 1 to 6; when there are plural $R^3$'s, they may be the same as each other or different from each other; when there are plural D's, they may be the same as each other or different from each other; when there are plural E's, they may be the same as each other or different from each other.

A more specific explanation will be given below.

$R^3$ represents an alkyl, alkenyl, aralkyl, or aryl group having 10 to 60 carbon atoms which may be substituted or unsubstituted. When $R^3$ represents an alkyl, alkenyl, or aralkyl group, the group may be linear, branched or cyclic. The group represented by $R^3$ may have a formula $C_gH_{2g+1}$ (wherein g represents an integer of 12 to 60), such as eicosyl or docosyl. Examples of the group represented by $R^3$ include dodecyl, myristyl, cetyl, stearyl, oleyl, eicosyl, docosyl, triacontanyl, tetracontanyl, pentacontanyl, dinonylphenyl, didodecylphenyl, tetradecylphenyl, tripentylphenyl, and dodecylnaphthyl. D represents a polyoxyalkylene group of the formula: —$(B)_n$-E, wherein B represents —$CH_2CH_2O$—, —$CH_2CH_2CH_2O$—, —$CH(CH_3)CH_2O$—, or —$CH_2CH(OH)CH_2O$—; and n represents an integer of from 1 to 50. B is preferably —$CH_2CH_2O$—; and n is preferably an integer of 5 to 30. Furthermore, E represents a hydrogen atom or a substituted or unsubstituted alkyl, aryl, alkylcarbonyl or arylcarbonyl group having 1 to 8 carbon atoms. The alkyl group is preferably methyl, ethyl, propyl, butyl, hexyl, or cyclohexyl, more preferably methyl, ethyl, or propyl. The alkylcarbonyl group is preferably acetyl, propionyl, butyroyl, pivaloyl, or cyclohexanecarbonyl, more preferably acetyl. The aryl group is preferably a phenyl group. The arylcarbonyl group is preferably a benzoyl group. E is especially preferably hydrogen, methyl, ethyl, propyl, acetyl, propionyl, or benzoyl.

G represents a connecting group having a valence of 2 to 7 or a single bond. The valence of the connecting group is preferably 2 to 5, more preferably 2 to 4, further preferably 2 or 3. G preferably represents an alkylene group, an arylene group, or a group obtained by combining groups selected from alkylene groups and arylene groups. G may be oxygen, an ester group, sulfur, an amide group, a sulfonyl group, or a divalent substituted or unsubstituted connecting group whose main chain contains a heterogeneous atom such as sulfur. Among them, oxygen, an ester group, and an amide group are especially preferable. In the formula (2), a and d each independently represents an integer of 1 to 6. The dispersant represented by the formula (2) preferably has a low solubility in an aqueous medium. For example, the solubility of the dispersant represented by the formula (2) in water at 25° C. is preferably not more than 0.5 mass %, more preferably not more than 0.1 mass %. Specific examples of the compound represented by the formula (2) are shown below. However, the invention is not limited to the specific examples shown.

WA-1

$C_{30}H_{61}O—(CH_2CH_2O)_{10}—H$

WA-2

$C_{40}H_{81}O—(CH_2CH_2O)_{16}—H$

WA-3

$C_{50}H_{101}O—(CH_2CH_2O)_{15}—H$

WA-4

$C_{50}H_{101}O—(CH_2CH_2O)_{30}—H$

WA-5

$C_{40}H_{80}O—(CH_2CH_2O)_{20}—COCH_3$

WA-6

$C_{40}H_{80}O—(CH_2CH_2O)_{20}—COC_6H_5$

WA-7

$C_{39}H_{79}COO—(CH_2CH_2O)_{15}—H$

WA-8

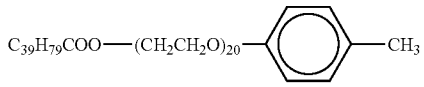

WA-9

$C_{40}H_{81}O—(CH(CH_3)CH_2O)_5—(CH_2CH_2O)_{20}—H$

WA-10

$C_{40}H_{81}O—(CH(CH_3)CH_2O)_3—(CH_2CH(OH)CH_2O)_{10}—H$

WA-11

$C_{40}H_{81}O—(CH(CH_3)CH_2O)_3—(CH_2CH(OH)CH_2O)_5—(CH_2CH_2O)_{10}—H$

WA-12

$C_{18}H_{33}O—(CH_2CH_2O)_{12}—H$

WA-13

$C_{29}H_{59}CON(CH_3)—(CH_2CH_2O)_{15}—H$

WA-14

$C_{29}H_{59}CON[(CH_2CH_2O)_{10}—H][(CH_2CH_2O)_{10}—H]$

-continued

WA-15

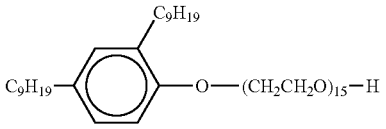

WA-16

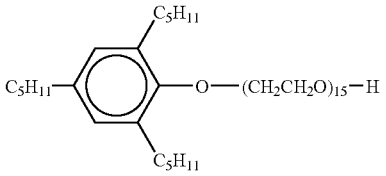

WA-17

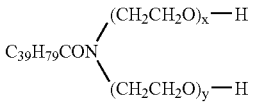

x + y = 20

WA-18

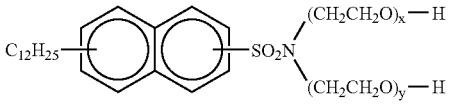

x + y = 12

WA-19

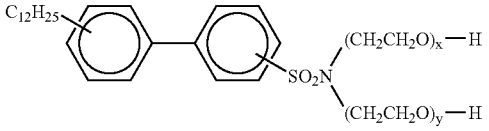

x + y = 15

Dispersed particles of the slipping agent used in the invention may be added to a slipping agent layer in the form of a dispersion. The solvent of the dispersion is not particularly limited, and may be water. For example, an usual organic solvent can be suitably selected and used at the time of dispersion. Examples thereof include ketones (for example, acetone, methyl ethyl ketone, methyl isobutyl ketone, and cyclohexanone), alcohols (for example, lower alcohols having from 1 to 8 carbon atoms such as methyl alcohol, ethyl alcohol, isopropyl alcohol, butyl alcohol, hexyl alcohol, and octyl alcohol), glycol derivatives (for example, cellosolve, ethylene glycol diethyl ether, and propylene glycol monomethyl ether), lower fatty acid esters having 1 to 5 carbon atoms (for example, ethyl acetate, butyl acetate, and ethyl propionate), haloalkanes (for example, methylene dichloride, ethylene dichloride, trichlene, trichloromethane, trichloroethane, and carbon tetrachloride), hydrocarbons (for example, octane, solvent naphtha, terpene oil, petroleum ether, thinner, petroleum benzine, benzene, toluene, and xylene), phenols (for example, phenol and resorcinol), ethers (for example, tetrahydrofuran and dioxane), phosphoric esters (for example, trimethyl phosphate, triethyl phosphate, and tributyl phosphate), DMF as an amide-based compound, and DMSO. Alcohols, ketones, glycol derivatives, lower fatty acid esters, haloalkanes, and hydrocarbons are preferable. In particular, in a mixed solvent system containing water, the solvent to be mixed with water may be a solvent which is miscible with water to form a uniform solvent such as alcohols, ketones, and glycol derivatives. When water is not used, the solvent may be selected from hydrocarbons, ketones, lower fatty acid esters, and haloalkanes.

When a coating liquid is prepared using such a solvent, the dispersion state of the slipping agent is stable, coating property is excellent, the resulting film is smooth, adhesion of photographic material debris or extraneous substance is prevented, repelling property at the time of development is improved, and scratch resistance is heightened. The foregoing organic solvent may be a mixture of two or more solvents which may be of the same class or of different classes. In the invention, the coating liquid may be a solution or fine dispersion of the slipping agent in a mixed solvent system of water and an organic solvent. The fine dispersion is obtained by known dispersion technologies such as dispersion by a mechanical shear force, ultrasonic dispersion, and precipitation by mixing of two liquids. The dispersion has a mean particle size of preferably not more than 2.0 μm, more preferably not more than 1.0 μm, still more preferably 0.005 μm to 0.5 μm. In order to reduce the mean particle size to less than 0.005 μm, a large quantity of dispersant must be used, and such a large quantity of dispersant occasionally impairs the photographic properties. When the solvent is a mixed solvent containing water, the amount of water is preferably at least 50% by volume.

Next, the dispersed particle of slipping agent usable in the invention will be hereunder described in more detail. In the dispersed particles containing the slipping agent and the dispersant represented by the formula (2), the ratio of the mass of the slipping agent to the mass of the dispersant represented by the formula (2) is not particularly limited. In a preferable embodiment, the dispersed particles contain 25 to 99 mass % of the slipping agent and 1 to 75 mass % of the dispersant. When the content of the slipping agent is high, the characteristics of the dispersed particles of the slipping agent in the outermost layer are more strongly exhibited. Accordingly, in the dispersed particle of the slipping agent, the proportion of the dispersant represented by the formula (2) is preferably lower. In a preferable embodiment, prior to the dispersing operation, the slipping agent and the dispersant are mixed at a temperature which is higher than any of the melting points of the slipping agent and the dispersant so that they are mixed in a molten state. The slipping agent dispersed particles are obtained, for example by a method comprising adding the above molten mixture to a solvent as a dispersion medium maintained at a high temperature, and finely dispersing the molten mixture by any of various dispersing processes. Alternatively, the slipping agent dispersed particles may be obtained by a method comprising adding a heated solvent to the above molten mixture and finely dispersing the molten mixture by any of various dispersing processes In another embodiment, the slipping agent and the dispersant are dissolved in a non-aqueous organic solvent, and then the solution is finely dispersed in water in the presence of a water-soluble surfactant, and then the dispersion containing dispersed slipping agent particles is added directly to the outermost layer. The non-aqueous organic solvent may be, for example, ethyl acetate. In this embodiment, the organic solvent may be optionally removed after the dispersing operation. An advantage of this embodiment is that even when the melting point of the slipping agent or the compound represented by the formula (2) is 100° C. or higher, the slipping agent and the compound represented by the formula (2) can be dissolved and mixed in the organic solvent at a low temperature to form a dispersed particle of the high-melting slipping agent in an aqueous system. The melting points of the slipping agent and the compound represented by the formula (2) are not particularly restricted. From the viewpoint of the scratch resistance, the melting points are preferably in the range of 50° C. to 200° C., more preferably in the range of 60° C. or higher, still more preferably in the range of 80° C. to 150° C. The solvent is preferably water since use of water realizes an eco-friendly production process of photothermographic materials. Accordingly, when a slipping agent having a melting point of 80° C. is used, the temperature of water should be 80° C. or higher during the dispersing operation.

3) Method of Adding Slipping Agent:

The slipping agent in the invention may be contained in a coating liquid in any form. For example, the slipping agent in the coaling liquid may be in the state of a solution in an appropriate solvent, in the state of an emulsion or dispersion, or in the state of a solid fine particle dispersion.

A well known example of the emulsification method comprises: dissolving the slipping agent in an oil such as dibutyl phthalate, tricresyl phosphate, dioctyl sebacate, or tri(2-ethylhexyl)phosphate, optionally using a cosolvent such as ethyl acetate or cyclohexanone; and then mechanically emulsifying the slipping in the presence of a dispersant such as described above. In this method, it is preferable to add a polymer such as α-methylstyrene oligomer or poly(t-butylacrylamide) to the emulsion in order to control the viscosity and the refractive index of the oil droplets.

In an embodiment, the solid particle dispersion is prepared by a method comprising dispersing powder of the slipping agent in an appropriate solvent such as water using a ball mill, a colloid mill, a vibration ball mill, a sand mill, a jet mill, a roll mill, or ultrasonic wave. A protective colloid (e.g. a polyvinyl alcohol) and/or a surfactant such as an anionic surfactant (e.g. a mixture of sodium triisopropylnaphthalenesulfonates each having a different combination of the substitution positions of the three isopropyl groups) may be used in the preparation. Beads of zirconia, etc. are commonly used as a dispersing medium in the above mills. The aqueous dispersion preferably includes an antiseptic agent such as a benzoisothiazolinone sodium salt.

The reducing agent is particularly preferably used in the state of an emulsion or dispersion. The slipping agent is preferably added in the form of fine particles having an average particle diameter of 0.01 to 10 μm, more preferably 0.05 to 5 μm, further preferably 0.1 to 2 μm.

4) Layer to which the Slipping Agent is Added and Addition Amount:

In a preferable embodiment, the slipping agent is added to the outermost layer.

The addition amount of the slipping agent is preferably 5 $mg/m^2$ to 100 $mg/m^2$, more preferably 5 $mg/m^2$ to 50 $mg/m^2$, further preferably 10 $mg/m^2$ to 50 $mg/m^2$.

(Matting Agent)

In the invention, it is preferable to incorporate a matting agent to the photothermographic material for the purpose of improving the conveyance property.

In the invention, the matting agent may be contained in the outermost layer, or in a layer functioning as the outermost layer, or in a layer in the vicinity of the surface of the photographic material. The outermost layer (which may be a protective layer) may have a double-layered structure. The matting agent is preferably added to the outermost layer. The matting agent may be added to the outermost layer on the image-forming layer side, or to the outermost layer on the back side, or to both. In a preferable embodiment, the matting agent is contained in a layer on the side of the support on which side a layer containing the slipping agent is provided.

The matting agent is preferably used in the form of a matting agent particle dispersion produced by dispersing the matting agent in the presence of a binder.

The matting agent usable in the invention is generally fine particles of a water-insoluble organic or inorganic compound. The matting agent is not particularly restricted and may be a matting agent known in the art. Examples thereof include organic matting agents described in U.S. Pat. Nos. 1,939,213, 2,701,245, 2,322,037, 3,262,782, 3,539,344 and 3,767,448 (the disclosures of which are incorporated herein by reference) and inorganic matting agents described in U.S. Pat. Nos. 1,260,772, 2,192,241, 3,257,206, 3,370,951, 3,523,022 and 3,769,020 (the disclosures of which are incorporated herein by reference).

Examples of organic compounds usable as the matting agents include water-dispersible vinyl polymers (for example, polymethyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate, and polytetrafluoroethylene), cellulose derivatives (for example, methyl cellulose, cellulose acetate, and cellulose acetate propionate), starch derivatives (for example, carboxy starch, carboxynitrophenyl starch, and a urea-formaldehyde-starch reaction product), and synthetic or natural organic polymer matting agents (for example, gelatin hardened by a known hardener and hollow hardened gelatin microcapsules obtained by coacervate hardening).

Examples of inorganic compounds usable as the matting agents include silicon dioxide, titanium dioxide, magnesium dioxide, aluminum oxide, barium sulfate, calcium carbonate, silver chloride desensitized by a known method, silver bromide desensitized by a known method, glass, and diatomaceous earth.

In the invention, polymer matting agents are more preferable.

A mixture of matting agents different in mean particle size, in size distribution or in shape can be used, in accordance with the necessity.

The size and shape of the matting agent is not particularly limited. In carrying out the invention, the particle diameter of the matting agent is preferably 0.1 μm to 30 μm, more preferably 0.3 μm to 20 μm, further preferably 0.5 μm to 10 μm. The particle size distribution of the matting agent may be narrow or broad. The variation coefficient of the particle diameter distribution of the matting agent is preferably 50% or less, more preferably 40% or less, still more preferably 30% or less. The variation coefficient is obtained according to the equation:

variation coefficient=(standard deviation of particle diameter)/(average particle diameter)×100.

Further, it is also preferable to use such a combination of two kinds of matting agents having small variation coefficients that the mean particle size of one matting agent is at least three times greater than the mean particle size of the other matting agent.

Since the matting agent largely influences haze and surface gloss of the coating film, it is preferable to suitably control the particle size, the particle shape and the particle size distribution by controlling the condition of the preparation of the matting agent or by mixing plural matting agents.

In the invention, the matting agent is preferably a matting agent made of a polymer such as the organic compounds described above. The glass transition point of the polymer is preferably 60° C. to 150° C., more preferably 80° C. to 130° C.

Examples of the matting agent usable in the invention are shown below. However, the examples should not be construed as limiting the invention.

M-1: Polyethylene particle, specific gravity: 0.90 (FLO-BEADS LE-1080, manufactured by Sumitomo Seika Chemicals Co., Ltd.)

M-2: Polyethylene particle, specific gravity: 0.93 (FLO-BEADS EA-209, manufactured by Sumitomo Seika Chemicals Co., Ltd.)

M-3: Polyethylene particle, specific gravity: 0.96 (FLO-BEADS HE-3040, manufactured by Sumitomo Seika Chemicals Co., Ltd.)

M-4: Silicone particle, specific gravity: 0.97

M-5: Silicone particle, specific gravity: 1.00 (E701, manufactured by Dow Toray Silicone Co., Ltd.)

M-6: Silicone particle, specific gravity: 1.03

M-7: Polystyrene particle, specific gravity: 1.05 (SB-6, manufactured by Sekisui Plastics Co., Ltd.)

M-8: Poly(St/MAA=97/3) copolymer particle, specific gravity: 1.05

M-9: Poly(St/MAA=90/10) copolymer particle, specific gravity: 1.06

M-10: Poly(St/MMA/MAA=50/40/10) copolymer particle, specific gravity: 1.09

M-11: Crosslinked polyethylene particle, specific gravity: 0.92

M-12: Crosslinked polyethylene particle, specific gravity: 0.95

M-13: Crosslinked polyethylene particle, specific gravity: 0.98

M-14: Crosslinked silicone particle, specific gravity: 0.99

M-15: Crosslinked silicone particle, specific gravity: 1.02

M-16: Crosslinked silicone particle, specific gravity: 1.04

M-17: Poly(St/DVB=90/10) particle, specific gravity: 1.06 (SX-713, manufactured by Soken Chemical & Engineering Co., Ltd.)

M-18: Poly(St/DVB=80/20) particle, specific gravity: 1.06 (SX-713, manufactured by Soken Chemical & Engineering Co., Ltd.)

M-19: Poly(St/DVB=70/30) particle, specific gravity: 1.07 (SX-713, manufactured by Soken Chemical & Engineering Co., Ltd.)

M-20: Poly(St/MAA/DVB=87/3/10) copolymer particle, specific gravity: 1.06 (SX-713A, manufactured by Soken Chemical & Engineering Co., Ltd.)

M-21: Poly(St/MAA/DVB=80/10/10) copolymer particle, specific gravity: 1.07 (SX-713B, manufactured by Soken Chemical & Engineering Co., Ltd.)

M-22: Poly(St/MMA/MAA/DVB=40/40/10/10) copolymer particle, specific gravity: 1.10

The content of the matting agent is preferably within such a range that the expected effects of the invention are obtained and that the original function of the layer containing the matting agent is substantially retained. The content of the matting agent is preferably 1 mg/m$^2$ to 400 mg/m$^2$, more preferably 5 mg/m$^2$ to 300 mg/m$^2$ in terms of the coating amount per 1 m$^2$ of the photographic material.

When the matting agent is contained in a layer on the image-forming layer side, in general, the content of the matting agent is usually such an amount not to develop stardust defects. The content of the matting agent is preferably such an amount that the Bekk smoothness is 500 seconds to 10,000 seconds, more preferably 500 seconds to 2,000 seconds. When the matting agent is contained in the back layer, the content of the matting agent is preferably such an amount that the Bekk smoothness is 10 seconds to 2,000 seconds, more preferably 50 seconds to 1,500 seconds. The Bekk smoothness mentioned herein is determined according to JIS P8119 and TAPPI T479 (the disclosures of which are incorporated herein by reference).

As described above, the matting agent may be contained in the outermost layer on the image-forming layer side, or in a layer adjacent to the outermost layer on the image-forming layer side, or in both. When the matting agent is used, the matting agent may be in the form of a matting agent particle dispersion obtained by dispersing the matting agent in the presence of a binder. In an example of the dispersing method, a polymer capable of forming a matting agent is dissolved in a solvent (such as a low-boiling organic solvent) to form a solution, and the solution is emulsified in an aqueous medium to obtain droplets containing the polymer, and then the solvent (such as the low-boiling organic solvent) is removed from the emulsion to form a dispersion of the matting agent. In another example of the dispersing method, fine particles of a polymer or the like capable of forming a matting agent are prepared, and a dispersion of the fine particles in an aqueous medium is prepared while preventing the occurrence of aggregation. In the invention, the latter exemplary method is preferable since the latter method does not discharge low-boiling organic solvents into the environment and is eco-friendly.

In the above methods for dispersing the matting agent, the matting agent may be mechanically dispersed in the aqueous medium in the presence of a binder as a dispersing agent by a known high-speed stirring device (such as a DISPAX emulsifier, a homomixer, a turbine mixer, or a homogenizer), an ultrasonic emulsification machine, etc. During dispersing operation, the pressure may be decreased to a pressure which is lower than atmospheric pressure so as to suppress foaming. In general, the dispersing agent is dissolved in the aqueous medium, and then the matting agent is added thereto. In an embodiment, a water dispersion of the matting agent obtained by polymerization may be directly added to the aqueous medium without undergoing drying process. The dispersing agent may be added to the dispersion liquid during the dispersing operation. Furthermore, the matting agent may be added to the dispersion liquid after completion of the dispersing operation for the purpose of stabilizing the physical properties of the dispersion. In all of these addition manners, the addition of the dispersing agent is conducted preferably by addition of a solvent (such as water or alcohol) containing the dispersing agent. The pH value of the aqueous medium may be controlled with an appropriate pH modifier during the dispersing operation or before or after the dispersing operation.

The stability of the matting agent dispersion after the dispersing operation may be improved by controlling the pH. Furthermore, a trace amount of a low-boiling organic solvent may be additionally used for the dispersing operation, and the organic solvent is usually removed after completion of the formation of fine particles.

The prepared dispersion may be preserved while stirred or may be preserved after its viscosity is heightened by using a hydrophilic colloid (for example, in a jelly state realized by use of gelatin) for the purpose of suppressing sedimentation of the matting agent during of preservation. Also, it is preferred to add an antiseptic to the dispersion for the purpose of preventing the propagation of bacteria during preservation.

At dispersing, the amount of binder is preferably 5 mass % to 300 mass % based on the amount of matting agent, more preferably 10 mass % to 200 mass % based on the amount of matting agent.

When the matting agent particle dispersion contains a surfactant, the dispersion stability of the dispersion is improved. Accordingly, it is preferable to add a surfactant to the matting agent particle dispersion. The surfactant is not particularly limited, and is preferably a fluorine compound. Specific fluorine compounds described below are more preferable.

(Fluorine Compound)

In a preferable embodiment, the photothermographic material of the invention comprises a fluorine compound having a fluoroalkyl group having 2 or more carbon atoms and 12 or less fluorine atoms. In the invention, the fluorine compound may be used as a surfactant.

The fluorine compound usable in the invention may have any structure so far as it has the foregoing fluoroalkyl group (the alkyl group which is substituted by a fluorine atom or fluorine atoms will be hereinafter referred to as "Rf"). The fluorine compound has at least one Rf, and may have two or more Rfs. The fluorine compound is preferably a fluorine compound having two or more Rfs.

Specific examples of the group represented by Rf are described below. However, the examples should not be construed as limiting the invention.

$—C_2F_5$ group, $—C_3F_7$ group, $—C_4F_9$ group, $—C_5F_{11}$ group, $—CH_2—C_4H_9$ group, $—C_4F_8—H$ group, $—C_2H_4—C_4F_9$ group, $—C_4H_8—C_4F_9$ group, $—C_6H_{12}—C_4F_9$ group, $—C_8H_{16}—C_4F_9$ group, $—C_4H_8—C_2F_5$ group, $—C_4H_8—C_3F_7$ group, $—C_4F_8—C_5F_{11}$ group, $—C_8H_{16}—C_2F_5$ group, $—C_2H_4—C_4F_8—H$ group, $—C_4H_8—C_4F_8—H$ group, $—C_6H_{12}—C_4F_8—H$ group, $—C_6H_{12}—C_2F_4—H$ group, $—C_8H_{16}—C_2F_4—H$ group, $—C_6H_{12}—C_4F_8—CH_3$ group, $—C_2H_4—C_3F_7$ group, $—C_2H_4—C_5F_{11}$ group, $—C_4H_8—CF(CF_3)_2$ group, $—CH_2CF_3$ group, $—C_4H_8—CH(C_2F_5)_2$ group, $—C_4H_8—CH(CF_3)_2$ group, $—C_4H_8—C(CF_3)_3$ group, $—CH_2—C_4F_8—H$ group, and $—CH_2—C_6F_{12}—H$ group.

The number of fluorine atoms in Rf is not more than 12, preferably in the range of 3 to 11, more preferably in the range of 5 to 9. Furthermore, the number of carbon atoms in Rf is 2 or larger, preferably in the range of 4 to 16, more preferably in the range of 5 to 12.

The structure of Rf is not particularly limited so far as Rf has 2 or more carbon atoms and 12 or less fluorine atoms. Rf is preferably a group represented by the following formula (A).

-RC-RE-W Formula (A)

In the formula (A), RC represents an alkylene group having 1 to 4 (preferably 1 to 3, more preferably 1 to 2) carbon atoms. The alkylene group represented by RC may be linear or branched.

RE represents a perfluoroalkylene group having 2 to 6 (preferably 2 to 4) carbon atoms. The term "perfluoroalkylene group" used herein refers to a group obtained by substituting all the hydrogen atoms of an alkylene group with fluorine atoms. The perfluoroalkylene group may be linear or branched, and may have a cyclic structure.

W represents a hydrogen atom, a fluorine atom, or an alkyl group, preferably a hydrogen atom or a fluorine atom, more preferably a fluorine atom.

In the invention, the fluorine compound may have a cationic hydrophilic group. The term "cationic hydrophilic group" used herein refers to a group which forms a cation when dissolved in water. Specific examples thereof include a quaternary ammonium, an alkylpyridium, an alkylimidazolinium, a primary aliphatic amine, a secondary aliphatic amine, and a tertiary aliphatic amine.

The cation is preferably an organic cationic substituent, more preferably an organic cationic group containing a nitrogen or phosphorus atom, and further preferably a pyridinium cation or an ammonium cation.

The anion species required for forming a salt may be an inorganic anion or an organic anion. Preferred examples of the inorganic anion include an iodine ion, a bromine ion, and a chlorine atom; and preferred examples of the organic anion include a p-toluenesulfonic acid ion, a benzenesulfonic acid ion, a methanesulfonic acid ion, and a trifluoromethanesulfonic acid ion.

The cationic fluorine compound preferred in the invention is represented by the following formula (1).

Formula (1)

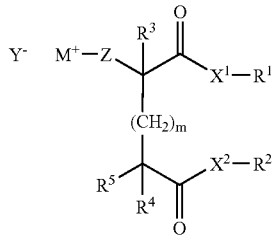

In the formula (1), $R^1$ and $R^2$ each independently represent a substituted or unsubstituted alkyl group, provided that at least one of $R^1$ and $R^2$ represents the foregoing fluoroalkyl group (Rf). In a preferable embodiment, both $R^1$ and $R^2$ represent Rfs. $R^3$, $R^4$, and $R^5$ each independently represent a hydrogen atom or a substituent; $X^1$, $X^2$, and Z each independently represent a divalent connecting group or a single bond; and $M^+$ represents a cationic substituent. $Y^-$ represents a counter anion. When the net charge of the molecule is 0 without the presence of $Y^-$, $Y^-$ may be omitted. Further, m represents 0 or 1.

In the formula (1), when $R^1$ or $R^2$ represents a substituted or unsubstituted alkyl group other than Rf, the alkyl group has one or more carbon atoms and may be linear, branched or cyclic. Examples of the substituent include a halogen atom, an alkenyl group, an aryl group, an alkoxyl group, a halogen atom other than fluorine, a carboxylic acid ester group, a carboxylic acid amide group, a carbamoyl group, an oxycarbonyl group, and a phosphoric ester group.

When $R^1$ or $R^2$ represents an alkyl group other than Rf, i.e., an alkyl group not substituted by a fluorine atom, the alkyl group is preferably a substituted or unsubstituted alkyl group having 1 to 24 carbon atoms, more preferably a substituted or unsubstituted alkyl group having 6 to 24 carbon atoms. Preferred examples of the unsubstituted alkyl group having 6 to 24 carbon atoms include an n-hexyl group, an n-heptyl group, an n-octyl group, a tert-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, an eicosyl group, a 2-octyldodecyl group, a docosyl group, a tetracosyl group, a 2-decyltetradecyl group, a tricosyl group, a cyclohexyl group, and a cycloheptyl group. Furthermore, preferred examples of the substituted alkyl group having 6 to 24 carbon atoms in total include a 2-hexenyl group, an oleyl group, a linoleyl group, a linolenyl group, a benzyl group, a β-phenethyl group, a 2-methoxyethyl group, a 4-phenylbutyl group, a 4-acetoxyethyl group, a 6-phenoxyhexyl group, a 12-phenyldodecyl group, a 18-phenyloctadecyl group, a 12-(p-chlorophenyl)dodecyl group, and 2-(diphenyl phosphate)ethyl group.

The alkyl group represented by $R^1$ or $R^2$ other than Rf is further preferably a substituted or unsubstituted alkyl group having 6 to 18 carbon atoms. Preferred examples of the unsubstituted alkyl group having 6 to 18 carbon atoms include an n-hexyl group, a cyclohexyl group, an n-heptyl group, an n-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, and a 4-tert-butylcyclohexyl group. Furthermore, preferred examples of the substituted alkyl group having 6 to 18 carbon atoms in total include a phenethyl group, a 6-phenoxyhexyl group, a 12-phenyldodecyl group, an oleyl group, a lionleyl group, and a linolenyl group.

The alkyl group represented by $R^1$ or $R^2$ other than Rf is still more preferably an n-hexyl group, a cyclohexyl group, an n-heptyl group, an n-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, an oleyl group, a linoleyl group, or a linolenyl group. Above all, linear, cyclic or branched unsubstituted alkyl groups having 8 to 16 carbon atoms are the most preferable.

In the formula (1), $R^3$, $R^4$, and $R^5$ each independently represent a hydrogen atom or a substituent. Examples of the substituent include an alkyl group (preferably an alkyl group having 1 to 20 carbon atoms, more preferably having 1 to 12 carbon atoms, especially preferably having 1 to 8 carbon atoms; examples thereof include a methyl group, an ethyl group, an isopropyl group, a tert-butyl group, an n-octyl group, an n-decyl group, an n-hexadecyl group, a cyclopropyl group, a cyclopentyl group, and a cyclohexyl group), an alkenyl group (preferably an alkenyl group having 2 to 20 carbon atoms, more preferably having 2 to 12 carbon atoms, and especially preferably having 2 to 8 carbon atoms; examples thereof include a vinyl group, an allyl group, a 2-butenyl group, and a 3-pentenyl group), an alkynyl group (preferably an alkynyl group having 2 to 20 carbon atoms, more preferably having 2 to 12 carbon atoms, and especially preferably having 2 to 8 carbon atom; examples thereof include a propargyl group and a 3-pentynyl group), an aryl group (preferably an aryl group having 6 to 30 carbon atoms, more preferably having 6 to 20 carbon atoms, and especially preferably having 6 to 12 carbon atoms; examples thereof include a phenyl group, a p-methylphenyl group, and a naphthyl group), a substituted or unsubstituted amino group (preferably an amino group having 0 to 20 carbon atoms, more preferably having 0 to 10 carbon atoms, especially preferably having 0 to 6 carbon atoms; examples thereof include an unsubstituted amino group, a methylamino group, a dimethylamino group, a diethylamino group, and a dibenzylamino group), an alkoxy group (preferably an alkoxy group having 1 to 20 carbon atoms, more preferably having 1 to 12 carbon atoms, especially preferably having 1 to 8 carbon atoms; examples thereof include a methoxy group, an ethoxy group, and a butoxy group), an aryloxy group (preferably an aryloxy group having 6 to 20 carbon atoms, more preferably having 6 to 16 carbon atoms, especially preferably having 6 to 12 carbon atoms; examples thereof include a phenyloxy group and a 2-naphthyloxy group), an acyl group (preferably an acyl group having 1 to 20 carbon atoms, more preferably having 1 to 16 carbon atoms, especially preferably having 1 to 12 carbon atoms; examples thereof include an acetyl group, a benzoyl group, a formyl group, and a pivaloyl group), an alkoxycarbonyl group (preferably an alkoxycarbonyl group having 2 to 20 carbon atoms, more preferably having 2 to 16 carbon atoms, especially preferably having 2 to 12 carbon atoms; examples thereof include a methoxycarbonyl group and an ethoxycarbonyl group), an aryloxycarbonyl group (preferably an aryloxycarbonyl group having 7 to 20 carbon atoms, more preferably having 7 to 16 carbon atoms, especially preferably having 7 to 10 carbon atoms; examples thereof include a phenyloxycarbonyl group), an acyloxy group (preferably an acyloxy group having 2 to 20 carbon atoms, more preferably having 2 to 16 carbon atoms, especially preferably having 2 to 10 carbon atoms; examples thereof include an acetoxy group and a benzoyloxy group), an acylamino group (preferably an acylamino group having 2 to 20 carbon atoms, more preferably having 2 to 16 carbon atoms, especially preferably having 2 to 10 carbon atoms; examples thereof include an acetylamino group and a benzoylamino group), an alkoxycarbonylamino group (preferably an alkoxycarbonylamino group having 2 to 20 carbon atoms, more preferably having 2 to 16 carbon atoms, especially preferably having 2 to 12 carbon atoms; examples thereof include a methoxycarbonylamino group), an aryloxycarbonylamino group (preferably an aryloxycarbonylamino group having 7 to 20 carbon atoms, more preferably having 7 to 16 carbon atoms, especially preferably having 7 to 12 carbon atoms; examples thereof include a phenyloxycarbonylamino group), a sulfonylamino group (preferably a sulfonylamino group having 1 to 20 carbon atoms, more preferably having 1 to 16 carbon atoms, especially preferably having 1 to 12 carbon atoms; examples thereof include a methanesulfonylamino group and a benzenesulfonylamino group), a sulfamoyl group (preferably a sulfamoyl group having 0 to 20 carbon atoms, more preferably having 0 to 16 carbon atoms, especially preferably having 0 to 12 carbon atoms; examples thereof include a sulfamoyl group, a methylsulfamoyl group, a dimethylsulfamoyl group, and a phenylsulfamoyl group), a carbamoyl group (preferably a carbamoyl group having 1 to 20 carbon atoms, more preferably having 1 to 16 carbon atoms, especially preferably having 1 to 12 carbon atoms; examples thereof include an unsubstituted carbamoyl group, a methylcarbamoyl group, a diethylcarbamoyl group, and a phenylcarbamoyl group), an alkylthio group (preferably an alkylthio group having 1 to 20 carbon atoms, more preferably having 1 to 16 carbon atoms, especially preferably having 1 to 12 carbon atoms; examples thereof include a methylthio group and an ethylthio group), an arylthio group (preferably an arylthio group having 6 to 20 carbon atoms, more preferably having 6 to 16 carbon atoms, especially preferably having 6 to 12 carbon atoms; examples thereof include a phenylthio group), a sulfonyl group (preferably a sulfonyl group having 1 to 20 carbon atoms, more preferably having 1 to 16 carbon atoms, especially preferably having 1 to 12 carbon atoms; examples thereof include a mesyl group and a tosyl group), a sulfinyl group (preferably a sulfinyl group having 1 to 20 carbon atoms, more preferably having 1 to 16 carbon atoms, especially preferably having 1 to 12 carbon atoms; examples thereof include a methanesulfinyl group and a benzenesulfinyl group), an ureido group (preferably an ureido group having 1 to 20 carbon atoms, more preferably having 1 to 16 carbon atoms, especially preferably having 1 to 12 carbon atoms; examples thereof include an unsubstituted ureido group, a methylureido group, and a phenylureido group), a phosphoric acid amide group (preferably a phosphoric acid amide group having 1 to 20 carbon atoms, more preferably having 1 to 16 carbon atoms, especially preferably having 1 to 12 carbon atoms; examples thereof include a diethylphosphoric acid amide group and a phenylphosphoric acid amide group), a hydroxyl group, a mercapto group, a halogen atom (for example, a fluorine atom, a chlorine atom, a bromine atom, and an iodine atom), a cyano group, a sulfo group, a carboxyl group, a nitro group, a hydroxamic acid group, a sulfino group, a hydrazino group, an imino group, a heterocyclic group (preferably a heterocyclic group having 1 to 30 carbon atoms, more preferably having 1 to 12 carbon atoms, for example, a heterocyclic group having a hetero atom (for example, a nitrogen atom, an oxygen atom, and a sulfur atom); examples thereof include an imidazolyl group, a pyridyl group, a quinolyl group, a furyl group, a piperidyl group, a morpholino group, a benzoxazolyl group, a benzimidazolyl group, and a benzothiazolyl group), and a silyl group (preferably a silyl group having 3 to 40 carbon atoms, more preferably having 3 to 30 carbon atoms, especially preferably having 3 to 24 carbon atoms; examples thereof include a trimethylsilyl group and a triphenylsilyl group). These substituents may be further substituted. When there are two or more substituents, these substituents may be the same as or different from each other. If possible, some of the substituents may be bonded to each other to form a ring.

$R^3$, $R^4$, and $R^5$ are each preferably an alkyl group or a hydrogen atom, more preferably a hydrogen atom.

In the formula (1), $X^1$ and $X^2$ each independently represent a divalent connecting group or a single bond. The divalent connecting group is not particularly restricted, and is preferably a group selected from an arylene group, —O—, —S—, and $NR^{31}$— or a group formed by combining groups selected from arylene groups, —O—, —S—, and $NR^{31}$—. $R^{31}$ represents a hydrogen atom or a substituent. When $R^{31}$ represents a substituent, examples thereof include the above-mentioned examples of substituents represented by $R^3$, $R^4$, and $R^5$. —$R^{31}$ is preferably an alkyl group, Rf mentioned above, or a hydrogen atom, more preferably a hydrogen atom). The divalent connecting group is more preferably —O—, —S—, or $NR^{31}$—. $X^1$ and $X^2$ are each more preferably —O— or $NR^{31}$—, further preferably —O— or —NH—, especially preferably —O—.

In the formula (1), Z represents a divalent connecting group or a single bond. The divalent connecting group is not particularly restricted, and is preferably a group selected from an alkylene group, an arylene group, —C(═O)—, —O—, —S—, —S(═O)—, —S(═O)$_2$—, and $NR^{32}$—, or a group formed by combination of groups selected from alkylene groups, arylene groups, —C(═O)—, —O—, —S—, —S(═O)—, —S(═O)$_2$—, and $NR^{32}$—. $R^{32}$ represents a hydrogen atom or a substituent, and examples of the substituent include the above examples of the substituents represented by $R^3$, $R^4$, and $R^5$. —$R^{32}$ is preferably an alkyl group or a hydrogen atom, more preferably a hydrogen atom. The divalent connecting group is more preferably a group selected from an alkylene group having 1 to 12 carbon atoms, an arylene group having 6 to 12 carbon atoms, —C(═O)—, —O—, —S—, —S(═O)—, —S(═O)$_2$—, and —$NR^{32}$—, or a group formed by combination of groups selected from alkylene groups having 1 to 12 carbon atoms, arylene groups having 6 to 12 carbon atoms, —C(═O)—, —O—, —S—, —S(═O)—, —S(═O)$_2$—, and —$NR^{32}$—. Z is further preferably a group selected from an alkylene group having 1 to 8 carbon atoms, —C(═O)—, —O—, —S—, —S(═O)—, —S(═O)$_2$—, and $NR^{32}$—, or a group formed by combination of groups selected from alkylene groups having 1 to 8 carbon atoms, —C(═O)—, —O—, —S—, —S(═O)—, —S(═O)$_2$—, and $NR^{32}$—. Examples thereof are shown below.

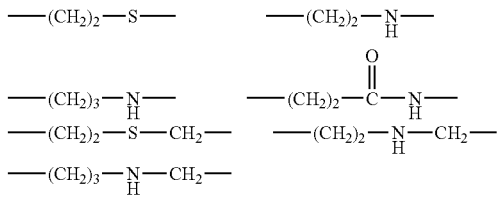

In the formula (1), $M^+$ represents a cationic substituent, preferably an organic cationic substituent, more preferably an organic cationic group containing a nitrogen or phosphorus atom. $M^+$ is further preferably a pyridinium cation or an ammonium cation, especially preferably a trialkylammonium cation represented by the following formula (2).

Formula (2)

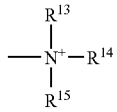

In the formula (2), $R^{13}$, $R^{14}$, and $R^{15}$ each independently represents a substituted or unsubstituted alkyl group. Examples of the substituent include the substituents described above as examples of substituents represented by $R^3$, $R^4$, and $R^5$. If possible, $R^{13}$, $R^{14}$, and $R^{15}$ may be bonded to each other to form a ring. $R^{13}$, $R^{14}$, and $R^{15}$ each preferably represent an alkyl group having 1 to 12 carbon atoms, more preferably an alkyl group having 1 to 6 carbon atoms, further preferably a methyl group, an ethyl group, or a methylcarboxyl group, especially preferably a methyl group.

In the formula (1), $Y^-$ represents a counter anion which may be an inorganic anion or an organic anion. Furthermore, when the net charge of the molecule is 0 without the presence of $Y^-$, $Y^-$ may be omitted. Preferred examples of the inorganic anion include an iodine ion, a bromine ion, and a chlorine ion; and examples of the organic anion include a p-toluenesulfonic acid ion, a benzenesulfonic acid ion, a methanesulfonic acid ion, and a trifluoromethanesulfonic acid ion. $Y^-$ is more preferably an iodine ion, a p-toluenesulfonic acid ion, or a benzenesulfonic acid ion, further preferably a p-toluenesulfonic acid ion.

In the formula (1), m represents 0 or 1, preferably 0.

Among the compounds represented by the formula (1), compounds represented by the formula (1-a) are preferable.

Formula (1-a)

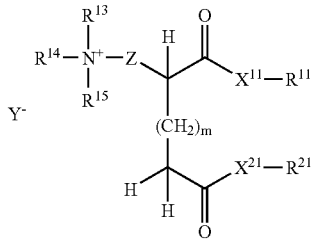

In the formula (1-a), $R^{11}$ and $R^{21}$ each independently represent a substituted or unsubstituted alkyl group, provided that at least one of $R^{11}$ and $R^{21}$ represents Rf defined above and that the total sum of the carbon atoms of $R^{11}$ and $R^{21}$ is not more than 19. $R^{13}$, $R^{14}$, and $R^{15}$ each independently represent a substituted or unsubstituted alkyl group, and some of $R^{13}$, $R^{14}$, and $R^{15}$ may be bonded to each other to form a ring. $X^{11}$ and $X^{21}$ each independently represent —O—, —S—, or $NR^{31}$—; $R^{31}$ represents a hydrogen atom or a substituent; and Z represents a divalent connecting group or a single bond. $Y^-$ represents a counter anion. When the net charge of the molecule is 0 without the presence of $Y^-$, $Y^-$ may be omitted.

In the formula (1-a), m represents 0 or 1. In the formula (1-a), the meanings and preferable ranges of Z and $Y^-$ are the same as in the foregoing formula (1). The meanings and preferable ranges of $R^{13}$, $R^{14}$, $R^{15}$, and m are also the same as in the foregoing formula (1).

In the formula (1-a), $X^{11}$ and $X^{21}$ each independently represent —O—, —S—, or $NR^{31}$— (wherein $R^{31}$ represents a hydrogen atom or a substituent, and examples of the substituent include the substituents described above as examples of substituents represented by $R^3$, $R^4$, and $R^5$). $R^{31}$ preferably represents an alkyl group, Rf defined above, or a hydrogen atom, more preferably a hydrogen atom. $X^{11}$ and $X^{21}$ are each more preferably —O— or —NH—, further preferably —O—.

In the formula (1-a), $R^{11}$ and $R^{21}$ are respectively synonymous with $R^1$ and $R^2$ in the foregoing formula (1), and preferred examples thereof are also the same, provided that the total sum of the carbon atoms of $R^{11}$ and $R^{21}$ is not more than 19. In the formula (1-a), m represents 0 or 1.

Specific examples of the compound represented by the formula (1) will be given below, but the specific examples should not be construed as limiting the invention. In the following structures of exemplified compounds, an "alkyl group" and a "perfluoroalkyl group" respectively mean a "linear alkyl group" and a "linear perfluoroalkyl group", unless otherwise indicated. Furthermore, in the following description, an abbreviation "2EH" means a 2-ethylhexyl group.

FS-1

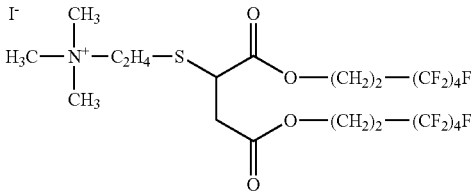

FS-2

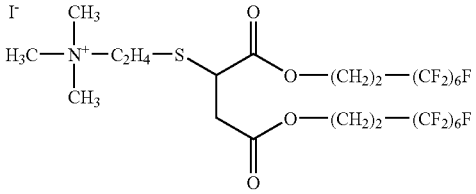

FS-3

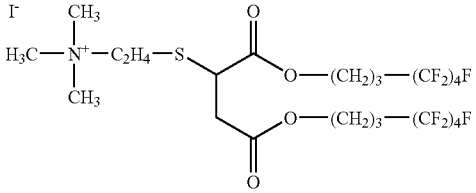

-continued

FS-4

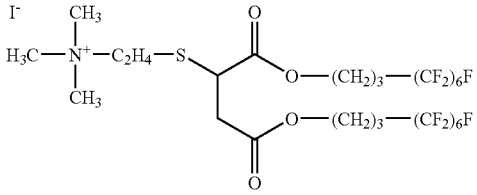

FS-5

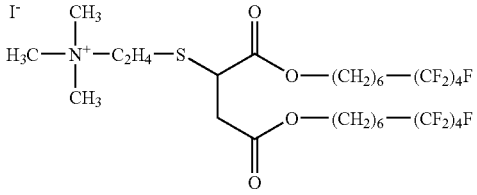

FS-6

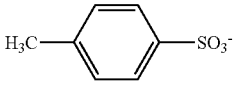

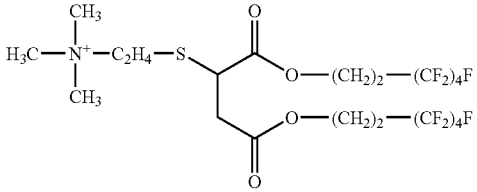

FS-7

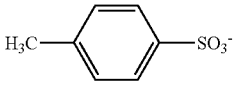

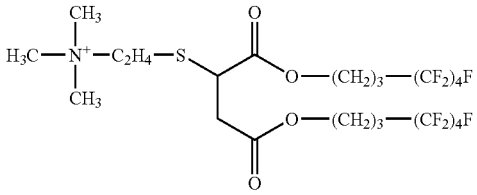

FS-8

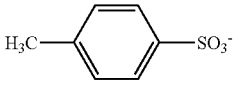

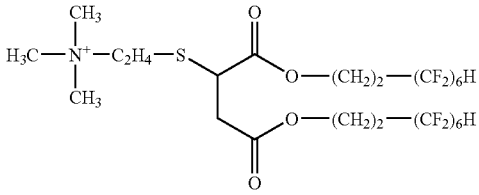

FS-9

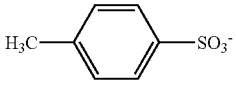

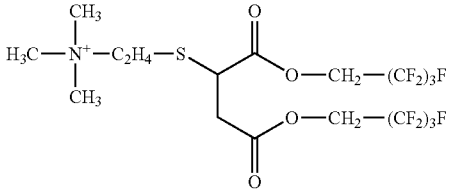

-continued
FS-10
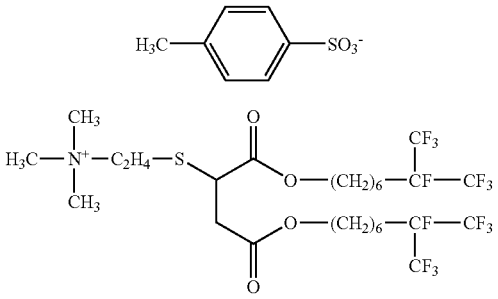
FS-11
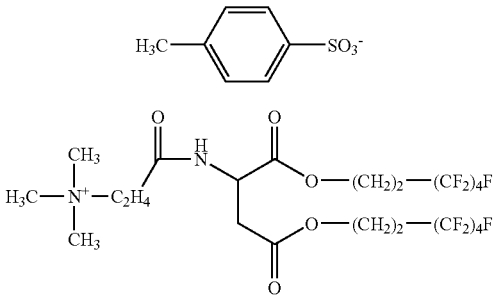
FS-12
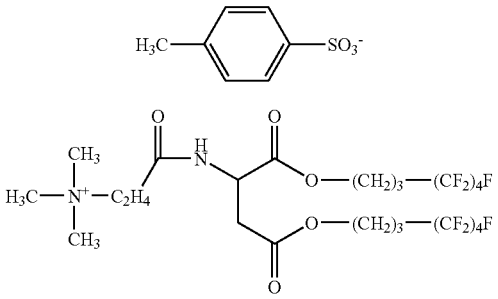
FS-13
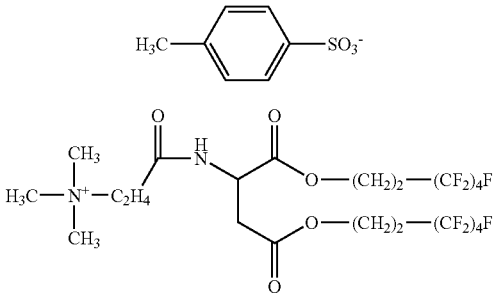
FS-14
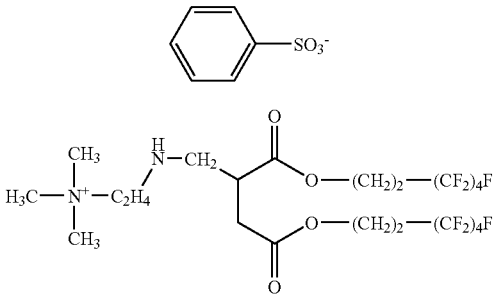
-continued
FS-15
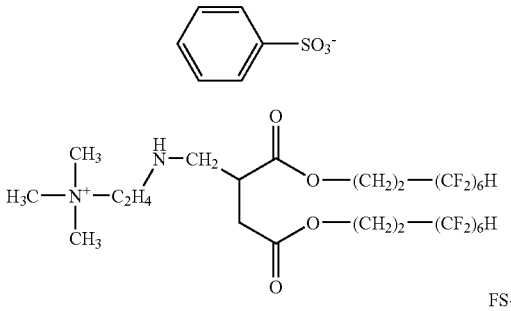
FS-16
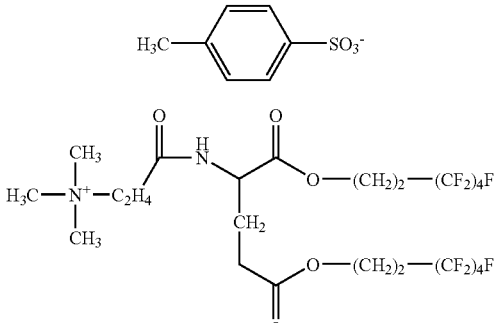
FS-17
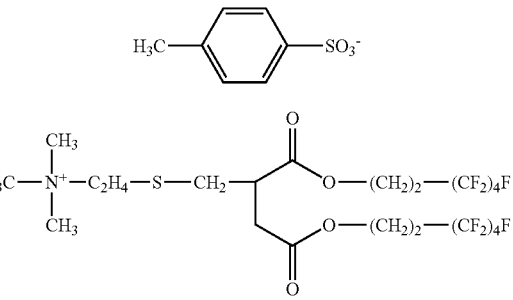
FS-18
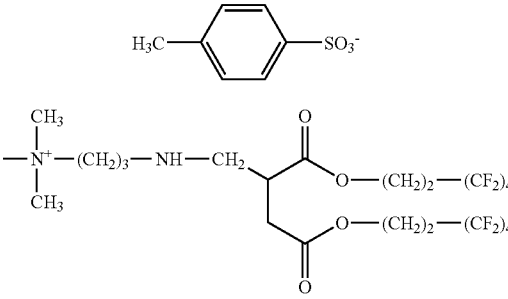
FS-19
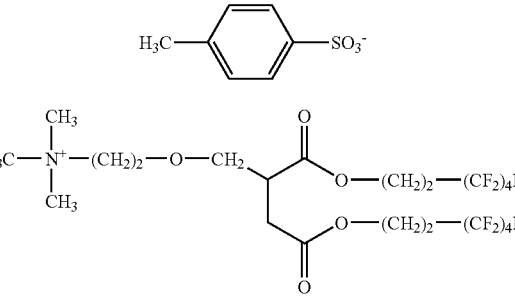

-continued
FS-20
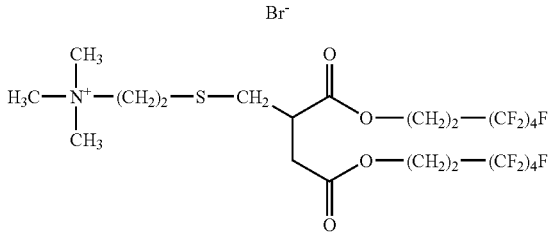
FS-21
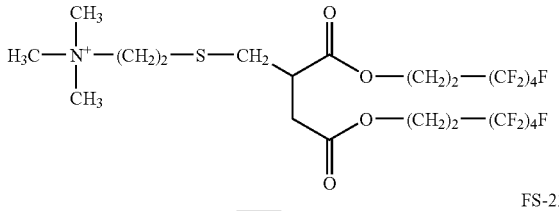
FS-22
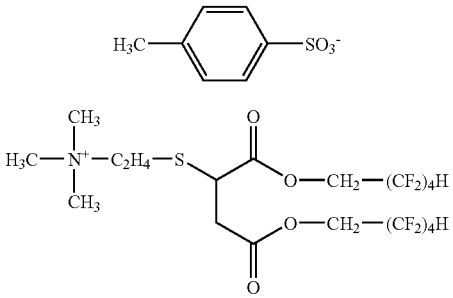
FS-23
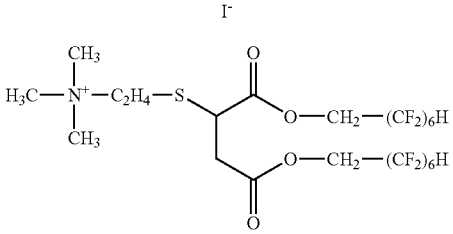
FS-24
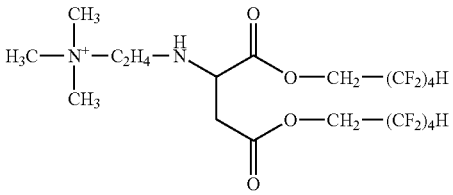
FS-25
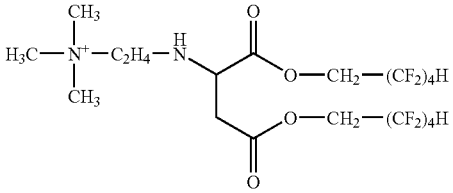
-continued
FS-26
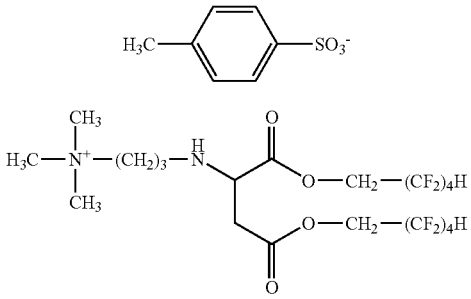
FS-27
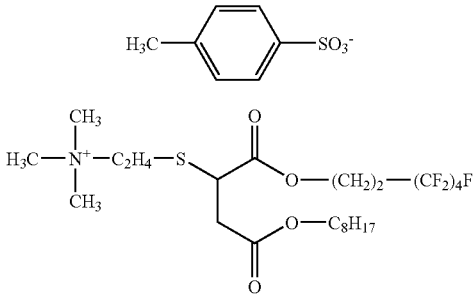
FS-28
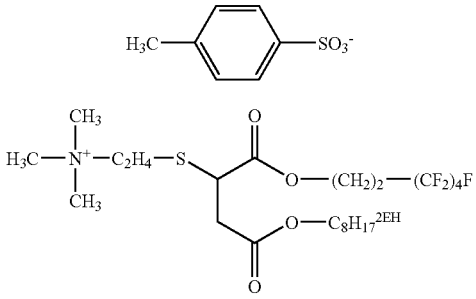
FS-29
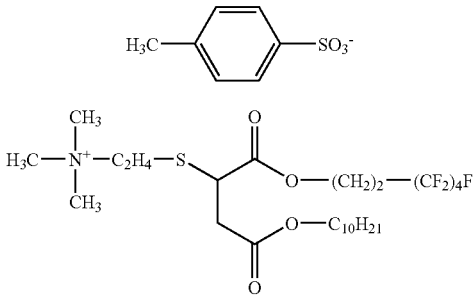
FS-30
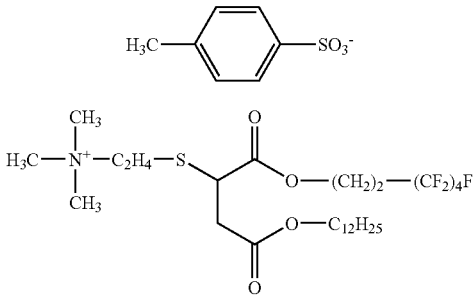

-continued
FS-31
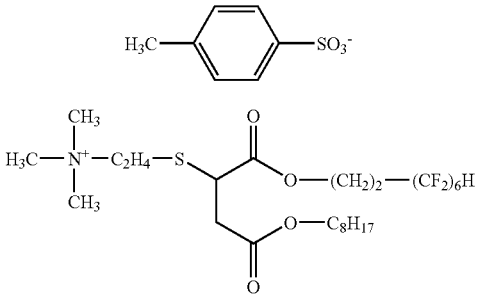
FS-32
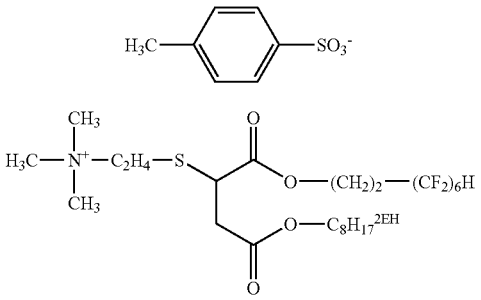
FS-33
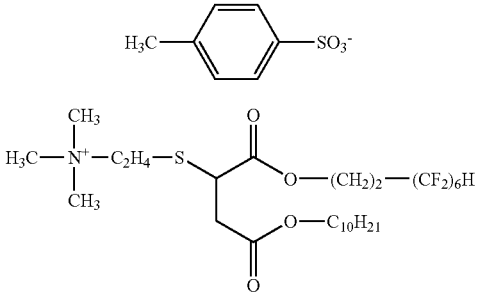
FS-34
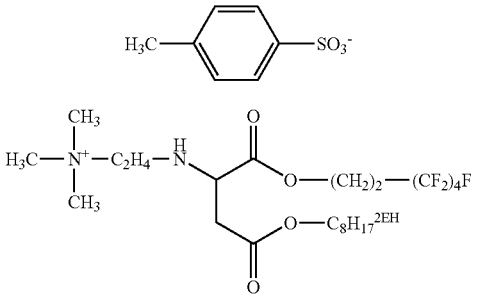
FS-35
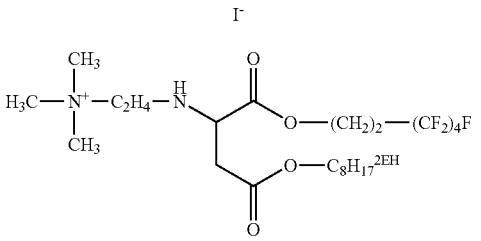
-continued
FS-36
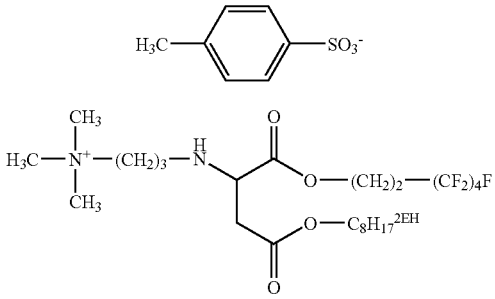
FS-37
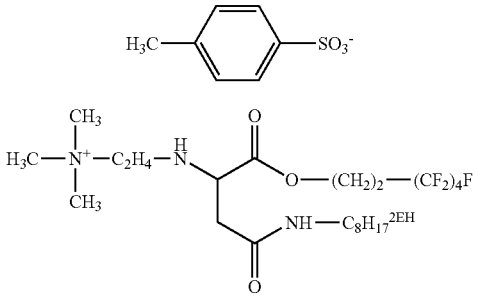
FS-38
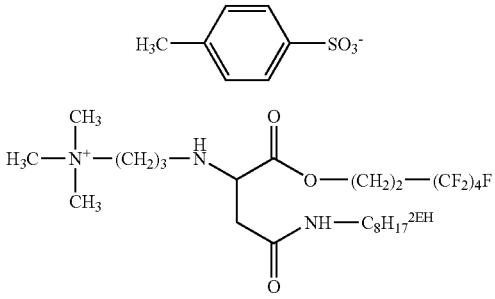
FS-39
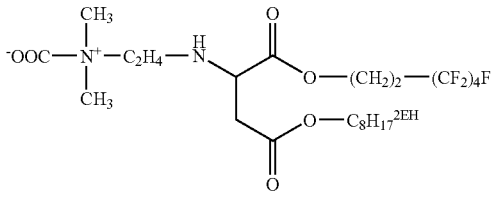
FS-40
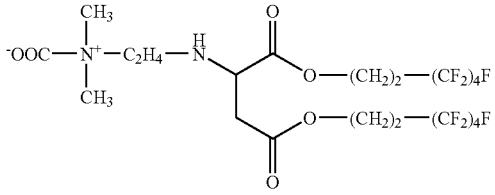

-continued
FS-41
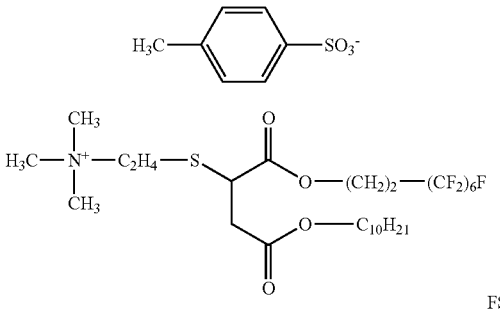
FS-42
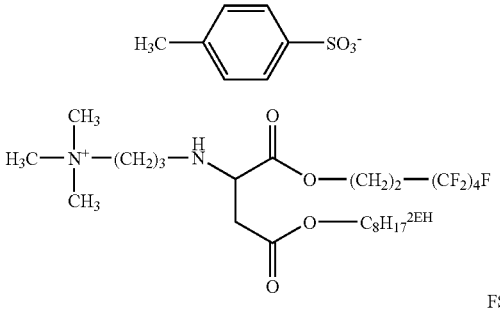
FS-43
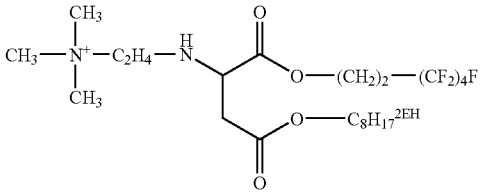
FS-44
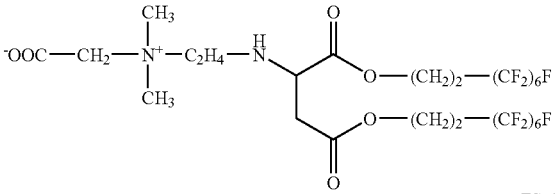
FS-45
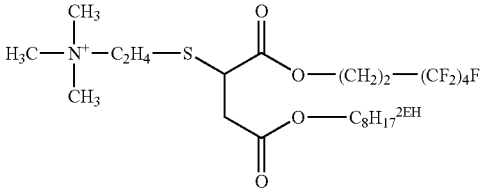
FS-46
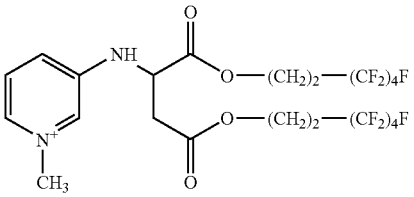
-continued
FS-47
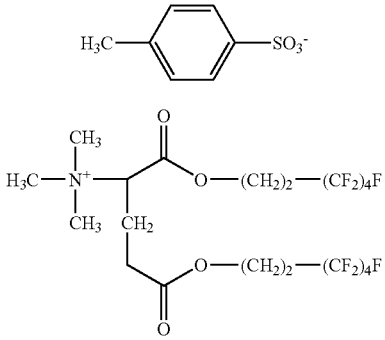
FS-48
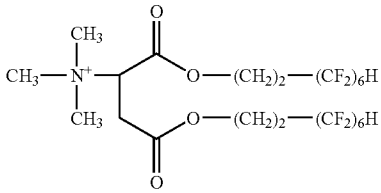
FS-49
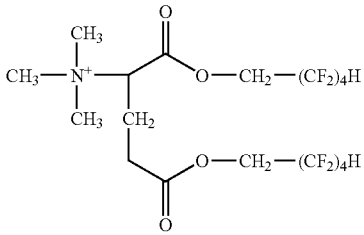
FS-50
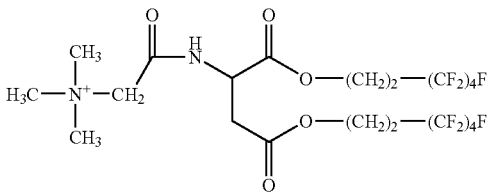
FS-51
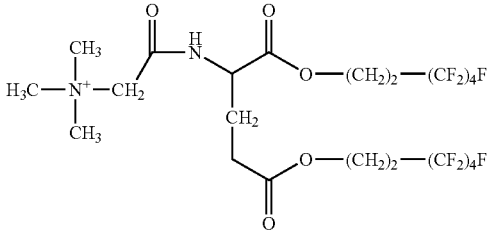

-continued
FS-52
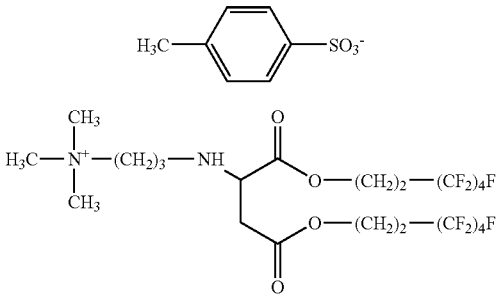
FS-53
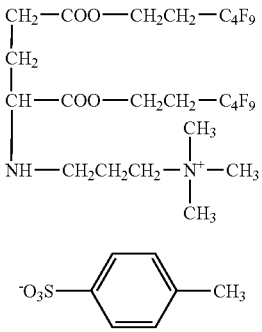
FS-54
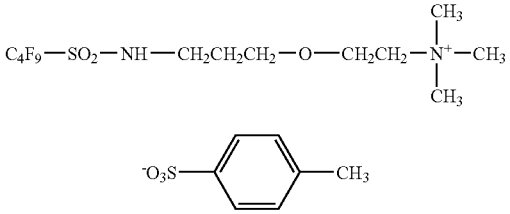
FS-55
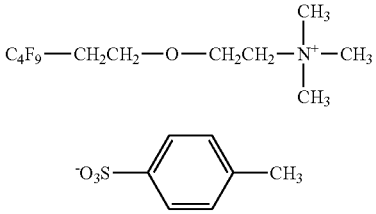
FS-56
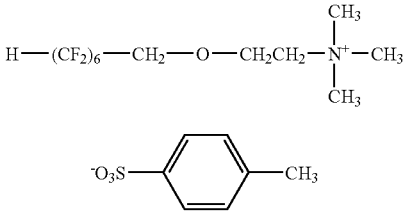
FS-57
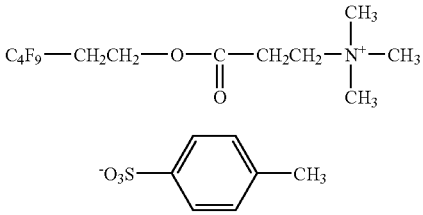
-continued
FS-58
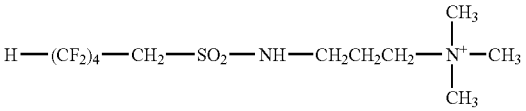
$I^-$
FS-59
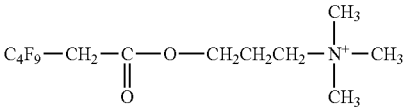
$Br^-$
FS-60
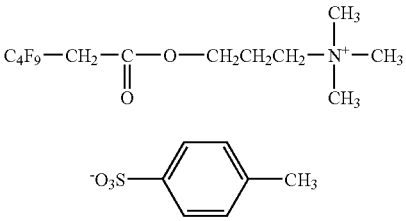
FS-61
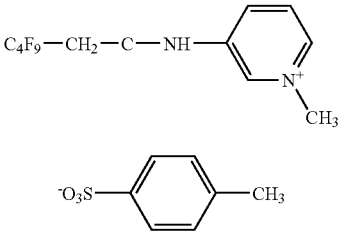
FS-62
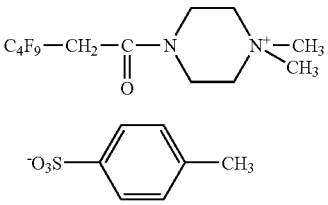
FS-63
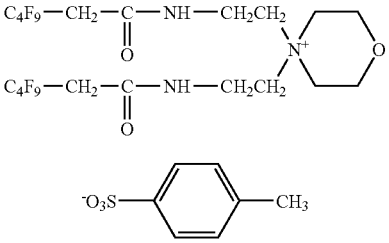
FS-64
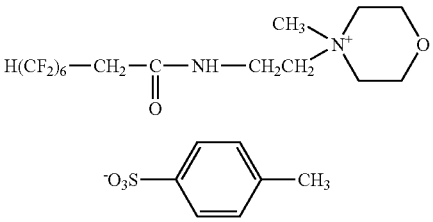

-continued

FS-65

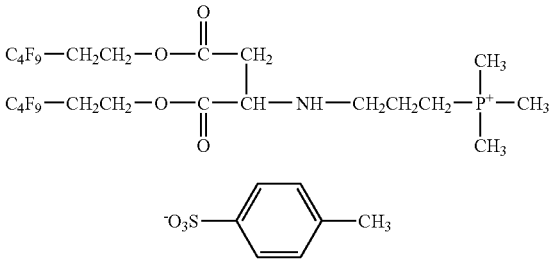

FS-66

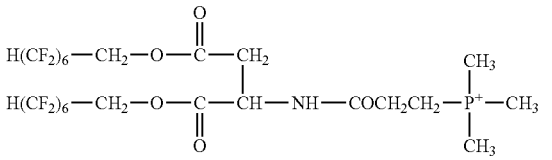

I⁻

Next, an example of a general synthesis method of compounds represented by the foregoing formula (1) or (1-a) usable in the invention will be described. However, the invention is by no means limited to the example.

These compounds can be synthesized by using a raw material such as a fumaric acid derivative, a maleic acid derivative, an itaconic acid derivative, a glutamic acid derivative, or an aspartic acid derivative. For example, when a fumaric acid derivative, a maleic acid derivative, or an itaconic acid derivative is used as the raw material, the target compound can be synthesized by subjecting the double bond of the raw material to the Michael addition reaction with a nucleophilic species and then making the reaction product cationic by an alkylating agent.

The fluorine compound in the invention may have an anionic hydrophilic group.

The term "anionic hydrophilic group" used herein refers to an acidic group having a pKa of not more than 7 or an alkali metal salt or ammonium salt thereof. Specific examples thereof include a sulfo group, a carboxyl group, a phosphonic acid group, a carbamoylsulfamoyl group, a sulfamoylsulfamoyl group, an acylsulfamoyl group, and salts thereof. Among them, a sulfo group, a carboxyl group, a phosphonic acid group, and salts thereof are preferable; and a sulfo group and salts thereof are more preferable. Examples of the cation species required for forming a salt include lithium, sodium, potassium, cesium, ammonium, tetramethylammonium, tetrabutylammonium, and methylpyridinium. Among them, lithium, sodium, potassium, and ammonium are preferable.

In the invention, the fluorine compound having an anionic hydrophilic group is preferably a compound represented by the following formula (3).

Formula (3)

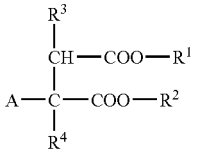

In the formula (3), $R^1$ and $R^2$ each independently represent an alkyl group, and at least one of $R^1$ and $R^2$ represents Rf. When $R^1$ or $R^2$ represents an alkyl group other than a fluoroalkyl group, the alkyl group is preferably an alkyl group having 2 to 18 carbon atoms, more preferably having 4 to 12 carbon atoms. $R^3$ and $R^4$ each independently represent a hydrogen atom or a substituted or unsubstituted alkyl group.

Specific examples of the fluoroalkyl group represented by $R^1$ or $R^2$ include the examples of Rf described above, and the fluoroalkyl group preferably has a structure represented by the foregoing formula (A). Also, preferred examples of the structure represented by the formula (A) include the above examples of the structure of the formula (A). In a preferable embodiment, the alkyl groups represented by $R^1$ and $R^2$ are both fluoroalkyl groups within the scope of Rf.

The substituted or unsubstituted alkyl group represented by $R^3$ or $R^4$ may be linear or branched or may have a cyclic structure. The substituent on the alkyl group is not particularly limited, and is preferably an alkenyl group, an aryl group, an alkoxy group, a halogen atom (preferably Cl), a carboxylic acid ester group, a carbonamide group, a carbamoyl group, an oxycarbonyl group, or a phosphoric ester group.

In the formula (3), A represents $—L_b—SO_3M$, wherein M represents a cation. Examples of the cation represented by M include alkali metal ions (for example, a lithium ion, a sodium ion, and a potassium ion), alkaline earth metal ions (for example, a barium ion and a calcium ion), and an ammonium ion. Among them, a lithium ion, a sodium ion, a potassium ion, and an ammonium ion are more preferable; and a lithium ion, a sodium ion, and a potassium ion are further preferable. The cation may be suitably selected based on the total carbon atom number of the compound of the formula (3), the substituent of the compound of the formula (3), the degree of branching of the alkyl group in the compound of the formula (3), and the like. When the total carbon atom number of $R^1$, $R^2$, $R^3$, and $R^4$ is 16 or larger, use of lithium ion as M is advantageous from the viewpoint of the balance between the solubility (especially in water) and antistatic ability or coating uniformity.

$L_b$ represents a single bond or a substituted or unsubstituted alkylene group. The substituent is preferably selected from the above examples of the substituent on $R^3$. When $L_b$ is an alkylene group, the carbon atom number is preferably not larger than 2. $L_b$ is preferably a single bond or a $—CH_2—$ group, more preferably a $—CH_2—$ group.

In an embodiment, the compound represented by the formula (3) comprises a combination of the groups which are selected from the above-described preferable examples of the groups represented by the respective reference characters.

Specific examples of the fluorine compound usable in the invention are shown below. However, the invention is by no means limited to these specific examples.

In the description of structures of the exemplified compounds, an alkyl group and a perfluoroalkyl group mean a linear alkyl group and a linear perfluoroalkyl group respectively, unless otherwise indicated.

(F-1)

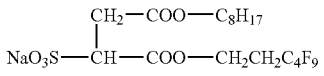

(F-2)

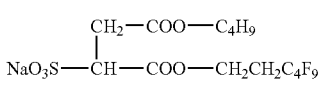

-continued
(F-3)
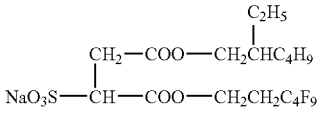
(F-4)
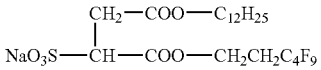
(F-5)
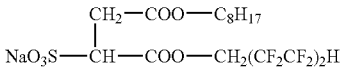
(F-6)
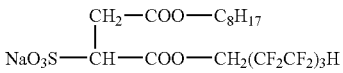
(F-7)
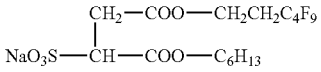
(F-8)
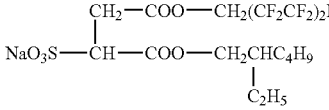
(F-9)
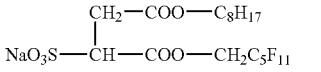
(F-10)
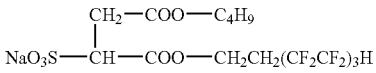
(F-11)
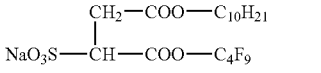
(F-12)
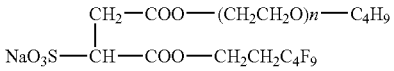
$n = 5\sim15$
(F-13)
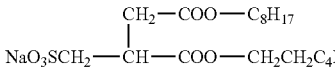
(F-14)
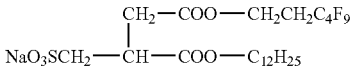
(F-15)
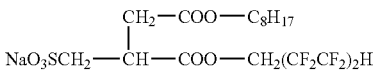
(F-16)
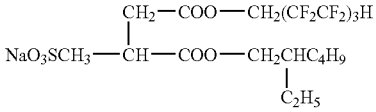
(F-17)
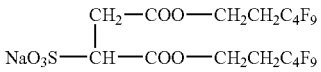
(F-18)
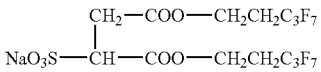
(F-19)
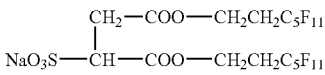
-continued
(F-20)
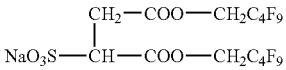
(F-21)
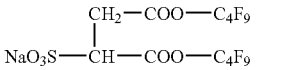
(F-22)
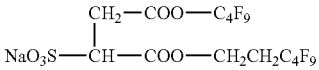
(F-23)
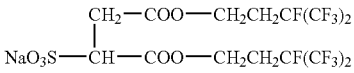
(F-24)
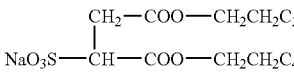
(F-25)
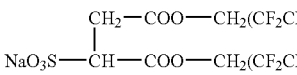
(F-26)
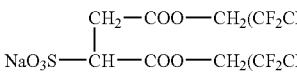
(F-27)
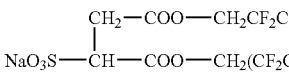
(F-28)
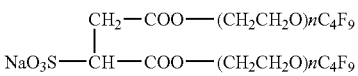
$n = 5\sim15$
(F-29)
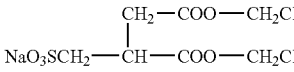
(F-30)
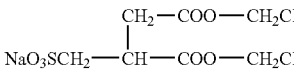
(F-31)
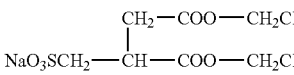
(F-32)
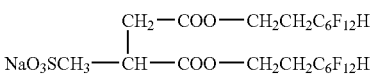
(F-33)
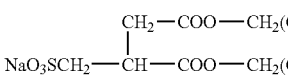
(F-34)
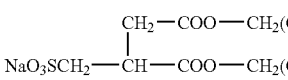
(F-35)
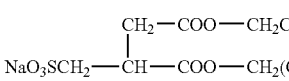
(F-36)
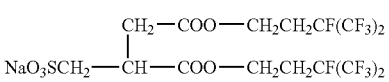
(F-37)
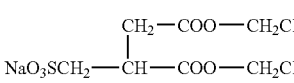

-continued (F-38)

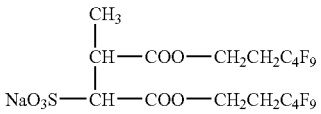

(F-39)

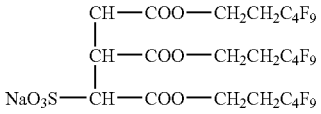

(F-40)

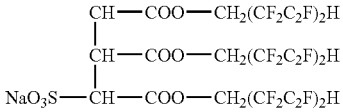

(F-41)

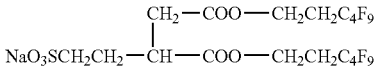

(F-42)

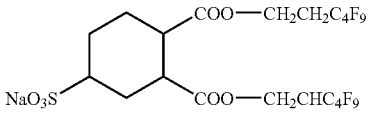

(F-43)

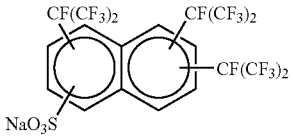

(F-44)

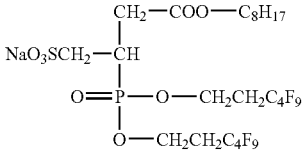

(F-45)

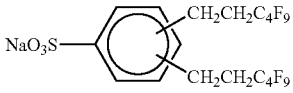

(F-46)

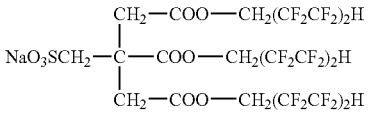

(F-47)

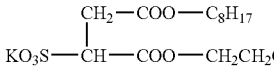

(F-48)

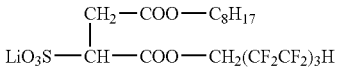

(F-49)

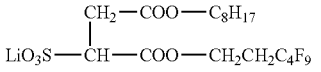

(F-50)

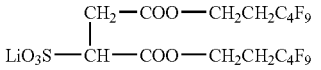

(F-51)

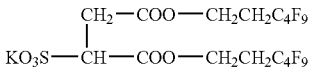

(F-52)

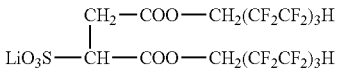

-continued (F-53)

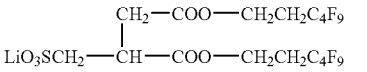

(F-54)

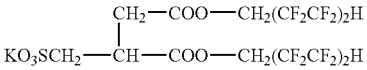

(F-55)

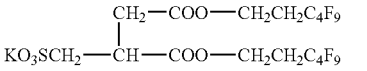

(F-56)

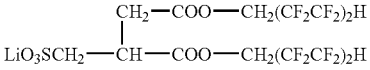

The fluorine compound may have a nonionic hydrophilic group. The term "nonionic hydrophilic group" used herein refers to a group which dissolves in water without dissociation into ions. Specific examples thereof include poly(oxyethylene) alkyl ethers and polyhydric alcohols.

In the invention, the nonionic fluorine compound is preferably a compound represented by the following formula (4).

Formula (4)

In the formula (4), Rf represents a fluoroalkyl group described above. Specific examples of Rf are the same as the above-mentioned specific examples of Rf. Preferable structural examples of Rf are the structures represented by the foregoing formula (A). Preferable structures thereof are also the same as described above.

In the formula (4), X represents a divalent connecting group. The divalent connecting group is not particularly restricted, and may be selected from the following groups.

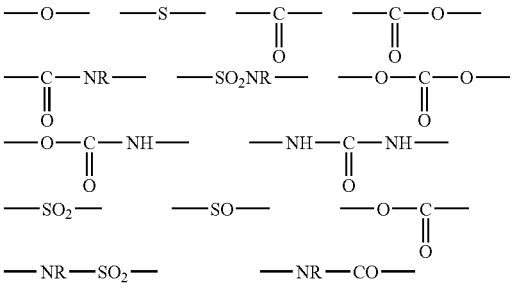

In the formula (4), n represents an integer of 2 or 3; and m represents an integer of 1 to 30. R represents a hydrogen atom, an alkyl group, an aryl group, a heterocyclic group, Rf, or a group having one or more Rfs as substituents.

Specific examples of the nonionic fluorine compound usable in the invention are shown below. However, the invention is by no means limited to these specific examples.

FN-1 n = 5~15

FN-2 n = 5~15

-continued

FN-3

$C_4F_9CH_2COO—(CH_2CH_2O)_n—H$ n = 5~15

FN-4

$C_4F_9CH_2CONH—(CH_2CH_2O)_n—H$ n = 5~15

FN-5

$C_4F_9CH_2SO_2NH—(CH_2CH_2O)_n—H$ n = 5~15

FN-6

$C_4F_9CH_2CH_2NHCOO—(CH_2CH_2O)_n—H$ n = 5~15

FN-7

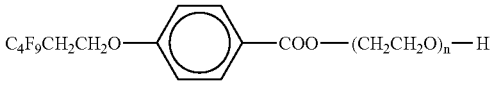

n = 5~15

FN-8

$H(CF_2)_4CH_2O—(CH_2CH_2CH_2O)_n—H$ n = 5~15

FN-9

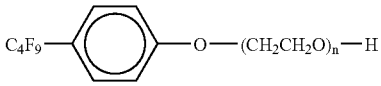

n = 5~15

FN-10

$C_4F_9CH_2CH_2O—(CH_2CH_2O)_{n1}—(CH_2CH_2CH_2O)_{n2}—(CH_2CH_2O)_{n3}—H$ n1 = 5~10
n2 = 5~10
n3 = 5~10

FN-11

$C_4F_9CH_2CH_2O—(CH_2CH_2O)_n—CH_3$ n = 10~20

FN-12

$C_4F_9CH_2CH_2O—(CH_2CH_2O)_n—C_4H_9$ n = 10~20

FN-13

$C_4F_9CH_2CH_2O—(CH_2CH_2O)_n—CH_2CH_2C_4H_9$ n = 10~20

FN-14

$$\begin{array}{l} CH_2COO—(CH_2CH_2O)_n—CH_2CH_2C_4H_9 \\ | \\ CH_2COO—(CH_2CH_2O)_n—CH_2CH_2C_4H_9 \end{array}$$

n = 5~10

FN-15

$$\begin{array}{l} CH_2COO—(CH_2CH_2O)_n—CH_2CH_2C_4H_9 \\ | \\ CHCOO—(CH_2CH_2O)_n—CH_2CH_2C_4H_9 \\ | \\ CH_2COO—(CH_2CH_2O)_n—CH_2CH_2C_4H_9 \end{array}$$

n = 5~10

FN-16

$$\begin{array}{l} CH_2O—(CH_2CH_2O)_n—CH_2CH_2C_4H_9 \\ | \\ CHO—(CH_2CH_2O)_n—CH_2CH_2C_4H_9 \\ | \\ CH_2O—(CH_2CH_2O)_n—CH_2CH_2C_4H_9 \end{array}$$

n = 5~10

-continued

FN-17

$H—C_6F_{12}CH_2O—(CH_2CH_2O)_n—CH_2C_6F_{12}—H$ n = 5~10

FN-18

$$\begin{array}{l} \quad\quad\quad CH_2O—(CH_2CH_2O)_n—CH_2(CF_2)_4H \\ \quad\quad\quad | \\ C_2H_5—C—CH_2O—(CH_2CH_2O)_n—CH_2(CF_2)_4H \\ \quad\quad\quad | \\ \quad\quad\quad CH_2O—(CH_2CH_2O)_n—CH_2(CF_2)_4H \end{array}$$

n = 5~10

The fluorine compound usable in the invention may be used as a surfactant preferably in a coating composition for forming any layer on the image-forming layer side of the support. It is more preferable to use the fluorine compound in the coating composition for forming the outermost layer of the photographic photosensitive material because the fluorine compound in the outermost layer realizes effective antistatic property and coating uniformity. The fluorine compound is useful in view of antistatic ability and coating uniformity. In addition, it is also effective for improving the storage stability and environment dependency in use.

The amount of the fluorine compound to be used in the invention is not particularly restricted. The amount of the fluorine compound may be determined based on the structure and position of the fluorine compound and on the types and amount of other materials to be contained in the composition. For example, when the fluorine compound is used in the coating liquid for the outermost layer of the photothermographic material, the coating amount of the fluorine compound contained in the coating composition is preferably 0.1 $mg/m^2$ to 100 $mg/m^2$, more preferably 0.5 $mg/m^2$ to 20 $mg/m^2$.

In the invention, only a single fluorine compound may be used, or a mixture of two or more fluorine compounds may be used. Furthermore, a fluorine compound other than the fluorine compound defined above may be used additionally. In addition, a surfactant other than the fluorine compound may be used jointly with the fluorine compound described in the invention.

(Non-Photosensitive Organic Silver Salt)

1) Composition

The non-photosensitive organic silver salt used in the invention is an organic silver salt which is relatively stable to light and which supplies a silver ion when heated to 80° C. or higher in the presence of exposed photosensitive silver halide and a reducing agent, to form a silver image. The organic silver salt may be any organic substance that can be reduced by a reducing agent to provide a silver ion. Such non-photosensitive organic silver salts are described, for example, in JP-A No. 10-62899, Paragraph 0048 to 0049, EP-A No. 0803764A1, Page 18, Line 24 to Page 19, Line 37, EP-A No. 0962812A1, JP-A Nos. 11-349591, 2000-7683, and 2000-72711, the disclosures of which are incorporated herein by reference. The organic silver salt is preferably a silver salt of an organic acid, more preferably a silver salt of a long-chain aliphatic carboxylic acid having 10 to 30 carbon atoms, still more preferably a silver salt of a long-chain aliphatic carboxylic acid having 15 to 28 carbon atoms. Examples of the fatty acid silver salt include silver lignocerate, silver behenate, silver arachidate, silver stearate, silver oleate, silver laurate, silver caproate, silver myristate, silver palmitate, silver erucate, and mixtures thereof. In the invention, the organic silver salt preferably has a silver behenate content of 50 to 100 mol %, more preferably 85 to 100 mol %, still more preferably 95 to 100 mol %. Further, the organic silver salt preferably has a silver erucate content of 2 mol % or less, more preferably 1 mol % or less, further preferably 0.1 mol % or less.

Further, the organic silver salt preferably has a silver stearate ratio of 1 mol % or lower so as to obtain a photothermographic material with a low Dmin, high sensitivity, and excellent image storability. The silver stearate content is more preferably 0.5 mol % or lower. In a preferable embodiment, the organic silver salt includes substantially no silver stearate.

When the organic silver salt includes silver arachidate, the silver arachidate content is preferably 6 mol % or lower from the viewpoint of achieving a low Dmin and excellent image storability. The silver arachidate content is more preferably 3 mol % or lower.

2) Shape

The shape of particles of the organic silver salt is not particularly restricted. The organic silver salt particles may be in a needle shape, a rod shape, a tabular shape, or a flaky shape.

In the invention, the organic silver salt particles are preferably in a flaky shape. It is also preferable to use organic silver salt particles in a short needle-shape, a rectangular shape, a cubic shape, or a potato-like shape, wherein each shape has a ratio of the longer axis to the shorter axis of lower than 5. Such organic silver salt particles cause less fogging which develops on the resultant photothermographic material in the heat development than long needle-shaped particles having a length ratio of the longer axis to the shorter axis of 5 or higher. The ratio of the longer axis to the shorter axis is more preferably 3 or lower, since the mechanical stability of the coating film is improved when organic silver salt particles having such a shape are used. In the invention, organic silver salt particles in a flaky shape are defined as follows. Organic silver salt particles are observed by an electron microscope, and the shape of each particle is approximated by a rectangular parallelepiped shape. The lengths of the three sides of the rectangular parallelepiped shape are respectively represented by a, b, and c in the ascending order (wherein c and b may be the same values), and a value x is calculated from the smaller values a and b according to the following equation: $x=b/a$. The values x of approximately 200 particles are calculated in the above-described manner to obtain an average x (the average of the values x). The organic silver salt particles in a flaky shape are defined as particles with an average x of 1.5 or larger. The average x is preferably 1.5 to 30, more preferably 1.5 to 15. In contrast, the organic silver salt particles in a needle-shape are defined as particles with an average x of 1 or larger but smaller than 1.5.

In the flaky particles (particles in a flaky shape), the length a may be considered as the thickness of a tabular particle having a main plane defined by the sides with the lengths b and c. The average of the lengths a of the particles is preferably 0.01 μm to 0.3 μm, more preferably 0.1 μm to 0.23 μm. The average of values c/b of the particles is preferably 1 to 9, more preferably 1 to 6, furthermore preferably 1 to 4, most preferably 1 to 3.

When the equivalent sphere diameter is 0.05 μm to 1 μm, aggregation hardly occurs in the photosensitive material and the image storability is improved. In the invention, the equivalent sphere diameter is measured by: directly photographing a sample using an electron microscope, and then image-processing the negative.

The aspect ratio of the flaky particle is defined as the value of the equivalent sphere diameter/a. The aspect ratio of the flaky particle is preferably 1.1 to 30, more preferably 1.1 to 15, so as to prevent aggregation of the particles in the photosensitive material, thereby improving the image storability.

The particle size distribution of the organic silver salt particles is preferably monodisperse distribution. In the monodisperse distribution, the percentage obtained by dividing the standard deviation of the length of the longer axis by the length of the longer axis and the percentage obtained by dividing the standard deviation of the length of the shorter axis by the length of the shorter axis are preferably 100% or lower, more preferably 80% or less, further preferably 50% or less. In order to observe the shape of the organic silver salt particle, a transmission electron microscope may be used to give a micrograph of the organic silver salt dispersion. Alternatively, the monodisperse distribution may be evaluated based on the standard deviation of the volume-weighted average diameter of the organic silver salt particles, and the percentage (the variation coefficient) obtained by dividing the standard deviation by the volume-weighted average diameter is preferably 100% or lower, more preferably 80% or lower, further preferably 50% or lower. For example, the particle size (the volume-weighted average diameter) may be measured by: dispersing the organic silver salt particles in a liquid, and exposing the dispersion to a laser light and obtaining the autocorrelation function of fluctuation of the scattering light to time.

3) Preparation

The organic silver salt particles may be prepared and dispersed by known methods described, for example, in JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, the disclosures of which are incorporated herein by reference.

When the organic silver salt particles are dispersed in the presence of a photosensitive silver salt, fogging is intensified and the sensitivity is remarkably reduced. Thus, in a preferable embodiment, substantially no photosensitive silver salt is present when the organic silver salt particles are dispersed. In the invention, the amount of photosensitive silver salt in the aqueous dispersion liquid of the organic silver salt is preferably 1 mol % or less, more preferably 0.1 mol % or less, per 1 mol of the organic silver salt. It is more preferable not to add s photosensitive silver salt to the dispersion liquid actively.

In an embodiment, the photosensitive material is prepared by a process comprising mixing an aqueous organic silver salt dispersion liquid with an aqueous photosensitive silver salt dispersion liquid. The mixing ratio between organic silver salt and photosensitive silver salt may be selected depending on the use of the photosensitive material. The mole ratio of photosensitive silver salt to organic silver salt is preferably 1 mol % to 30 mol %, more preferably 2 to 20 mol %, particularly preferably 3 to 15 mol %. It is preferable to mix two or more aqueous organic silver salt dispersion liquids and two or more aqueous photosensitive silver salt dispersion liquids so as to control the photographic properties.

4) Amount

The amount of organic silver salt may be selected without particular restrictions, and the total amount of the applied silver (including photosensitive silver halide) is preferably 0.1 g/m$^2$ to 5.0 g/m$^2$, more preferably 0.3 g/m$^2$ to 3.0 g/m$^2$, furthermore preferably 0.5 g/m$^2$ to 2.0 g/m$^2$. In order to improve the image storability, the total amount of the applied silver is preferably 1.8 g/m$^2$ or less, more preferably 1.6 g/m$^2$ or less. In the invention, when a reducing agent preferred in the invention is used, sufficient image density can be achieved even with such a small amount of silver.

Reducing Agent

The photothermographic material of the invention preferably includes a heat developing agent which is a reducing agent for the organic silver salt. The reducing agent for the organic silver salt may be any substance which reduces a silver ion to metallic silver, and the reducing agent is preferably an organic substance. Examples of such a reducing agent are disclosed in JP-A No. 11-65021, paragraphs 0043 to 0045, and EP-A No. 0803764A1, p. 7, line 34 to p. 18, line 12, the disclosures of which are incorporated herein by reference. The reducing agent is preferably a so-called hindered phenol reducing agent having a substituent at an ortho position relative to the phenolic hydroxyl group, or a bisphenol reducing agent, particularly preferably a compound represented by the following formula (R).

Formula (R)

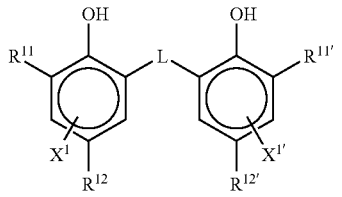

In the formula (R), $R^{11}$ and $R^{11'}$ each independently represent an alkyl group having 1 to 20 carbon atoms; $R^{12}$ and $R^{12'}$ each independently represent a hydrogen atom or a substituent which can be bonded to the benzene ring; L represents an —S— group or a —CHR$^{13}$— group, and $R^{13}$ represents a hydrogen atom or an alkyl group having 1 to 20 carbon atoms; $X^1$ and $X^{1'}$ each independently represent a hydrogen atom or a substituent which can be bonded to the benzene ring.

The formula (R) is described in detail below. In the following, the scope of the term "an alkyl group" encompasses "a cycloalkyl group" unless mentioned otherwise.

1) $R^{11}$ and $R^{11'}$ $R^{11}$ and $R^{11'}$ each independently represent a substituted or unsubstituted alkyl group having 1 to 20 carbon atoms. There are no particular restrictions on the substituents on the alkyl group. Examples of substituents on the alkyl group include aryl groups, a hydroxy group, alkoxy groups, aryloxy groups, alkylthio groups, arylthio groups, acylamino groups, sulfonamide groups, sulfonyl groups, phosphoryl groups, acyl groups, carbamoyl groups, ester groups, ureido groups, urethane groups, and halogen atoms.

2) $R^{12}$ and $R^{12'}$, and $X^1$ and $X^{1'}$ $R^{12}$ and $R^{12'}$ each independently represent a hydrogen atom or a substituent which can be bonded to the benzene ring. Also $X^1$ and $X^{1'}$ each independently represent a hydrogen atom or a substituent which can be bonded to the benzene ring. Examples of the substituent which can be bonded to the benzene ring include alkyl groups, aryl groups, halogen atoms, alkoxy groups, and acylamino groups.

3) L

L represents an —S— group or a —CHR$^{13}$— group. $R^{13}$ represents a hydrogen atom or an alkyl group having 1 to 20 carbon atoms, and the alkyl group may have a substituent. When $R^{13}$ represents an unsubstituted alkyl group, examples thereof include a methyl group, an ethyl group, a propyl group, a butyl group, a heptyl group, an undecyl group, an isopropyl group, a 1-ethylpentyl group, a 2,4,4-trimethylpentyl group, a cyclohexyl group, a 2,4-dimethyl-3-cyclohexenyl group, and a 3,5-dimethyl-3-cyclohexenyl group. Examples of the substituent on the alkyl group represented by $R^{13}$ include the substituents described above as examples of the substituent on $R^{11}$ or $R^{11'}$. The substituent on the alkyl group may be a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, or a sulfamoyl group.

4) Preferred Substituents $R^{11}$ and $R^{11'}$ are each preferably a primary, secondary or tertiary alkyl group having 1 to 15 carbon atom. Specific examples of such an alkyl group include a methyl group, an isopropyl group, a t-butyl group, a t-octyl group, a cyclohexyl group, a cyclopentyl group, a 1-methyl cyclohexyl group, and a 1-methylcyclopropyl group. $R^{11}$ and $R^{11'}$ each are more preferably an alkyl group having 1 to 4 carbon atoms, still more preferably a methyl group, a t-butyl group, a t-amyl group, or a 1-methylcyclohexyl group, most preferably a methyl group or a t-butyl group.

$R^{12}$ and $R^{12'}$ are each preferably an alkyl group having 1 to 20 carbon atoms, and specific examples thereof include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, and a methoxyethyl group. $R^{12}$ and $R^{12'}$ are each more preferably a methyl group, an ethyl group, a propyl group, an isopropyl group, or a t-butyl group, particularly preferably a methyl group or an ethyl group.

$X^1$ and $X^{1'}$ are each preferably a hydrogen atom, a halogen atom, or an alkyl group, more preferably a hydrogen atom.

L is preferably a —CHR$^{13}$— group.

$R^{13}$ is preferably a hydrogen atom or an alkyl group having 1 to 15 carbon atoms. The alkyl group may be a linear alkyl group or a cyclic alkyl group, and may have a C=C bond. The alkyl group is preferably a methyl group, an ethyl group, a propyl group, an isopropyl group, a 2,4,4-trimethylpentyl group, a cyclohexyl group, a 2,4-dimethyl-3-cyclohexenyl group, or a 3,5-dimethyl-3-cyclohexenyl group. $R^{13}$ is particularly preferably a hydrogen atom, a methyl group, an ethyl group, a propyl group, an isopropyl group, or a 2,4-dimethyl-3-cyclohexenyl group.

When $R^{11}$ and $R^{11'}$ are tertiary alkyl groups and $R^{12}$ and $R^{12'}$ are methyl groups, $R^{13}$ is preferably a primary or secondary alkyl group having 1 to 8 carbon atoms such as a methyl group, an ethyl group, a propyl group, an isopropyl group, or a 2,4-dimethyl-3-cyclohexenyl group.

When $R^{11}$ and $R^{11'}$ are tertiary alkyl groups and $R^{12}$ and $R^{12'}$ are alkyl groups other than methyl, $R^{13}$ is preferably a hydrogen atom.

When none of $R^{11}$ and $R^{11'}$ is a tertiary alkyl group, $R^{13}$ is preferably a hydrogen atom or a secondary alkyl group, particularly preferably a secondary alkyl group. The secondary alkyl group is preferably an isopropyl group or a 2,4-dimethyl-3-cyclohexenyl group.

The combination of $R^{11}$, $R^{11'}$, $R^{12}$, $R^{12'}$ and $R^{13}$ affects the heat developability of the resultant photothermographic material, the tone of the developed silver, and the like. It is preferable to use a combination of two or more reducing agents depending on the purpose since such properties can be adjusted by the combination of the reducing agents.

Examples of the reducing agent used in the invention, such as the compound represented by formula (R), are shown below. However, reducing agents usable in the invention are not limited to the examples.

R-1

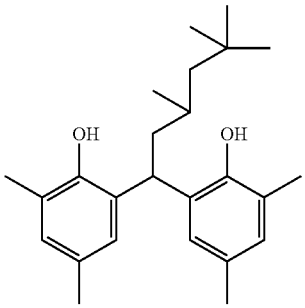

R-2

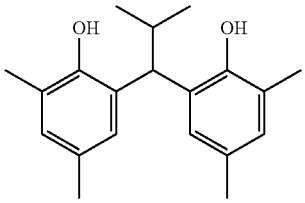

R-3

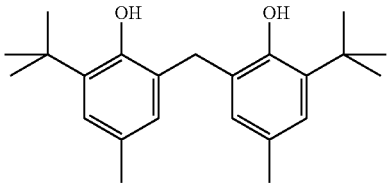

R-4

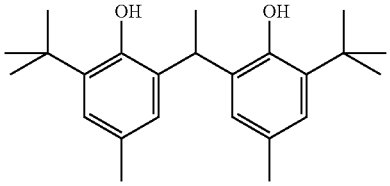

R-5

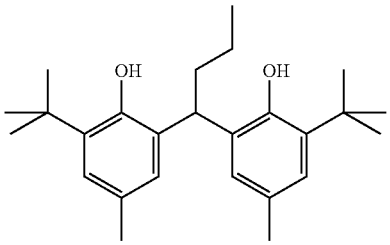

-continued

R-6

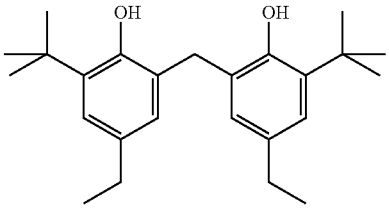

R-7

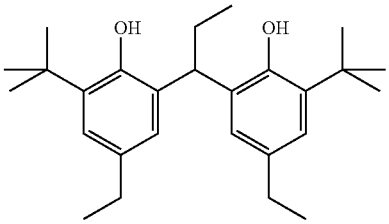

R-8

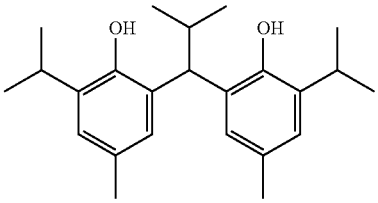

R-9

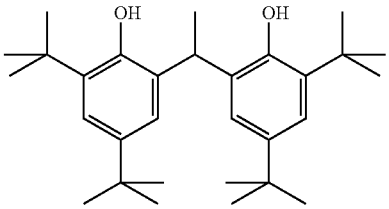

R-10

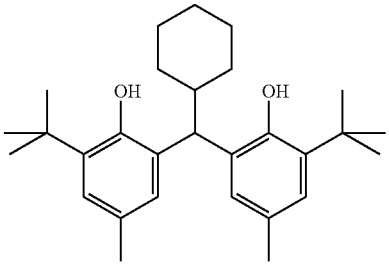

R-11

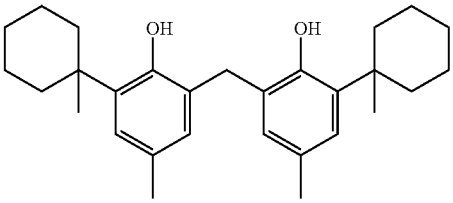

R-12

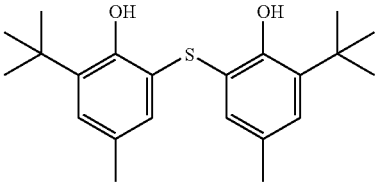

-continued

R-13

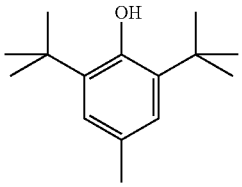

R-14

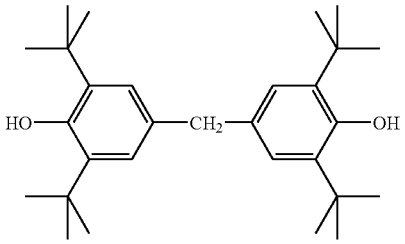

R-15

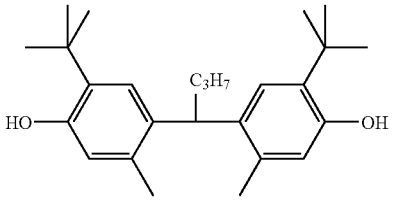

R-16

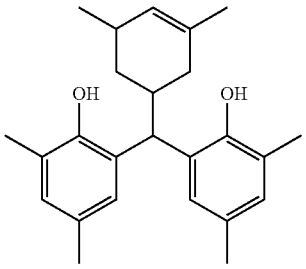

R-17

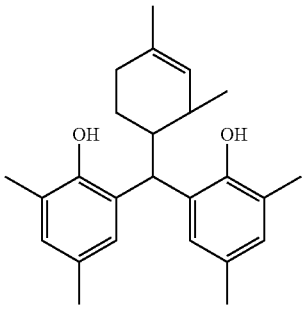

R-18

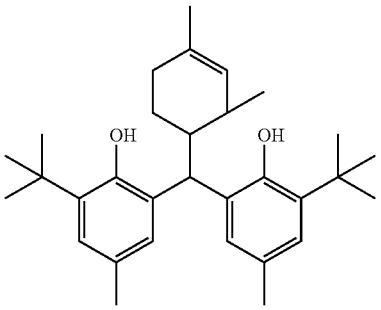

In addition, preferable reducing agents are also disclosed in JP-A Nos. 2001-188314, 2001-209145, 2001-350235, and 2002-156727, and EP-A No. 1278101A2, the disclosures of which are incorporated herein by reference. The amount of the reducing agent in the photothermographic material is preferably 0.1 to 3.0 g/m$^2$, more preferably 0.2 to 2.0 g/m$^2$, furthermore preferably 0.3 to 1.0 g/m$^2$. Further, the mole ratio of reducing agent to silver on the image-forming layer side is preferably 5 to 50 mol %, more preferably 8 to 30 mol %, further preferably 10 to 20 mol %. The reducing agent is preferably contained in the image-forming layer.

The state of the reducing agent in the coating liquid may be any state such as a solution, an emulsion, or a solid particle dispersion.

A well known example of the emulsification method comprises: dissolving the reducing agent in an oil such as dibutyl phthalate, tricresyl phosphate, dioctyl sebacate, or tri(2-ethylhexyl)phosphate, optionally using a cosolvent such as ethyl acetate or cyclohexanone; and then mechanically emulsifying the reducing agent in the presence of a surfactant such as sodium dodecylbenzene sulfonate, sodium oleoyl-N-methyltaurinate, or sodium di(2-ethylhexyl)sulfosuccinate. In this method, it is preferable to add a polymer such as α-methylstyrene oligomer or poly(t-butylacrylamide) to the emulsion in order to control the viscosity and the refractive index of the oil droplets.

In an embodiment, the solid particle dispersion is prepared by a method comprising dispersing powder of the reducing agent in an appropriate solvent such as water using a ball mill, a colloid mill, a vibration ball mill, a sand mill, a jet mill, a roll mill, or ultrasonic wave. A protective colloid (e.g. a polyvinyl alcohol) and/or a surfactant such as an anionic surfactant (e.g. a mixture of sodium triisopropylnaphthalenesulfonates each having a different combination of the substitution positions of the three isopropyl groups) may be used in the preparation. Beads of zirconia, etc. are commonly used as a dispersing medium in the above mills, and in some cases Zr, etc. is eluted from the beads and mixed with the dispersion. The amount of the eluted and mixed component depends on the dispersion conditions, and is generally within the range of 1 to 1,000 ppm. The eluted zirconia does not cause practical problems as long as the amount of Zr in the photothermographic material is 0.5 mg or smaller per 1 g of silver.

In a preferable embodiment, the aqueous dispersion includes an antiseptic agent such as a benzoisothiazolinone sodium salt.

The reducing agent is particularly preferably used in the state of a solid particle dispersion. The reducing agent is preferably added in the form of fine particles having an average particle diameter of 0.01 to 10 μm, more preferably 0.05 to 5 μm, further preferably 0.1 to 2 μm. In the invention, the particle diameters of particles in other solid dispersions are preferably in the above range.

(Development Accelerator)

The photothermographic material of the invention preferably includes a development accelerator, and preferred examples thereof include sulfonamidephenol compounds such as sulfonamidephenol compounds represented by the formula (A) described in JP-A Nos. 2000-267222 and 2000-330234; hindered phenol compounds such as hindered phenol compounds represented by the formula (II) described in JP-A No. 2001-92075; hydrazine compounds such as hydrazine compounds represented by the formula (I) described in JP-A Nos. 10-62895 and 11-15116; hydrazine compounds represented by the formula (D) described in JP-A No. 2002-156727; hydrazine compounds represented by the formula (1) described in JP-A No. 2002-278017; phenol compounds and naphthol compounds such as phenol compounds and naphthol compounds represented by the formula (2) described in JP-A No. 2001-264929; phenol compounds described in JP-A Nos. 2002-311533 and 2002-341484; and naphthol compounds described in JP-A No. 2003-66558. The disclosures of the above patent documents are incorporated herein by reference. Naphthol compounds described in JP-A No. 2003-66558 are preferable.

The mol ratio of development accelerator to reducing agent may be 0.1 to 20 mol %, preferably 0.5 to 10 mol %, more preferably 1 to 5 mol %. The development accelerator may be added to the photothermographic material in any of the manners described above as examples of the method of adding the reducing agent. The development accelerator is particularly preferably added in the form of a solid dispersion or an emulsion. The emulsion of the development accelerator is preferably a dispersion prepared by emulsifying the development accelerator in a mixture of a high-boiling-point solvent that is solid at ordinary temperature and a low-boiling-point cosolvent, or a so-called oilless emulsion which includes no high-boiling-point solvent.

In the invention, the hydrazine compounds described in JP-A Nos. 2002-156727 and 2002-278017, and the naphthol compounds described in JP-A No. 2003-66558 are more preferable development accelerators.

In the invention, the development accelerator is particularly preferably a compound represented by the following formula (A-1) or (A-2).

Q1-NHNH-Q2 Formula (A-1);

In the formula (A-1), Q1 represents an aromatic group or a heterocyclic group each of which has a carbon atom bonded to the —NHNH-Q2 group. Q2 represents a carbamoyl group, an acyl group, an alkoxycarbonyl group, an aryloxycarbonyl group, a sulfonyl group, or a sulfamoyl group.

In the formula (A-1), the aromatic group or heterocyclic group represented by Q1 preferably has a 5- to 7-membered unsaturated ring. Examples of the 5- to 7-membered unsaturated ring include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isoxazole ring, a thiophene ring, and condensed rings thereof.

The ring may have a substituent. When the ring has two or more substituents, they may be the same as each other or different from each other. Examples of the substituent include halogen atoms, alkyl groups, aryl groups, carbonamide groups, alkylsulfonamide groups, arylsulfonamide groups, alkoxy groups, aryloxy groups, alkylthio groups, arylthio groups, carbamoyl groups, sulfamoyl groups, a cyano group, alkylsulfonyl groups, arylsulfonyl groups, alkoxycarbonyl groups, aryloxycarbonyl groups, and acyl groups. These substituents may further have substituents, and preferred examples thereof include halogen atoms, alkyl groups, aryl groups, carbonamide groups, alkylsulfonamide groups, arylsulfonamide groups, alkoxy groups, aryloxy groups, alkylthio groups, arylthio groups, acyl groups, alkoxycarbonyl groups, aryloxycarbonyl groups, carbamoyl groups, a cyano group, sulfamoyl groups, alkylsulfonyl groups, arylsulfonyl groups, and acyloxy groups.

When Q2 represents a carbamoyl group, the carbamoyl group preferably has 1 to 50 carbon atoms, and more preferably has 6 to 40 carbon atoms. Examples of the carbamoyl group include unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphtylcarbamoyl, N-3-pyridylcarbamoyl, and N-benzylcarbamoyl.

When Q2 represents an acyl group, the acyl group preferably has 1 to 50 carbon atoms, and more preferably has 6 to 40 carbon atoms. Examples of the acyl group include formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. When Q2 represents an alkoxycarbonyl group, the alkoxycarbonyl group preferably has 2 to 50 carbon atoms, and more preferably has 6 to 40 carbon atoms. Examples of the alkoxycarbonyl group include methoxycarbonyl, ethoxycarbonyl, isobutyloxycarbonyl, cyclohexyloxycarbonyl, dodecyloxycarbonyl, and benzyloxycarbonyl.

When Q2 represents an aryloxycarbonyl group, the aryloxycarbonyl group preferably has 7 to 50 carbon atoms, and more preferably has 7 to 40 carbon atoms. Examples of the aryloxycarbonyl group include phenoxycarbonyl, 4-octyloxyphenoxycarbonyl, 2-hydroxymethylphenoxycarbonyl, and 4-dodecyloxyphenoxycarbonyl. When Q2 represents a sulfonyl group, the sulfonyl group preferably has 1 to 50 carbon atoms, and more preferably has 6 to 40 carbon atoms. Examples of the sulfonyl group include methylsulfonyl, butylsulfonyl, octylsulfonyl, 2-hexadecylsulfonyl, 3-dodecyloxypropylsulfonyl, 2-octyloxy-5-tert-octylphenylsulfonyl, and 4-dodecyloxyphenylsulfonyl.

When Q2 represents a sulfamoyl group, the sulfamoyl group preferably has 0 to 50 carbon atoms, and more preferably has 6 to 40 carbon atoms. Examples of the sulfamoyl group include unsubstituted sulfamoyl, N-ethylsulfamoyl, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl.

The group represented by Q2 may have a substituent selected from the groups described above as examples of the substituent on the 5- to 7-membered unsaturated ring of Q1. When the group represented by Q2 has two or more substituents, the substituents may be the same as each other or different from each other.

Next, preferable range of the compound represented by formula (A-1) is described. The group represented by Q1 preferably has a 5- or 6-membered unsaturated ring, and more preferably has a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isoxazole ring, or a condensed ring in which any of the above rings is fused with a benzene ring or with an unsaturated heterocycle. Q2 represents preferably a carbamoyl group, particularly preferably a carbamoyl group having a hydrogen atom on the nitrogen atom.

Formula (A-2)

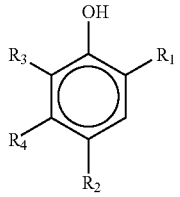

In the formula (A-2), $R_1$ represents an alkyl group, an acyl group, an acylamino group, a sulfonamide group, an alkoxycarbonyl group, or a carbamoyl group. $R_2$ represents a hydrogen atom, a halogen atom, an alkyl group, an alkoxy group, an aryloxy group, an alkylthio group, an arylthio group, an acyloxy group, or a carbonic acid ester group. $R_3$ and $R_4$ each independently represent a substituent which can be bonded to the benzene ring, which may be selected from the substituents described above in the explanation on the formula (A-1). $R_3$ and $R_4$ may combine to form a condensed ring.

$R_1$ represents preferably: an alkyl group having 1 to 20 carbon atoms such as a methyl group, an ethyl group, an isopropyl group, a butyl group, a tert-octyl group, or a cyclohexyl group; an acylamino group such as an acetylamino group, a benzoylamino group, a methylureido group, or a 4-cyanophenylureido group; or a carbamoyl group such as an n-butylcarbamoyl group, an N,N-diethylcarbamoyl group, a phenylcarbamoyl group, a 2-chlorophenylcarbamoyl group, or a 2,4-dichlorophenylcarbamoyl group. $R_1$ represents more preferably an acylamino group, which may be an ureido group or a urethane group. $R_2$ represents preferably: a halogen atom (more preferably a chlorine atom or a bromine atom); an alkoxy group such as a methoxy group, a butoxy group, an n-hexyloxy group, an n-decyloxy group, a cyclohexyloxy group, or a benzyloxy group; or an aryloxy group such as a phenoxy group or a naphthoxy group.

$R_3$ represents preferably a hydrogen atom, a halogen atom, or an alkyl group having 1 to 20 carbon atoms, most preferably a halogen atom. $R_4$ represents preferably a hydrogen atom, an alkyl group, or an acylamino group, more preferably an alkyl group or an acylamino group. Preferred examples of the group represented by $R_3$ or $R_4$ are equal to the above-described examples of the group represented by $R_1$. When $R_4$ represents an acylamino group, $R_4$ and $R_3$ may be bound to each other to form a carbostyryl ring.

When $R_3$ and $R_4$ combine with each other to form a condensed ring in the formula (A-2), the condensed ring is particularly preferably a naphthalene ring. The naphthalene ring may have a substituent selected from the above-described examples of the substituent on the ring of Q1 in the formula (A-1). When the compound represented by the formula (A-2) is a naphthol-based compound, $R_1$ represents preferably a carbamoyl group, particularly preferably a benzoyl group. $R_2$ represents preferably an alkoxy group or an aryloxy group, particularly preferably an alkoxy group.

Preferable examples of the development accelerator are illustrated below without intention of restricting the scope of the present invention.

A-1

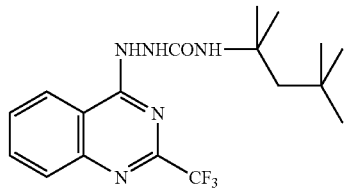

A-2

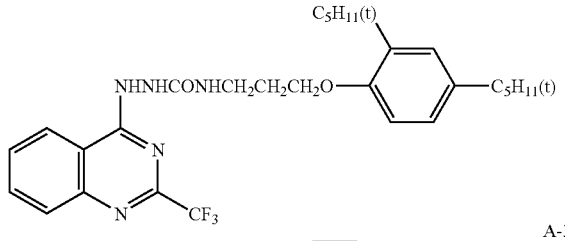

A-3

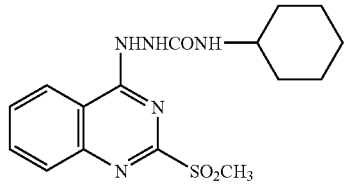

A-4

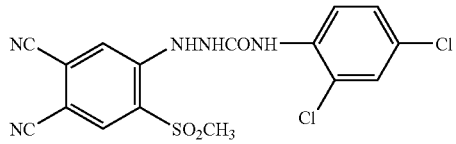

A-5

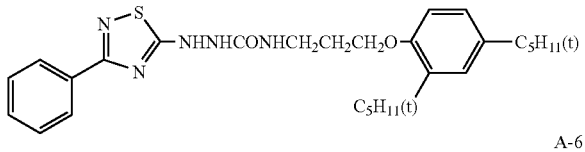

A-6

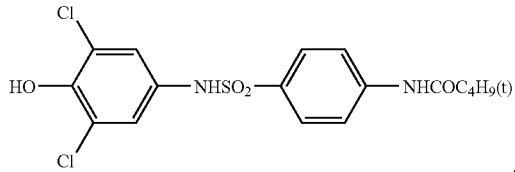

A-7

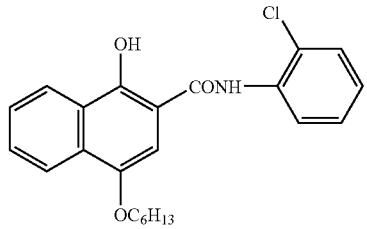

A-8

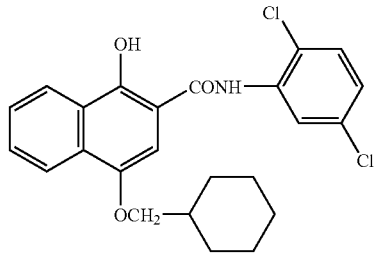

-continued

A-9

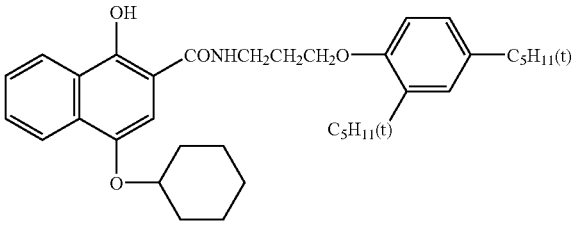

(A-10)

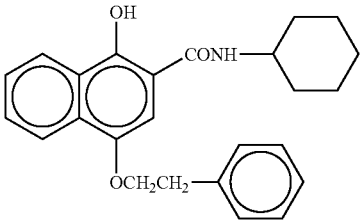

(A-11)

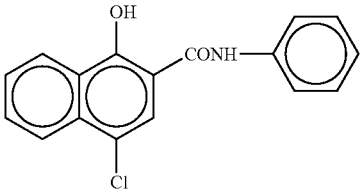

(A-12)

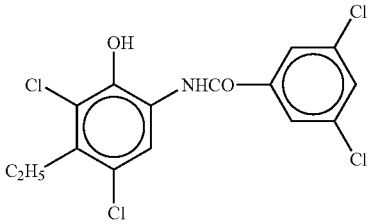

(Hydrogen-bonding Compound)

When the reducing agent has an aromatic hydroxyl group (—OH) or amino group (—NHR, in which R represents a hydrogen atom or an alkyl group), particularly when the reducing agent is the above-mentioned bisphenol compound, it is preferable to use a non-reducing hydrogen-bonding compound having a group capable of forming a hydrogen bond with the hydroxyl or amino group.

Examples of the group capable of forming a hydrogen bond with the hydroxyl or amino group include phosphoryl groups, sulfoxide groups, sulfonyl groups, carbonyl groups, amide groups, ester groups, urethane groups, ureido groups, tertiary amino groups, and nitrogen-containing aromatic groups. The group capable of forming a hydrogen bond with the hydroxyl or amino group is preferably: a phosphoryl group; a sulfoxide group; an amide group having no >N—H groups, but the nitrogen atom being blocked as >N—Ra (in which Ra represents a substituent other than H); a urethane group having no >N—H groups, the nitrogen atom being blocked as >N—Ra (in which Ra represents a substituent other than H); and a ureido group having no >N—H group, but the nitrogen atom being blocked as >N—Ra (in which Ra represents a substituent other than H).

The hydrogen-bonding compound used in the invention is particularly preferably a compound represented by the following formula (D):

Formula (D)

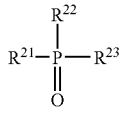

In the formula (D), $R^{21}$ to $R^{23}$ each independently represent an alkyl group, an aryl group, an alkoxy group, an aryloxy group, an amino group, or a heterocyclic group. These groups each may be unsubstituted or substituted.

When any of $R^{21}$ to $R^{23}$ has a substituent, examples of the substituent include halogen atoms, alkyl groups, aryl groups, alkoxy groups, amino groups, acyl groups, acylamino groups, alkylthio groups, arylthio groups, sulfonamide groups, acyloxy groups, oxycarbonyl groups, carbamoyl groups, sulfamoyl groups, sulfonyl groups, and phosphoryl groups. Preferred substituents are alkyl groups and aryl groups, and specific examples thereof include a methyl group, an ethyl group, an isopropyl group, a t-butyl group, a t-octyl group, a phenyl group, 4-alkoxyphenyl groups, and 4-acyloxyphenyl groups.

When any of $R^{21}$ to $R^{23}$ represents an alkyl group, examples thereof include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group, and a 2-phenoxypropyl group.

When any of $R^{21}$ to $R^{23}$ represents an aryl group, examples thereof include a phenyl group, a cresyl group, a xylyl group, a naphtyl group, a 4-t-butylphenyl group, a 4-t-octylphenyl group, a 4-anisidyl group, and a 3,5-dichlorophenyl group.

When any of $R^{21}$ to $R^{23}$ represents an alkoxy group, examples thereof include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, and a benzyloxy group.

When any of $R^{21}$ to $R^{23}$ represents an aryloxy group, examples thereof include a phenoxy group, a cresyloxy group, an isopropylphenoxy group, a 4-t-butylphenoxy group, a naphthoxy group, and a biphenyloxy group.

When any of $R^{21}$ to $R^{23}$ represents an amino group, examples thereof include a dimethylamino group, a diethylamino group, a dibutylamino group, a dioctylamino group, an N-methyl-N-hexylamino group, a dicyclohexylamino group, a diphenylamino group, and an N-methyl-N-phenylamino group.

$R^{21}$ to $R^{23}$ are each preferably an alkyl group, an aryl group, an alkoxy group, or an aryloxy group. In order to obtain the effects of the invention, in a preferable embodiment, at least one of $R^{21}$ to $R^{23}$ represents an alkyl group or an aryl group. In a more preferable embodiment, two or more of $R^{21}$ to $R^{23}$ represent groups selected from alkyl groups and aryl groups. Further, it is preferable to use a compound represented by the formula (D) in which $R^{21}$ to $R^{23}$ represent the same groups, from the viewpoint of reducing the cost.

Specific examples of the hydrogen-bonding compound (such as a compound represented by the formula (D)) are illustrated below without intention of restricting the scope of the present invention.

D-1
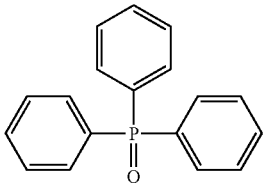
D-2
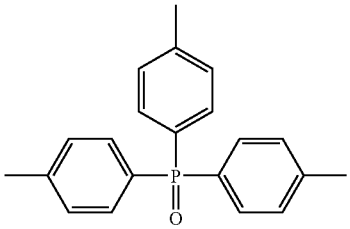
D-3
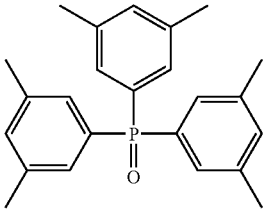
D-4
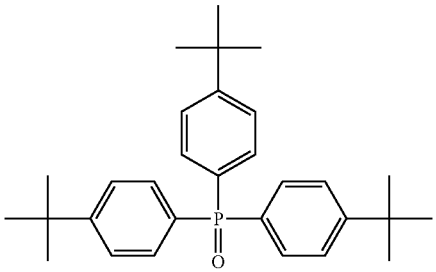
D-5
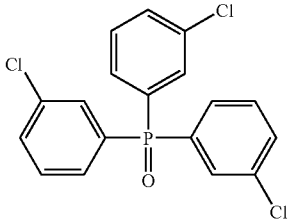
D-6
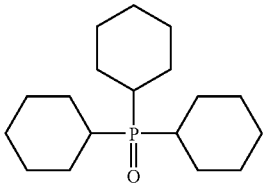
D-7
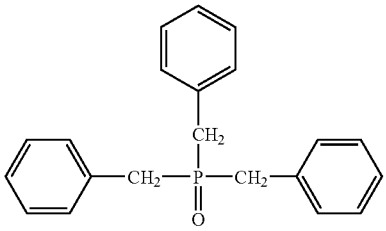
-continued
D-8
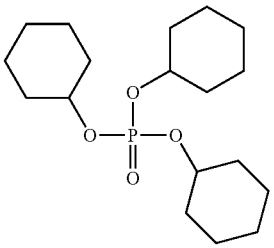
D-9
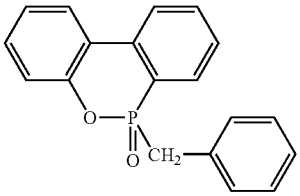
D-10
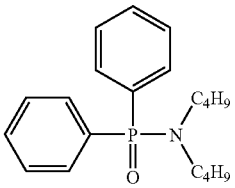
D-11
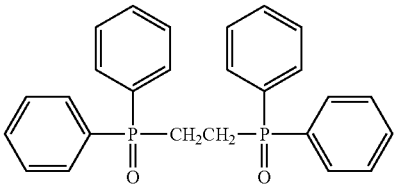
D-12
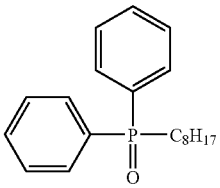
D-13
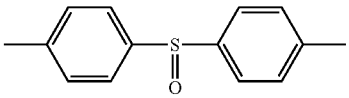
D-14
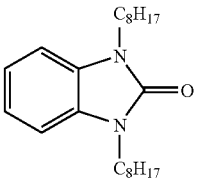
D-15
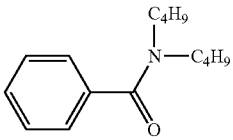
Specific examples of the hydrogen-bonding compound further include compounds disclosed in EP Patent No. 1096310, and JP-A Nos. 2002-156727 and 2002-318431, the disclosures of which are incorporated by reference herein.

The compound of the formula (D) may be added to the coating liquid and used in the photothermographic material in the form of a solution, an emulsion, or a solid particle dispersion. The specific manner of producing the solution, emulsion, or solid particle dispersion may be the same as in the case of the reducing agent. The compound is preferably used in the form of a solid dispersion. The hydrogen-bonding compound forms a hydrogen-bond complex with the reducing agent having a phenolic hydroxyl group or an amino group in the solution. The complex can be isolated as a crystal depending on the combination of the reducing agent and the compound of the formula (D).

It is particularly preferable to use the powder of the isolated crystal to form a solid particle dispersion, from the viewpoint of achieving stable performances. In a preferable embodiment, powder of the reducing agent and powder of the compound of the formula (D) are mixed, and then the mixture is dispersed in the presence of a dispersing agent by a sand grinder mill, etc., thereby forming the complex in the dispersing process.

The mole ratio of compound represented by the formula (D) to reducing agent is preferably 1 to 200 mol %, more preferably 10 to 150 mol %, further preferably 20 to 100 mol %.

(Photosensitive Silver Halide)

1) Halogen Composition

The halogen composition of the photosensitive silver halide used in the invention is not particularly restricted, and may be silver chloride, silver chlorobromide, silver bromide, silver iodobromide, silver iodochlorobromide, or silver iodide. Among them, silver bromide, silver iodobromide, and silver iodide are preferable. In a grain of the photosensitive silver halide, the halogen composition may be uniform in the entire grain, or may vary stepwise or steplessly. In an embodiment, the photosensitive silver halide grain has a core-shell structure. The core-shell structure is preferably a 2- to 5-layered structure, more preferably a 2- to 4-layered structure. It is also preferable to employ techniques for localizing silver bromide or silver iodide on the surface of the grain of silver chloride, silver bromide, or silver chlorobromide.

2) Method of Forming Photosensitive Silver Halide Grain

Methods of forming photosensitive silver halide grains are well known in the field. For example, the methods described in *Research Disclosure,* No. 17029, June 1978 (the disclosure of which is incorporated by reference) and U.S. Pat. No. 3,700,458 (the disclosure of which is incorporated by reference) may be used in the invention. In an embodiment, the photosensitive silver halide grains are prepared by: adding a silver source and a halogen source to a solution of gelatin or another polymer to form a photosensitive silver halide; and then mixing the silver halide with an organic silver salt. The methods disclosed in the following documents are also preferable: JP-A No. 11-119374, Paragraph 0217 to 0224, and JP-A Nos. 11-352627 and 2000-347335, the disclosures of which are incorporated by reference herein.

3) Grain Size

The grain size of the photosensitive silver halide grain is preferably small so as to suppress the clouding after image formation. Specifically, the grain size is preferably 0.20 μm or smaller, more preferably 0.01 μm to 0.15 μm, further preferably 0.02 μm to 0.12 μm. The grain size of the photosensitive silver halide grain is the average diameter of the circle having the same area as the projected area of the grain; in the case of tabular grain, the projected area refers to the projected area of the principal plane.

4) Grain Shape

The photosensitive silver halide grain may be a cuboidal grain, an octahedral grain, a tabular grain, a spherical grain, a rod-shaped grain, a potato-like grain, etc. In the invention, the cuboidal grain is preferable. Silver halide grains with roundish corners are also preferable. The face index (Miller index) of the outer surface plane of the photosensitive silver halide grain is not particularly limited. In a preferable embodiment, the silver halide grains have a high proportion of {100} faces; a spectrally sensitizing dye adsorbed to the {100} faces exhibits a higher spectral sensitization efficiency. The proportion of the {100} faces is preferably 50% or higher, more preferably 65% or higher, further preferably 80% or higher. The proportion of the {100} faces according to the Miller indices can be determined by a method described in T. Tani, *J. Imaging Sci.,* 29, 165 (1985) (the disclosure of which is incorporated herein by reference) using adsorption dependency between {111} faces and {100} faces upon adsorption of a sensitizing dye.

5) Heavy Metal

The photosensitive silver halide grain used in the invention may include a metal selected from the metals of Groups 8 to 13 of the Periodic Table of Elements (having Groups 1 to 18) or a complex thereof. The metal is more preferably selected from metals of Groups 8 to 10 of the Periodic Table of Elements. When the photosensitive silver halide grain includes a metal selected from the metals of Groups 8 to 13 of the Periodic Table of Elements or a metal complex containing a metal selected from the metals of Groups 8 to 10 as the central metal, the metal or the central metal is preferably rhodium, ruthenium, iridium, or iron. The metal complex may be used singly or in combination with another complex including the same or different metal. The amount of the metal or the metal complex is preferably $1\times10^{-9}$ mol to $1\times10^{-3}$ mol per 1 mol of silver. The heavy metals, the metal complexes, and methods of adding them are described, for example, in JP-A No. 7-225449, JP-A No. 11-65021, Paragraph 0018 to 0024, and JP-A No. 11-119374, Paragraph 0227 to 0240, the disclosures of which are incorporated by reference herein.

In the invention, the silver halide grain is preferably a silver halide grain having a hexacyano metal complex on its outer surface. Examples of the hexacyano metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. The hexacyano metal complex is preferably a hexacyano Fe complex.

The counter cation of the hexacyano metal complex is not important because the hexacyano metal complex exists as an ion in an aqueous solution. The counter cation is preferably a cation which is highly miscible with water and suitable for an operation to precipitate the silver halide emulsion; examples thereof include: alkaline metal ions such as a sodium ion, a potassium ion, a rubidium ion, a cesium ion, and a lithium ion; and ammonium and alkylammonium ions such as a tetramethylammonium ion, a tetraethylammonium ion, a tetrapropylammonium ion, and a tetra-(n-butyl)-ammonium ion.

The hexacyano metal complex may be added in the form of a solution in water, or in a mixed solvent of water and a water-miscible organic solvent (e.g. an alcohol, an ether, a glycol, a ketone, an ester, an amide, etc.), or in a gelatin.

The amount of the hexacyano metal complex to be added is preferably $1\times10^{-5}$ mol to $1\times10^{-2}$ mol per 1 mol of silver, more preferably $1\times10^{-4}$ mol to $1\times10^{-3}$ mol per 1 mol of silver.

In order to allow the hexacyano metal complex to exist on the outer surface of the silver halide grains, the hexacyano metal complex may be added to the silver halide grains after the completion of the addition of an aqueous silver nitrate solution for grain formation but before the chemical sensitization (which may be chalcogen sensitization such as sulfur sensitization, selenium sensitization, or tellurium sensitization or may be noble metal sensitization such as gold sensitization). Specifically, the hexacyano metal complex may be directly added to the silver halide grains before the completion of the preparation step, in the water-washing step, in the dispersion step, or before the chemical sensitization step. It is preferable to add the hexacyano metal complex immediately after grain formation but before the completion of the preparation step so as to prevent excess growth of the silver halide grains.

In an embodiment, the addition of the hexacyano metal complex is started after 96 mass % of the total amount of silver nitrate for grain formation is added. In a preferable embodiment, the addition is started after 98 mass % of the total amount of silver nitrate is added. In a more preferable embodiment, the addition is started after 99 mass % of the total amount of silver nitrate is added.

When the hexacyano metal complex is added after the addition of the aqueous silver nitrate solution but immediately before the completion of grain formation, the hexacyano metal complex is adsorbed onto the outer surface of the silver halide grain, and most of the adsorbed hexacyano metal complex forms a hardly-soluble salt with silver ion on the surface. The silver salt of hexacyano iron (II) is less soluble than AgI and thus preventing redissolution of the fine grains, whereby the silver halide grains with a smaller grain size can be produced.

The metal atoms and metal complexes such as $[Fe(CN)_6]^{4-}$ which may be added to the silver halide grains, and the desalination methods and the chemical sensitization methods for the silver halide emulsion are described in JP-A No. 11-84574, Paragraph 0046 to 0050, JP-A No. 11-65021, Paragraph 0025 to 0031, and JP-A No. 11-119374, Paragraph 0242 to 0250, the disclosures of which are incorporated herein by reference.

6) Gelatin

In the invention, the gelatin contained in the photosensitive silver halide emulsion may be selected from various gelatins. The gelatin has a molecular weight of preferably 10,000 to 1,000,000 so as to maintain excellent dispersion state of the photosensitive silver halide emulsion in the coating liquid containing the organic silver salt. Substituents on the gelatin are preferably phthalated. The gelatin may be added during the grain formation or during the dispersing process after the desalting treatment, and is preferably added during the grain formation.

7) Sensitizing Dye

The sensitizing dye used in the invention is a sensitizing dye which can spectrally sensitize the silver halide grains when adsorbed by the silver halide grains, so that the sensitivity of the silver halide is heightened in the desired wavelength range. The sensitizing dye may be selected from sensitizing dyes having spectral sensitivities which are suitable for spectral characteristics of the exposure light source. The sensitizing dyes and methods of adding them are described, for example, in JP-A No. 11-65021, Paragraph 0103 to 0109; JP-A No. 10-186572 (the compounds represented by the formula (II)); JP-A No. 11-119374 (the dyes represented by the formula (I) and Paragraph 0106); U.S. Pat. Nos. 5,510,236; 3,871,887 (the dyes described in Example 5); JP-A No. 2-96131; JP-A No. 59-48753 (the dyes disclosed therein); EP-A No. 0803764A1, Page 19, Line 38 to Page 20, Line 35; JP-A Nos. 2001-272747, 2001-290238, and 2002-23306, the disclosures of which are incorporated herein by reference. Only a single sensitizing dye may be used or two or more sensitizing dyes may be used. In an embodiment, the sensitizing dye is added to the silver halide emulsion after the desalination but before the coating. In a preferable embodiment, the sensitizing dye is added to the silver halide emulsion after the desalination but before the completion of the chemical ripening.

The amount of the sensitizing dye to be added may be selected in accordance with the sensitivity and the fogging properties, and is preferably $10^{-6}$ mol to 1 mol per 1 mol of the silver halide in the image-forming layer, more preferably $10^{-4}$ mol to $10^{-1}$ mol per 1 mol of the silver halide in the image-forming layer.

In the invention, a super-sensitizer may be used in order to increase the spectral sensitization efficiency. Examples of the super-sensitizer include compounds described in EP-A No. 587,338, U.S. Pat. Nos. 3,877,943 and 4,873,184, JP-A Nos. 5-341432, 11-109547, and 10-111543, the disclosures of which are incorporated herein by reference.

8) Chemical Sensitization

In a preferable embodiment, the photosensitive silver halide grains are chemically sensitized by methods selected from the sulfur sensitization method, the selenium sensitization method, and the tellurium sensitization method. Known compounds such as the compounds described in JP-A No. 7-128768 (the disclosure of which is incorporated herein by reference) may be used in the sulfur sensitization method, the selenium sensitization method, and the tellurium sensitization method. In the invention, the tellurium sensitization is preferred, and it is preferable to use a compound or compounds selected from the compounds described in JP-A No. 11-65021, Paragraph 0030 and compounds represented by the formula (II), (III), or (IV) described in JP-A No. 5-313284, the disclosures of which are incorporated by reference herein.

In a preferable embodiment, the photosensitive silver halide grains are chemically sensitized by the gold sensitization method, which may be conducted alone or in combination with the chalcogen sensitization. The gold sensitization method preferably uses a gold sensitizer having a gold atom with the valence of +1 or +3. The gold sensitizer is preferably a common gold compound. Typical examples of the gold sensitizer include chloroauric acid, bromoauric acid, potassium chloroaurate, potassium bromoaurate, auric trichloride, potassium auricthiocyanate, potassium iodoaurate, tetracyanoauric acid, ammonium aurothiocyanate, and pyridyltrichloro gold. Further, the gold sensitizers described in U.S. Pat. No. 5,858,637 and JP-A No. 2002-278016 (the disclosures of which are incorporated herein by reference) are also preferable in the invention.

In the invention, the chemical sensitization may be carried out at any time between grain formation and coating. The chemical sensitization may be carried out after desalination, for example, (1) before spectral sensitization, (2) during spectral sensitization, (3) after spectral sensitization, or (4) immediately before coating.

The amount of the sulfur, selenium, or tellurium sensitizer may be changed in accordance with the kind of the silver halide grains, the chemical ripening condition, and the like, and is generally b $10^{-8}$ mol to $10^{-2}$ mol per 1 mol of silver halide, preferably $10^{-7}$ mol to $10^{-3}$ mol per 1 mol of silver halide.

The amount of the gold sensitizer to be added may be selected in accordance with the conditions, and is preferably $10^{-7}$ mol to $10^{-3}$ mol per 1 mol of silver halide, more preferably $10^{-6}$ mol to $5\times10^{-4}$ mol per 1 mol of silver halide.

The conditions for the chemical sensitization are not particularly restricted and are generally conditions in which pH is 5 to 8, pAg is 6 to 11, and temperature is 40 to 95° C.

A thiosulfonic acid compound may be added to the silver halide emulsion by a method described in EP-A No. 293, 917, the disclosure of which is incorporated by reference herein.

In the invention, the photosensitive silver halide grains may be subjected to reduction sensitization using a reduction sensitizer. The reduction sensitizer is preferably selected from ascorbic acid, aminoiminomethanesulfinic acid, stannous chloride, hydrazine derivatives, borane compounds, silane compounds, and polyamine compounds. The reduction sensitizer may be added at any time between crystal growth and coating in the preparation of the photosensitive emulsion. It is also preferable to ripen the emulsion while maintaining the pH value of the emulsion at 7 or higher and/or maintaining the pAg value at 8.3 or lower, so as to reduction-sensitize the photosensitive emulsion. Further, it is also preferable to conduct reduction sensitization by introducing a single addition part of a silver ion during grain formation.

9) Compound Whose One-electron Oxidized Form Formed by One-electron Oxidation Can Release One or More Electron(s)

The photothermographic material of the invention preferably comprises a compound whose one-electron oxidized form formed by one-electron oxidation can release one or more electron(s). The compound may be used alone or in combination with the above-mentioned chemical sensitizers, thereby heightening the sensitivity of the silver halide.

The compound whose one-electron oxidized form formed by one-electron oxidation can release one or more electron (s) is the following compound of Type 1 or 2.

(Type 1) a compound whose one-electron oxidized form formed by one-electron oxidation can release one or more electron(s) through a subsequent bond cleavage reaction.

(Type 2) a compound whose one-electron oxidized form formed by one-electron oxidation can release one or more electron(s) after a subsequent bond formation.

The compound of Type 1 is described first.

Specific examples of the compound of Type 1 include compounds described as a one-photon two-electron sensitizer or a deprotonating electron donating sensitizer described in JP-A No. 9-211769 (Compounds PMT-1 to S-37 described in Tables E and F on Pages 28 to 32); JP-A No. 9-211774; JP-A No. 11-95355 (Compounds INV 1 to 36); Japanese Patent Application National Publication Laid-Open No. 2001-500996 (Compounds 1 to 74, 80 to 87, and 92 to 122); U.S. Pat. Nos. 5,747,235, and 5,747,236; EP Patent No. 786692A1 (Compounds INV 1 to 35); EP Patent No. 893732A1; U.S. Pat. Nos. 6,054,260, and 5,994,051; the disclosures of which are incorporated by reference herein. Preferred embodiments of the compounds are also described in the patent documents.

Further, examples of the compounds of Type 1 include compounds represented by the following formula (1) (equivalent to the formula (1) described in JP-A No. 2003-114487); compounds represented by the following formula (2) (equivalent to the formula (2) described in JP-A No. 2003-114487); compounds represented by the following formula (3) (equivalent to the formula (1) described in JP-A No. 2003-114488); compounds represented by the following formula (4) (equivalent to the formula (2) described in JP-A No. 2003-114488); compounds represented by the following formula (5) (equivalent to the formula (3) described in JP-A No. 2003-114488); compounds represented by the following formula (6) (equivalent to the formula (1) described in JP-A No. 2003-75950); compounds represented by the following formula (7) (equivalent to the formula (2) described in JP-A No. 2003-75950); compounds represented by the following formula (8) (equivalent to the formula (1) described in JP-A No. 2004-239943); and compounds represented by the following formula (9) (equivalent to the formula (3) described in JP-A No. 2004-245929) which can undergo a reaction represented by the following chemical reaction formula (1) (equivalent to the chemical reaction formula (1) described in JP-A No. 2004-245929). The disclosures of the above patent documents are incorporated by reference herein. Preferred embodiments of the compounds are described in the patent documents.

Formula (1)

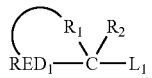

Formula (2)

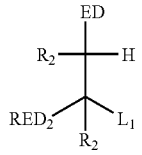

Formula (3)

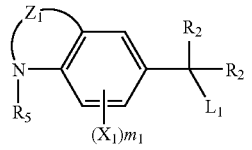

Formula (4)

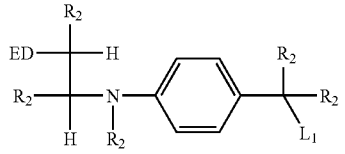

Formula (5)

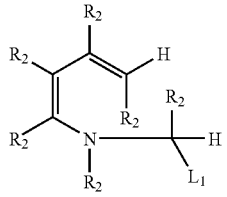

Formula (6)

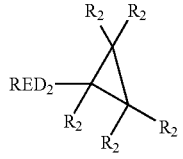

-continued

Formula (7)

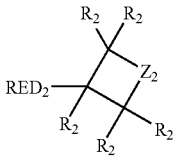

Formula (8)

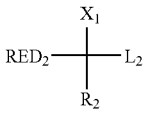

Chemical Reaction Formula (1)

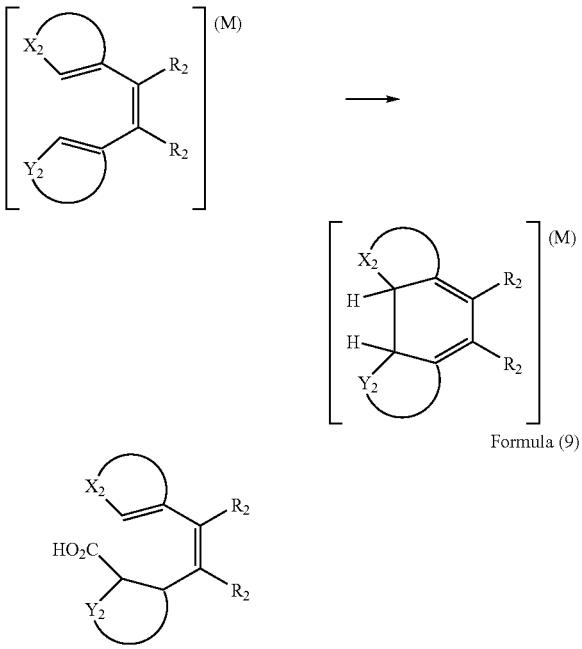

Formula (9)

In the formulae, $RED_1$ and $RED_2$ each represent a reducing group. $R_1$ represents a nonmetallic atomic group which, together with the carbon atom C and $RED_1$, forms a ring structure corresponding to a tetrahydro- or octahydro-derivative of a 5- or 6-membered aromatic ring (which may be an aromatic heterocycle). $R_2$ represents a hydrogen atom or a substituent. When one compound has a plurality of $R_2$'s, they may be the same as each other or different from each other. $L_1$ represents a leaving group. ED represents an electron-donating group. $Z_1$ represents an atomic group which, together with the nitrogen atom and two carbon atoms in the benzene ring, can form a 6-membered ring. $X_1$ represents a substituent, and $m_1$ represents an integer of 0 to 3. $Z_2$ represents —$CR_{11}R_{12}$—, —$NR_{13}$—, or —O—. $R_{11}$ and $R_{12}$ each independently represent a hydrogen atom or a substituent. $R_{13}$ represents a hydrogen atom, an alkyl group, an aryl group, or a heterocyclic group. Specifically, $X_1$ may represent an alkoxy group, an aryloxy group, a heterocyclyloxy group, an alkylthio group, an arylthio group, a heterocyclylthio group, an alkylamino group, an arylamino group, or a heterocyclylamino group. $L_2$ represents a carboxyl group or a salt thereof, or a hydrogen atom. $X_2$ represents a group which, together with the C═C group, forms a 5-membered heterocycle. $Y_2$ represents a group which, together with the C═C group, forms a 5- or 6-membered, aryl or heterocyclic group. M represents a radical, a radical cation, or a cation.

The compound of Type 2 is described next.

Examples of the compounds of Type 2 include compounds represented by the following formula (10) (equivalent to the formula (1) described in JP-A No. 2003-140287), and compounds represented by the following formula (11) (equivalent to the formula (2) described in JP-A No. 2004-245929) which can undergo a reaction represented by the following chemical reaction formula (1) (equivalent to the chemical reaction formula (1) described in JP-A No. 2004-245929). Preferred embodiments of the compounds are described in the patent documents.

Formula (10)

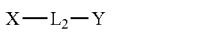

Chemical Reaction Formula (1)

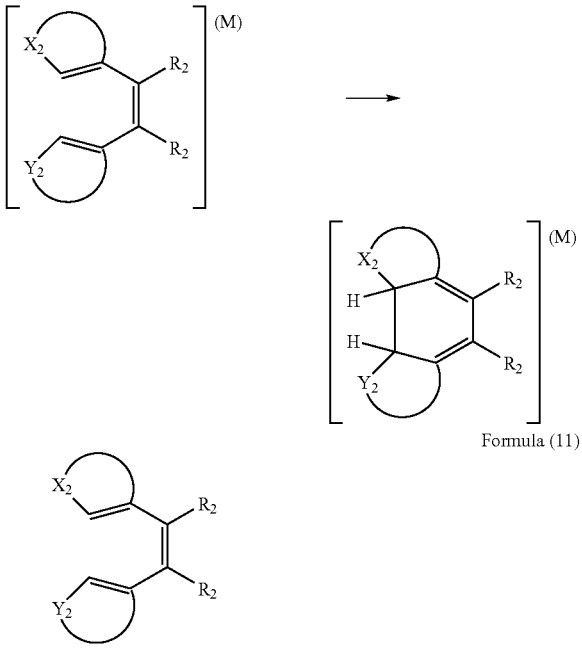

Formula (11)

In the formulae, X represents a reducing group that can be one-electron-oxidized. Y represents a reactive group which contains a carbon-carbon double bond, a carbon-carbon triple bond, an aromatic group, or a benzo-condensed, nonaromatic heterocyclic group, and which can react with the one-electron-oxidized group derived from X to form a bond. $L_2$ represents a linking group that connects X and Y. $R_2$ represents a hydrogen atom or a substituent. When a compound has a plurality of $R_2$'s, they may be the same as each other or different from each other. $X_2$ represents a group which, together with the C═C group, forms a 5-membered heterocycle. $Y_2$ represents a group which, together with the C═C group, forms a 5- or 6-membered, aryl or heterocyclic group. M represents a radical, a radical cation, or a cation.

The compound of Type 1 or 2 preferably has a group which can adsorb silver halide, or a spectrally sensitizing dye moiety. Typical examples of the group which can adsorb silver halide include groups described in JP-A No. 2003-156823, Page 16, Right column, Line 1 to Page 17, Right column, Line 12, disclosure of which is incorporated by reference herein. The spectrally sensitizing dye moiety has a structure described in JP-A No. 2003-156823, Page 17, Right column, Line 34 to Page 18, Left column, Line 6, disclosure of which is incorporated by reference herein.

The compound of Type 1 or 2 is more preferably a compound having a group which can adsorb silver halide, and furthermore preferably has a compound having two or more groups which can adsorb silver halide. When the compound has two or more groups which can adsorb silver halide, the groups may be the same as each other or different from each other.

Preferable examples of the group which can adsorb silver halide include mercapto-substituted, nitrogen-containing, heterocyclic groups (e.g., a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzthiazole group, a 1,5-dimethyl-1,2,4-triazolium-3-thiolate group, etc.), and nitrogen-containing heterocyclic groups each having an —NH— group capable of forming a silver imide (>NAg) as a moiety of the heterocycle (e.g., a benzotriazole group, a benzimidazole group, an indazole group, etc.) Particularly preferred among them are a 5-mercaptotetrazole group, a 3-mercapto-1,2,4-triazole group, and a benzotriazole group, and most preferred are a 3-mercapto-1,2,4-triazole group and a 5-mercaptotetrazole group.

In a preferable embodiment, the compound of Type 1 or 2 is a compound having a group which can adsorb silver halide, the group having two or more mercapto groups. Each mercapto group (—SH) may be converted to a thione group if it can be tautomerized. The group which can adsorb silver halide and has two or more mercapto groups may be a dimercapto-substituted nitrogen-containing heterocyclic group, etc., and preferred examples thereof include a 2,4-dimercaptopyrimidine group, a 2,4-dimercaptotriazine group, and a 3,5-dimercapto-1,2,4-triazole group.

The group which can adsorb silver may be a quaternary salt group of nitrogen or phosphorus. Specifically, the quaternary nitrogen salt group may comprise: an ammonio group such as a trialkylammonio group, a dialkyl-aryl (or heteroaryl)-ammonio group or an alkyl-diaryl (or diheteroaryl)-ammonio group; or a heterocyclic group containing a quaternary nitrogen. The quaternary phosphorus salt group may comprise a phosphonio group such as a trialkylphosphonio group, a dialkyl-aryl (or heteroaryl)-phosphonio group, an alkyl-diaryl (or diheteroaryl)-phosphonio group, or a triaryl (or triheteroaryl)-phosphonio group. The quaternary salt group is more preferably a quaternary nitrogen salt group, further preferably an aromatic, quaternary-nitrogen-containing, heterocyclic group having a 5- or 6-membered ring structure, particularly preferably a pyridinio group, a quinolinio group, or a isoquinolinio group. The quaternary-nitrogen-containing heterocyclic groups may have a substituent.

Examples of the counter anion of the quaternary salt group include halogen ions, a carboxylate ion, a sulfonate ion, a sulfate ion, a perchlorate ion, a carbonate ion, a nitrate ion, $BF_4^-$, $PF_6^-$, and $Ph_4B^-$. When the compound has a group with a negative charge such as a carboxylate group, the quaternary salt may be formed within the molecule. Examples of preferred counter anions other than the internal anions include a chlorine ion, a bromine ion, and a methanesulfonate ion.

When the compound of Type 1 or 2 has a quaternary nitrogen or phosphorus salt group as the group which can adsorb silver halide, the compound is preferably a compound represented by the following formula (X):

$$(P—Q1\text{-})_i—R(—Q2\text{-}S)_j. \qquad \text{Formula (X)}$$

In the formula (X), P and R each independently represent a quaternary nitrogen or phosphorus salt group which is not the sensitizing dye moiety. Q1 and Q2 each independently represent a linking group which may be selected from a single bond, an alkylene group, an arylene group, a heterocyclic group, —O—, —S—, —$NR_N$—, —C(=O)—, —$SO_2$—, —SO—, —P(=O)—, or a combination thereof. $R_N$ represents a hydrogen atom, an alkyl group, an aryl group, or a heterocyclic group. S represents a residue obtained by removing an atom from a compound of Type 1 or 2. i and j each independently represent an integer of 1 or larger, the sum of i and j being 2 to 6. In an embodiment, i represents 1 to 3 and j represents 1 to 2. In a preferable embodiment, i represents 1 or 2 and j represents 1. In a more preferable embodiment, i represents 1 and j represents 1. The compound represented by the formula (X) preferably has 10 to 100 carbon atoms. The carbon number of the compound is more preferably 10 to 70, further preferably 11 to 60, particularly preferably 12 to 50.

The compound of Type 1 or 2 may be added at any time in the preparation of the photothermographic material, for example, in the preparation of the photosensitive silver halide emulsion. For example, the compound may be added during the formation of the photosensitive silver halide grains, during desalination, during chemical sensitization, or before coating. The compound may be added two or more times. The compound may be added, preferably after the completion of the photosensitive silver halide grain formation but before desalination; or during chemical sensitization (just before chemical sensitization to immediately after chemical sensitization); or before coating. The compound may be added, more preferably during the period from the chemical sensitization to just before mixing of the silver halide with the non-photosensitive organic silver salt.

The compound of Type 1 or 2 may be added preferably after dissolved in water, a water-soluble solvent such as methanol or ethanol, or a mixed solvent obtained by mixing solvents selected from water and water-soluble solvents. When the compound whose solubility in water varies depending on pH is dissolved in water, the pH value of the solution may be appropriately adjusted so as to dissolve the compound well, before added to the silver halide.

It is preferable to incorporate the compound of Type 1 or 2 into the image-forming layer comprising the photosensitive silver halide and the non-photosensitive organic silver salt. It is also preferable to incorporate the compound of Type 1 or 2 into a protective layer, an intermediate layer, etc. as well as the image-forming layer, so that the compound diffuses during coating. The compound may be added after or before or simultaneously with the addition of the sensitizing dye. In the image-forming layer, the amount of the compound is preferably $1\times10^{-9}$ mol to $5\times10^{-1}$ mol per 1 mol of the silver halide, more preferably $1\times10^{-8}$ mol to $5\times10^{-2}$ mol, per 1 mol of silver halide.

Examples of compounds of Type 1 and 2 are shown below. However, compounds of Type 1 and 2 are not limited to the examples.

1

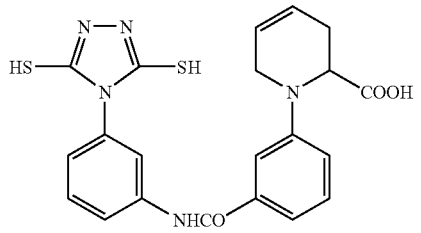

-continued
2
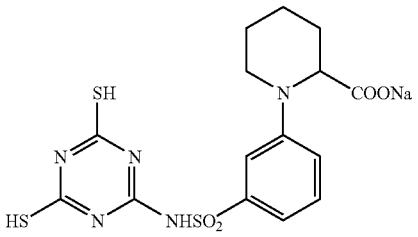
3
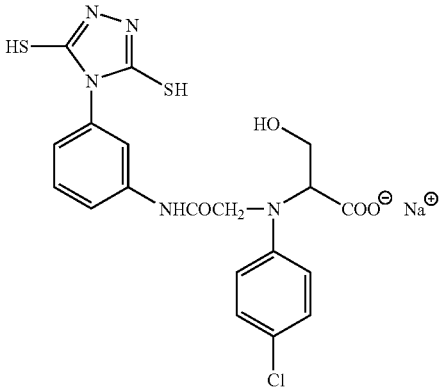
4
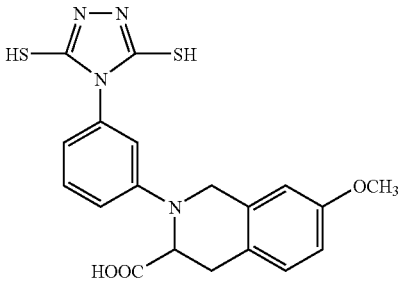
5
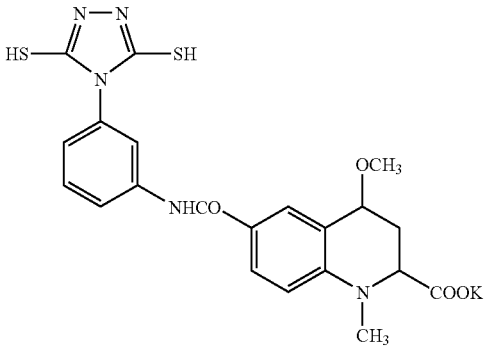
6
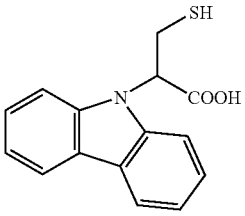
-continued
7
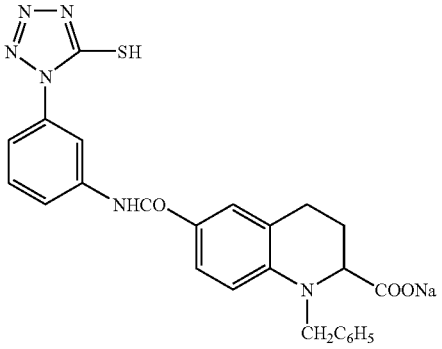
8
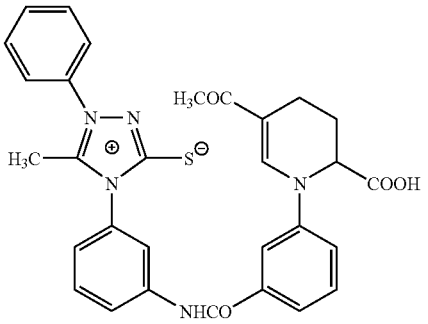
9
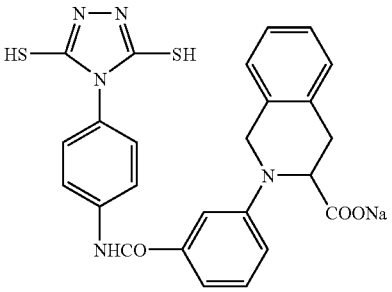
10
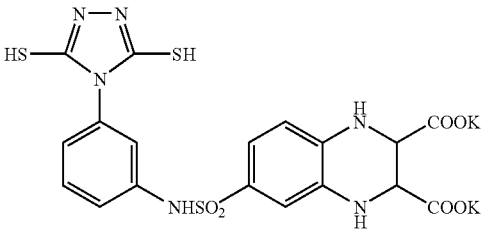
11
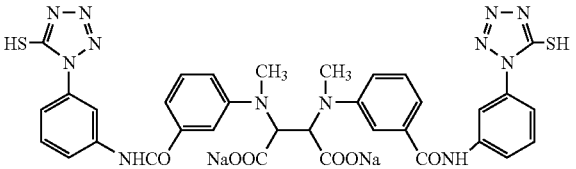

-continued
12
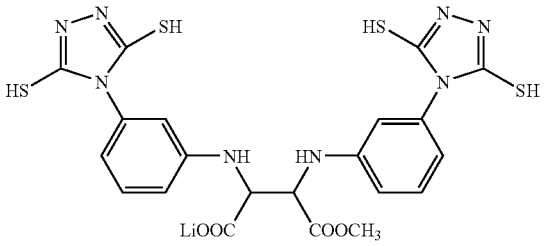
13
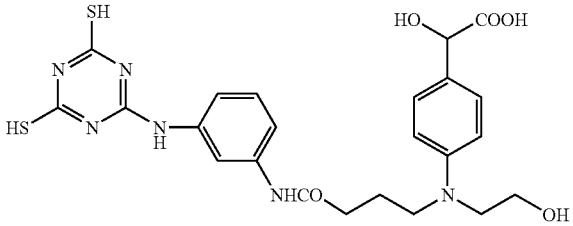
14
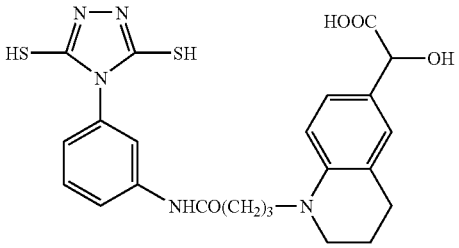
15
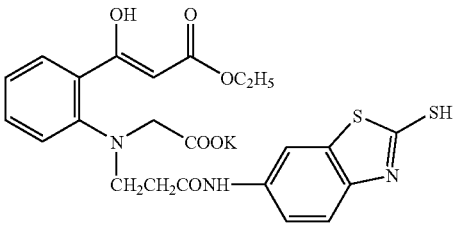
16
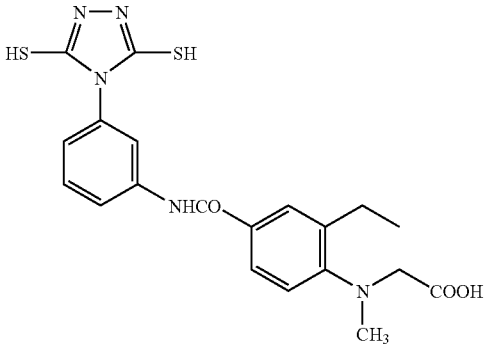
-continued
17
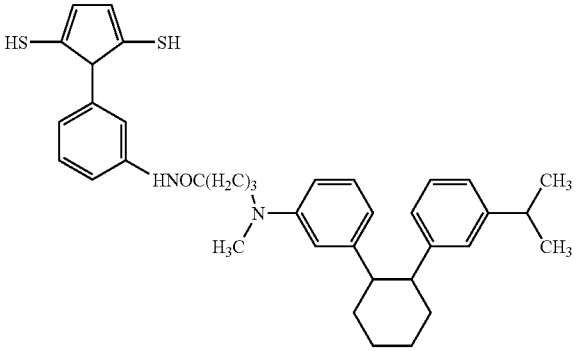
18
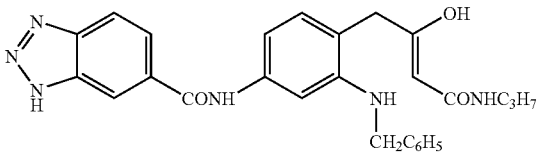
19
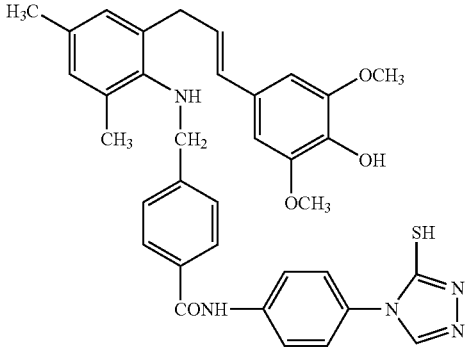
20
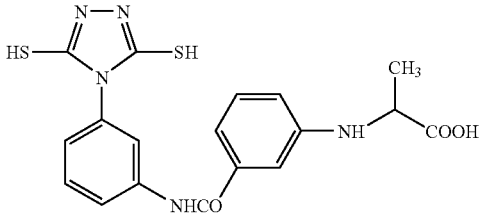
21
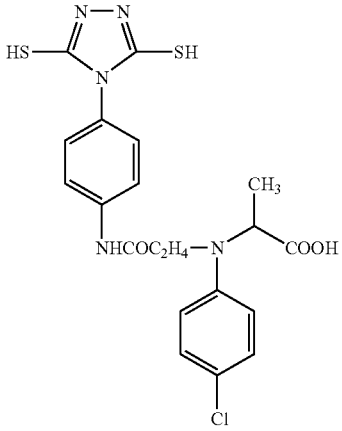

-continued
22
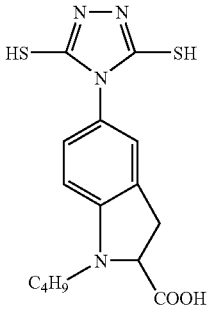
23
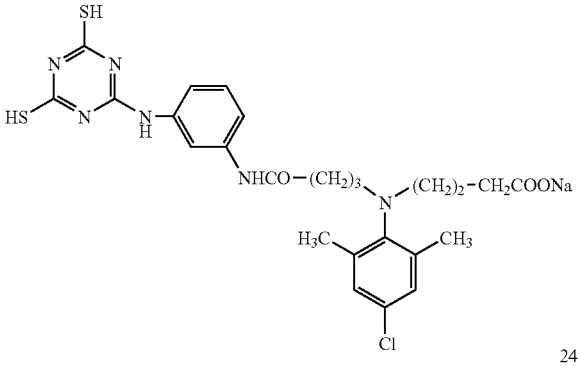
24
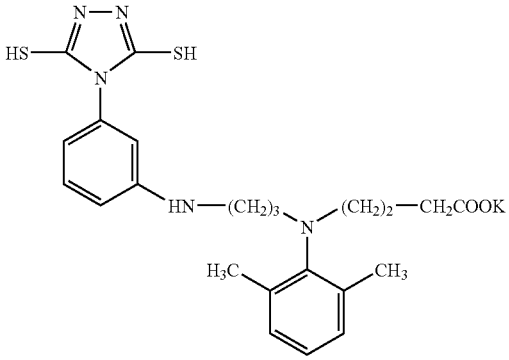
25
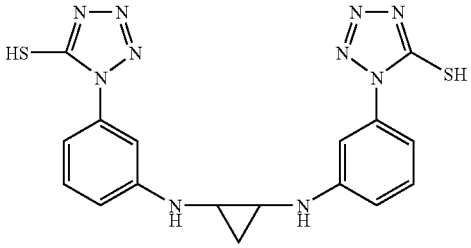
26
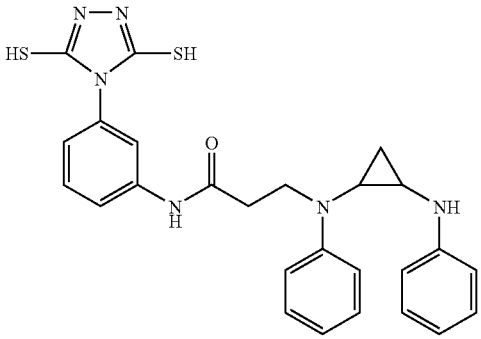
-continued
27
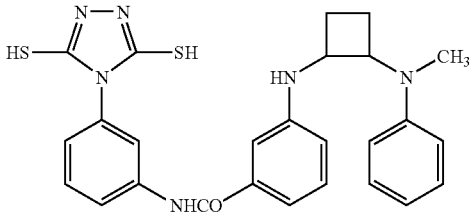
28
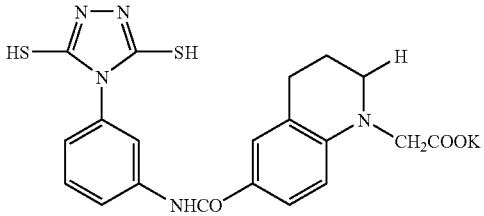
29
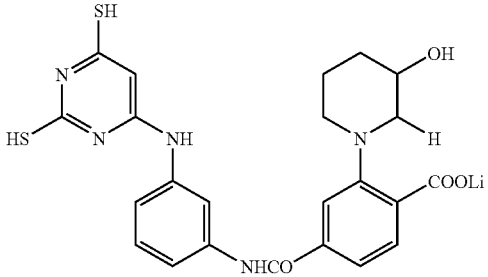
30
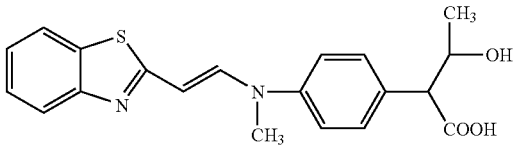
31
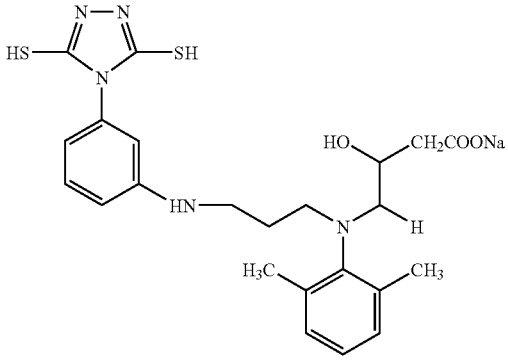
32
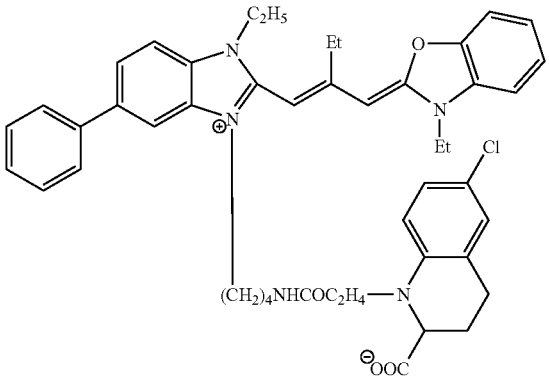

-continued

33

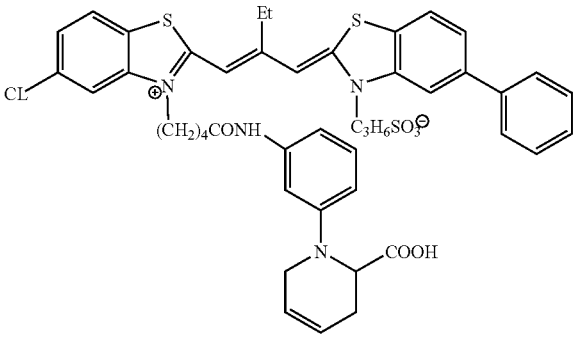

34

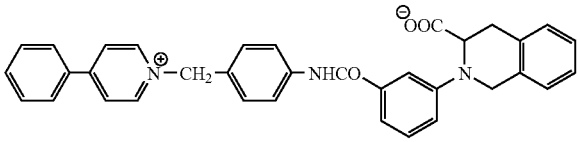

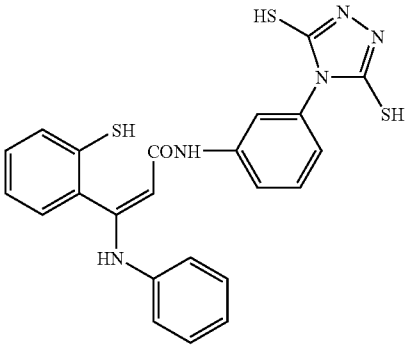

G-1

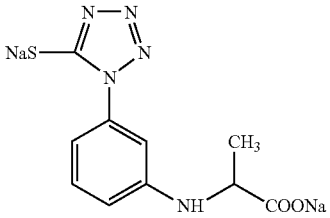

G-2

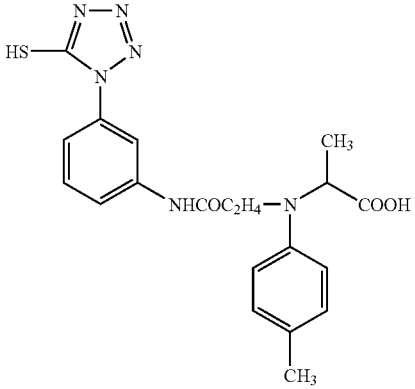

-continued

G-3

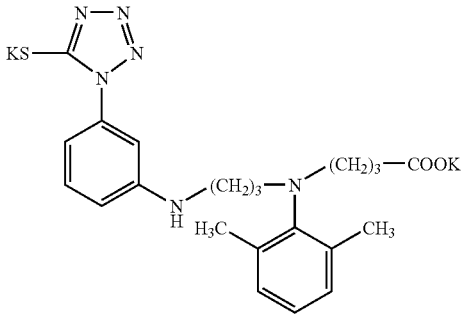

G-4

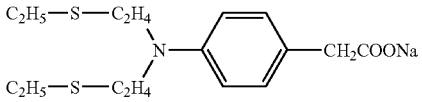

G-5

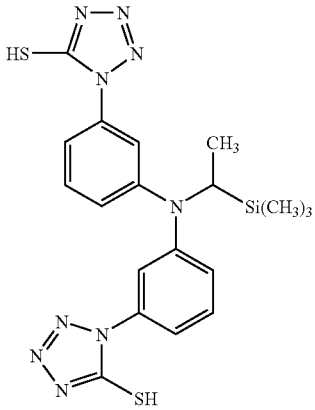

11) Coating Amount

The amount of photosensitive silver halide to be coated is, in terms of the coated silver amount per 1 $m^2$ of photothermographic material, preferably 0.03 to 0.6 $g/m^2$, more preferably 0.05 to 0.4 $g/m^2$, still more preferably 0.07 to 0.3 $g/m^2$. Further, the amount of photosensitive silver halide per 1 mol of organic silver salt is preferably 0.01 to 0.5 mol, more preferably 0.02 to 0.3 mol, further preferably 0.03 to 0.2 mol.

12) Mixing of Photosensitive Silver Halide and Organic Silver Salt

The methods and conditions of mixing the photosensitive silver halide and the organic silver salt, which are separately prepared, are not particularly restricted as long as the advantageous effects of the invention can be sufficiently obtained. In an embodiment, the silver halide and the organic silver salt are separately prepared and then mixed by a high-speed stirrer, a ball mill, a sand mill, a colloid mill, a vibrating mill, a homogenizer, etc. In another embodiment, the prepared photosensitive silver halide is added to the organic silver salt during the preparation of the organic silver salt, and the preparation of the organic silver salt is then completed. It is preferable to mix two or more aqueous organic silver salt dispersion liquids and two or more aqueous photosensitive silver salt dispersion liquids so as to adjust the photographic properties.

13) Addition of Silver Halide to Coating Liquid

The silver halide is added to the coating liquid for the image-forming layer preferably between 180 minutes before coating and immediately before coating, more preferably between 60 minutes before coating and 10 seconds before coating. There are no particular restrictions on the methods and conditions of the coating as long as the advantageous effects of the invention can be sufficiently obtained. In an embodiment, the silver halide is mixed with the coating liquid in a tank while controlling the addition flow rate and the feeding amount to the coater, such that the average retention time calculated from the addition flow rate and the feeding amount to the coater is the desired time. In another embodiment, the silver halide is mixed with the coating liquid by a method using a static mixer described, for example, in N. Harnby, M. F. Edwards, and A. W. Nienow, translated by Koji Takahashi, *Ekitai Kongo Gijutsu,* Chapter 8 (Nikkan Kogyo Shimbun, Ltd., 1989), the disclosure of which is incorporated herein by reference.

(Binder)

As the binder in the organic-silver-salt-containing layer in the invention, any polymer may be used. The polymer is preferably transparent or translucent, and generally colorless. The polymer may be a natural resin, polymer or copolymer, a synthetic resin, polymer or copolymer, or another film-forming medium, and specific examples thereof include gelatins, gums, polyvinyl alcohols, hydroxyethylcelluloses, cellulose acetates, cellulose acetate butyrates, polyvinylpyrrolidones, caseins, starches, polyacrylic acids, polymethylmethacrylic acids, polyvinyl chlorides, polymethacrylic acids, styrene-maleic anhydride copolymers, styrene-acrylonitrile copolymers, styrene-butadiene copolymers, polyvinyl acetals (e.g. polyvinyl formals, polyvinyl butyrals, etc.), polyesters, polyurethanes, phenoxy resins, polyvinylidene chlorides, polyepoxides, polycarbonates, polyvinyl acetates, polyolefins, cellulose esters, and polyamides. In the coating liquid, the binder may be dissolved or dispersed in an aqueous solvent or in an organic solvent, or may be in the form of an emulsion.

The glass-transition temperature of the binder polymer used in the organic-silver-salt containing layer is preferably 0 to 80° C. Polymer having such high glass-transition temperatures are hereinafter referred to as "high Tg binders" occasionally. The glass-transition temperature of the binder is more preferably 10 to 70° C., further preferably 15 to 60° C.

In the invention, Tg of a copolymer can be calculated using the following equation:

$$1/Tg=\Sigma(Xi/Tgi).$$

Assuming the copolymer is comprised of n monomers which are designated by "monomer i" (i=1 to n), Xi is the weight fraction of the monomer i ($\Sigma Xi=1$), and Tgi is the glass-transition temperature (absolute temperature) of the homopolymer of the monomer i. $\Sigma(Xi/Tgi)$ is the sum of Xi/Tgi for i=1 to n. In the invention, the glass-transition temperature Tgi of the homopolymer of each monomer is based on a value described in J. Brandrup and E. H. Immergut, *Polymer Handbook, 3rd Edition* (Wiley-Interscience, 1989), the disclosure of which is incorporated by reference herein.

Two or more binders may be used as necessary. In an embodiment, a binder having a glass transition temperature of 20° C. or higher and a binder having a glass transition point of lower than 20° C. are used simultaneously. When a blend of polymers having different Tg's are used, the mass-average Tg is preferably in the above-described range.

In a preferable embodiment, a coating liquid is prepared which includes a solvent comprising water in an amount of 30 mass % or more based on the amount of the solvent, then the coating liquid is applied and dried to form the image-forming layer. In this embodiment, the binder of the image-forming layer is preferably soluble or dispersible in a water-based solvent (water solvent). The binder is preferably a polymer latex having an equilibrium moisture content of 2 mass % or lower at 25° C. 60% RH. The latex preferably has an ionic conductivity of 2.5 mS/cm or lower, and such a latex can be prepared by purifying a synthesized polymer using a separation membrane.

The above water-based solvent is water or a mixed solvent of water and a water-miscible organic solvent, the proportion of the water-miscible organic solvent to the mixed solvent being 70 mass % or lower. Examples of the water-miscible organic solvent include alcohol solvents such as methyl alcohol, ethyl alcohol, and propyl alcohol; cellosolve solvents such as methyl cellosolve, ethyl cellosolve, and butyl cellosolve; ethyl acetate; and dimethylformamide.

In the specification, the term "water-based solvent" is used also when the polymer is not dissolved thermodynamically, but is in the form of a dispersed state.

The equilibrium water content at 25° C. 60% RH can be represented by the following equation:

$$\text{Equilibrium water content at 25° C. 60\% RH}=\{(W1-W0)/W0\}\times 100\ (\text{mass \%}),$$

in which W1 represents a weight of a polymer having an equilibrium water content in an atmosphere of 25° C. 60% RH, and W0 represents a weight of the polymer in the bone-dry state at 25° C.

Definition and measuring methods of the water content is described in *Kobunshi Kogaku Koza* 14, *Kobunshi Zairyo Shikenho,* edited by The Society of Polymer Science, Japan, Chijin Shokan Co., Ltd., the disclosure of which is incorporated herein by reference.

The equilibrium moisture content at 25° C. 60% RH of the binder polymer is preferably 2 mass % or lower, more preferably 0.01 to 1.5 mass %, furthermore preferably 0.02 to 1 mass %.

The binder polymer is preferably dispersible in an aqueous solvent. The dispersion state of the polymer in the coating liquid may be a latex in which fine particles of a water-insoluble hydrophobic polymer are dispersed, or a dispersion (or emulsion) liquid in which polymer molecules are dispersed in the molecular or micell state. The latex dispersion is more preferable. The average particle diameter of the dispersed particles is 1 to 50,000 nm, preferably 5 to 1,000 nm, more preferably 10 to 500 nm, and furthermore preferably 50 to 200 nm. The particle size distribution of the dispersed particles is not particularly restricted, and may be a wide or monodisperse distribution. It is preferable to use two or more kinds of particles each having a monodisperse distribution so as to adjust the physical properties of the coating liquid.

Preferred examples of polymers dispersible in the aqueous solvents include hydrophobic polymers such as acrylic polymers, polyesters, rubbers (e.g. SBR resins), polyurethanes, polyvinyl chlorides, polyvinyl acetates, polyvinylidene chlorides, and polyolefins. The polymer may be linear, branched, or cross-linked, and may be a homopolymer derived form one monomer or a copolymer derived form two or more monomers. The copolymer may be a random copolymer or a block copolymer. The number-average molecular weight of the polymer is preferably 5,000 to 1,000,000, more preferably 10,000 to 200,000. When the number-average molecular weight is too small, the resultant image-forming layer tends to have insufficient strength. On the other hand, when the number-average molecular weight is too large, the polymer is poor in the film-forming properties. Further, cross-linkable polymer latexes are particularly preferable.

<Examples of Latex>

Specific examples of usable polymer latexes are described below. In the examples, the polymers are represented by the starting monomers, the numerals in parentheses represent the mass ratios (mass %) of the monomers, and the molecular weights are number-average molecular weights. The polymers using multifunctional monomers have cross-linked structures and the concept of the molecular weight cannot be implemented because of the cross-linked structures, whereby such polymers are referred to as cross-linked polymers and explanation of the molecular weight is omitted. Tg represent the glass-transition temperature.

P-1; Latex of -MMA(70)-EA(27)-MAA(3)—(Molecular weight 37,000, Tg 61° C.)

P-2; Latex of -MMA(70)-2EHA(20)-St(5)-AA(5)—(Molecular weight 40,000, Tg 59° C.)

P-3; Latex of -St(50)-Bu(47)-MAA(3)—(Cross-linked polymer, Tg −17° C.)

P-4; Latex of -St(68)-Bu(29)-AA(3)—(Cross-linked polymer, Tg 17° C.)

P-5; Latex of -St(71)-Bu(26)-AA(3)—(Cross-linked polymer, Tg 24° C.)

P-6; Latex of -St(70)-Bu(27)-IA(3)—(Cross-linked polymer)

P-7; Latex of -St(75)-Bu(24)-AA(1)—(Cross-linked polymer, Tg 29° C.)

P-8; Latex of -St(60)-Bu(35)-DVB(3)-MAA(2)—(Cross-linked polymer)

P-9; Latex of -St(70)-Bu(25)-DVB(2)-AA(3)—(Cross-linked polymer)

P-10; Latex of -VC(50)-MMA(20)-EA(20)-AN(5)-AA(5)—(Molecular weight 80,000)

P-11; Latex of -VDC(85)-MMA(5)-EA(5)-MAA(5)—(molecular weight 67,000)

P-12; Latex of -Et(90)-MAA(10)—(Molecular weight 12,000)

P-13; Latex of -St(70)-2EHA(27)-AA(3)—(Molecular weight 130,000, Tg 43° C.)

P-14; Latex of -MMA(63)-EA(35)-AA(2)—(Molecular weight 33,000, Tg 47° C.)

P-15; Latex of -St(70.5)-Bu(26.5)-AA(3)—(Cross-linked polymer, Tg 23° C.)

P-16; Latex of -St(69.5)-Bu(27.5)-AA(3)—(Cross-linked polymer, Tg 20.5° C.)

The abbreviations in the above examples represent the following monomers.

MMA; Methyl methacrylate
EA; Ethyl acrylate
MAA; Methacrylic acid
2EHA; 2-Ethylhexyl acrylate
St; Styrene
Bu; Butadiene
AA; Acrylic acid
DVB; Divinylbenzene
VC; Vinyl chloride
AN; Acrylonitrile
VDC; Vinylidene chloride
Et; Ethylene
IA; Itaconic acid Commercially-available polymer latexes may be used in the invention, and examples thereof include acrylic polymers such as CEBIAN A-4635, 4718, and 4601 (available from Daicel Chemical Industries, Ltd.) and NIPOL LX811, 814, 821, 820, and 857 (available from Nippon Zeon Co., Ltd.); polyesters such as FINETEX ES650, 611, 675, and 850 (available from Dainippon Ink and Chemicals, Inc.) and WD-size and WMS (available from Eastman Chemical Co.); polyurethanes such as HYDRAN AP10, 20, 30, and 40 (available from Dainippon Ink and Chemicals, Inc.); rubbers such as LACSTAR 7310K, 3307B, 4700H, and 7132C (available from Dainippon Ink and Chemicals, Inc.) and NIPOL LX416, 410, 438C, and 2507 (available from Nippon Zeon Co., Ltd.); polyvinyl chlorides such as G351 and G576 (available from Nippon Zeon Co., Ltd.); polyvinylidene chlorides such as L502 and L513 (available from Asahi Kasei Kogyo K.K.); and polyolefins such as CHEMIPEARL S120 and SA100 (available from Mitsui Chemicals, Inc.).

Only a single polymer latex may be used or a mixture of two or more polymer latexes may be used in accordance with the necessity.

<Preferable Latex>

The polymer latex to be used in the invention is preferably a latex of styrene-butadiene copolymer. The ratio between the mass of styrene monomer units to the mass of butadiene monomer units in the styrene-butadiene copolymer is preferably in the range of 40:60 to 95:5. The proportion of the total mass of styrene monomer units and the butadiene monomer units to the mass of the copolymer is preferably 60 mass % to 99 mass %. Further, the polymer latex may contain acrylic acid and/or methacrylic acid in an amount of preferably 1 mass % to 6 mass %, more preferably 2 mass % to 5 mass %, based on the total mass of the styrene monomer units and butadiene monomer units. The polymer latex preferably contains acrylic acid. A preferred range of the molecular weight is the same as described above.

The latex of the styrene-butadiene copolymer preferably used in the invention may be, for example, any of P-3 to P-8 and P-15 described above, or a commercially available product such as LACSTAR-3307B or 7132C, or NIPOL LX416.

In the invention, the organic-silver-salt containing layer may further include a hydrophilic polymer such as gelatin, polyvinyl alcohol, methyl cellulose, hydroxypropyl cellulose, or carboxymethyl cellulose as necessary. The amount of such a hydrophilic polymer to be added is preferably not more than 30 mass %, and more preferably not more than 20 mass %, based on the total amount of binder in the organic-silver-salt containing layer.

The organic-silver-salt containing layer (that is, image-forming layer) preferably includes a polymer latex. In the image-forming layer, the mass ratio of binder to organic silver salt is preferably in the range of 1/10 to 10/1, more preferably in the range of 1/3 to 5/1, furthermore preferably in the range of 1/1 to 3/1.

The layer containing the organic silver salt is generally the image-forming layer (the emulsion layer) containing the photosensitive silver halide (the photosensitive silver salt). In this case, the mass ratio of binder to silver halide is preferably in the range of 400 to 5, more preferably in the range of 200 to 10.

In the invention, the total amount of the binder in the image-forming layer is preferably 0.2 to 30 g/m$^2$, more preferably 1 to 15 g/m$^2$, further preferably 2 to 10 g/m$^2$. In the image-forming layer of the invention, a crosslinker for crosslinking and a surfactant for improvement of coatability may also be added.

Preferable Solvent for Coating Liquid

In the invention, the solvent of the coating liquid for the organic-silver-salt containing layer is preferably an aqueous solvent including 30 mass % or more of water. The term "solvent" used herein means a solvent or a dispersion medium. The aqueous solvent may include any water-miscible organic solvent such as methyl alcohol, ethyl alcohol, isopropyl alcohol, methyl cellosolve, ethyl cellosolve, dimethylformamide, and ethyl acetate. The water content of the solvent for the coating liquid is preferably 50 mass % or higher, more preferably 70 mass % or higher. Examples of preferred solvents include water, 90/10 mixture of water/methyl alcohol, 70/30 mixture of water/methyl alcohol, 80/15/5 mixture of water/methyl alcohol/dimethylformamide, 85/10/5 mixture of water/methyl alcohol/ethyl cellosolve, and 85/10/5 mixture of water/methyl alcohol/isopropyl alcohol, the numerals representing the mass ratios (mass %).

(Antifoggant)

Examples of antifoggants, stabilizers, and stabilizer precursors usable in the invention include compounds disclosed in JP-A No. 10-62899, Paragraph 0070 and EP-A No. 0803764A1, Page 20, Line 57 to Page 21, Line 7; compounds described in JP-A Nos. 9-281637 and 9-329864; and compounds described in U.S. Pat. No. 6,083,681 and EP Patent No. 1048975. The disclosures of the above patent documents are incorporated herein by reference.

(1) Organic Polyhalogen Compound

Organic polyhalogen compounds, which can be preferably used as the antifoggant in the invention, are described in detail below. The antifoggant is preferably an organic polyhalogen compound represented by the following formula (H):

$$Q—(Y)_n—C(Z1)(Z2)X. \qquad \text{Formula (H)}$$

In the formula (H), Q represents an alkyl group, an aryl group, or a heterocyclic group, Y represents a divalent linking group, n represents 0 to 1, Z1 and Z2 each independently represent a halogen atom, and X represents a hydrogen atom or an electron-withdrawing group.

In the formula (H), Q represents preferably an alkyl group having 1 to 6 carbon atoms, an aryl group having 6 to 12 carbon atoms, or a heterocyclic group including at least one nitrogen atom such as a pyridyl group or a quinolyl group.

When Q represents an aryl group, the aryl group is preferably a phenyl group substituted by an electron-withdrawing group with a positive Hammett's substituent constant σp. The Hammett's substituent constant is described, for example, in *Journal of Medicinal Chemistry,* 1973, Vol. 16, No. 11, 1207–1216, the disclosure of which is incorporated herein by reference. Examples of such an electron-withdrawing group include halogen atoms, alkyl groups having substituents of electron-withdrawing groups, aryl groups substituted by electron-withdrawing groups, heterocyclic groups, alkyl sulfonyl groups, aryl sulfonyl groups, acyl groups, alkoxycarbonyl groups, carbamoyl groups, and sulfamoyl groups. The electron-withdrawing group is preferably a halogen atom, a carbamoyl group, or an arylsulfonyl group, particularly preferably a carbamoyl group.

In a preferable embodiment, X represents an electron-withdrawing group. The electron-withdrawing group is preferably a halogen atom, an (aliphatic, aryl, or heterocyclyl) sulfonyl group, an (aliphatic, aryl, or heterocyclyl) acyl group, an (aliphatic, aryl, or heterocyclyl) oxycarbonyl group, a carbamoyl group, or a sulfamoyl group, more preferably a halogen atom or a carbamoyl group, particularly preferably a bromine atom.

Z1 and Z2 each independently represent preferably a bromine atom or an iodine atom, more preferably a bromine atom.

Y represent preferably —C(=O)—, —SO—, —$SO_2$—, —C(=O)N(R)—, or —$SO_2$N(R)—, more preferably —C(=O)—, —$SO_2$—, or —C(=O)N(R)—, particularly preferably —$SO_2$— or —C(=O)N(R)—, in which R represents a hydrogen atom, an aryl group, or an alkyl group, preferably a hydrogen atom or an alkyl group, particularly preferably a hydrogen atom.

In the formula (H), n represents 0 or 1, preferably 1.

In the formula (H), Y represents preferably —C(=O)N(R)— when Q represents an alkyl group, and Y represents preferably —$SO_2$— when Q represents an aryl group or a heterocyclic group.

In an embodiment, the antifoggant is a compound including two or more units represented by the formula (H), wherein each unit is bound to another unit, and a hydrogen atom in the formula (H) is substituted with the bond in each unit. Such a compound is referred to as a bis-, tris-, or tetrakis-type compound.

The compound represented by (H) is preferably substituted by a dissociative group (such as a COOH group, a salt of a COOH group, an $SO_3H$ group, a salt of an $SO_3H$ group, a $PO_3H$ group, or a salt of a $PO_3H$ group); a group containing a quaternary nitrogen cation, such as an ammonium group or a pyridinium group; a polyethyleneoxy group; a hydroxyl group; or the like.

Specific examples of the compounds represented by the formula (H) are shown below.

(H-1)

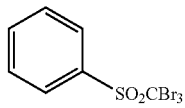

(H-2)

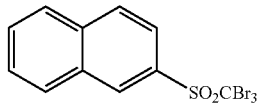

(H-3)

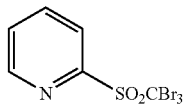

(H-4)

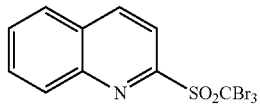

(H-5)

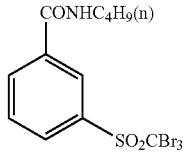

-continued (H-6)

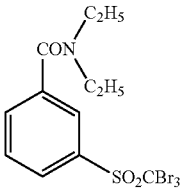

(H-7)

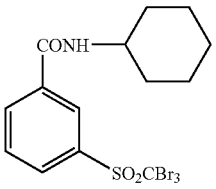

(H-8)

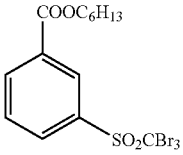

(H-9)

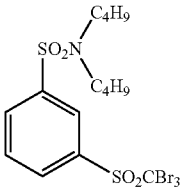

(H-10)

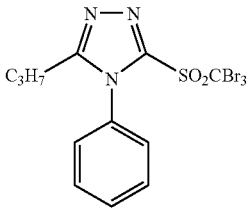

(H-11)

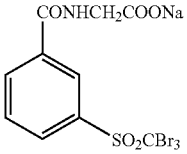

(H-12)

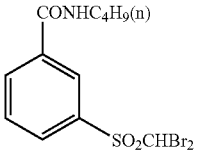

(H-13)

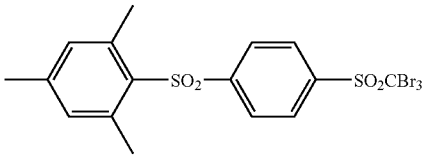

(H-14)

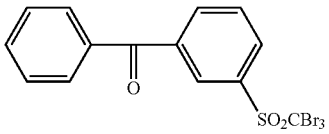

-continued (H-15)

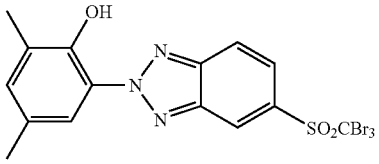

(H-16)

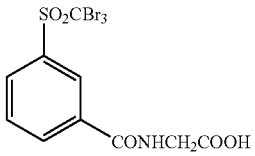

(H-17)

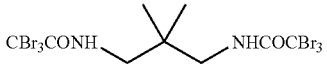

(H-18)

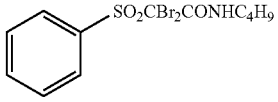

(H-19)

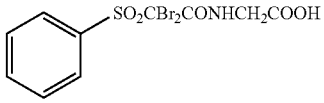

Examples of polyhalogen compounds usable in the invention include, in addition to the above compounds, compounds described in U.S. Pat. Nos. 3,874,946, 4,756,999, 5,340,712, 5,369,000, 5,464,737, and 6,506,548, and JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441, the disclosures of which are incorporated herein by reference. The compounds described in JP-A Nos. 7-2781,2001-33911, and 2001-312027 are particularly preferred.

The amount of the polyhalogen compound is preferably $10^{-4}$ mol to 1 mol, more preferably $10^{-3}$ mol to 0.5 mol, further preferably mol $10^{-2}$ mol to 0.2 mol, per 1 mol of non-photosensitive silver salt.

The antifoggant may be added to the photosensitive material in any of the manners described above as examples of the method of adding the reducing agent. The organic polyhalogen compound is preferably added in the state of a solid particle dispersion.

(2) Other Antifoggants

Examples of other antifoggants usable in the invention include mercury (II) salts described in JP-A No. 11-65021, Paragraph 0113; benzoic acid compounds described in JP-A No. 11-65021, Paragraph 0114; salicylic acid derivatives described in JP-A No. 2000-206642; formalin scavenger compounds represented by the formula (S) described in JP-A No. 2000-221634; triazine compounds disclosed in claim 9 of JP-A No. 11-352624; compounds represented by the formula (III) described in JP-A No. 6-11791; and 4-hydroxy-6-methyl-1,3,3a,7-tetrazaindene. The disclosures of the above patent documents are incorporated herein by reference.

The photothermographic materials of the invention may further include an azolium salt for the purpose of preventing fogging. Examples of the azolium salt include compounds represented by the formula (XI) described in JP-A No. 59-193447; compounds described in JP-B No. 55-12581; and compounds represented by the formula (II) described in JP-A No. 60-153039. The disclosures of the above patent documents are incorporated herein by reference. In an embodiment, the azolium salt is added to a layer on the same side as the image-forming layer. The layer to which the azolium salt may be added is preferably the image-forming layer. However, the azolium salt may be added to any portion of the material. The azolium salt may be added in any step in the preparation of the coating liquid. When the azolium salt is added to the organic-silver-salt containing layer, the azolium salt may be added in any step between the preparation of the organic silver salt and the preparation of the coating liquid. In an embodiment, the azolium salt is added during the period after the preparation of the organic silver salt but before the application of the coating liquid. The azolium salt may be added in the form of powder, a solution, a fine particle dispersion, etc. Further, the azolium salt may be added in the form of a solution which further contains other additives such as sensitizing dyes, reducing agents, and toning agents. The amount of the azolium salt to be added per 1 mol of silver is not particularly limited, and is preferably $1\times10^{-6}$ mol to 2 mol, more preferably $1\times10^{-3}$ mol to 0.5 mol.

(Other Additives)

1) Mercapto Compound, Disulfide Compound, and Thione Compound

Substances selected from mercapto compounds, disulfide compounds, and thione compounds may be used in the photothermographic material of the invention in order to control (inhibit or accelerate) the development, to heighten the spectral sensitization efficiency, or to improve the storability before or after the development, etc. Examples of the compounds are described in JP-A No. 10-62899, Paragraph 0067 to 0069; JP-A No. 10-186572, the compounds represented by the formula (I) and specific examples thereof described in Paragraph 0033 to 0052; EP-A No. 0803764A1, Page 20, Line 36-56; the disclosures of which are incorporated herein by reference. Mercapto-substituted heteroaromatic compounds described, for example, in JP-A Nos. 9-297367, 9-304875, 2001-100358, 2002-303954, and 2002-303951, (the disclosures of which are incorporated herein by reference) are particularly preferred in the invention.

2) Toning Agent

It is preferable to add a toning agent to the photothermographic material of the invention. Toning agents are described in JP-A No. 10-62899, paragraphs 0054 to 0055, EP-A No. 0803764A1, p. 21, lines 23 to 48, and JP-A Nos. 2000-356317 and 2000-187298. Specific examples of the toning agent include: phthalazinone, phthalazinone derivatives, and metal salts thereof, such as 4-(1-naphtyl)phthalazinone, 6-chlorophthalazinone, 5,7-dimethoxyphthalazinone, and 2,3-dihydro-1,4-phthalazinedione; combinations of phthalazinone with phthalic acids such as phthalic acid, 4-methylphthalic acid, 4-nitrophthalic acid, diammonium phthalate, sodium phthalate, potassium phthalate, and tetrachlorophthalic anhydride; phthalazines (phthalazine, phthalazine derivatives, and metal salts thereof) such as 4-(1-naphtyl)phthalazine, 6-isobutylphthalazine, 6-tert-butylphthalazine, 6-chlorophthalazine, 5,7-dimethoxyphthalazine, and 2,3-dihydrophthalazine; and combinations of phthalazines with phthalic acids. Combinations of phthalazines with phthalic acids are preferable, and the combination of 6-isopropylphthalazine and phthalic acid and the combination of 6-isopropylphthalazine and 4-methylphthalic acid are more preferable.

3) Plasticizer and Slipping Agent

In the invention, known plasticizers and slipping agents can be used for improving the physical property of films. Particularly, it is preferred to use a slipping agent such as liquid paraffin, a long-chain fatty acid, a fatty acid amide, or a fatty acid ester, for the purpose of improving the handling property at production and the scratch resistance at heat development. The slipping agent is preferably liquid paraffin from which low-boiling ingredients have been removed, or a fatty acid ester with a molecular weight of 1,000 or more having a branched structure.

The plasticizer and slipping agent that can be used in the image-forming layer and the non-photosensitive layer are preferably selected from the compounds described in JP-A No. 11-65021, paragraph 0117, JP-A Nos. 2000-5137, 2004-219794, 2004-219802, and 2004-334077, the disclosures of which are incorporated herein by reference.

4) Dye and Pigment

In the invention, the image-forming layer may further comprise various dyes and pigments (for example, C. I. Pigment Blue 60, C. I. Pigment Blue 64, and C. I. Pigment Blue 15:6) from the viewpoint of improving the tone, preventing occurrence of interference fringe and irradiation upon laser exposure. The dyes and pigments are described, for example, in WO98/36322 and JP-A Nos. 10-268465 and 11-338098, the disclosures of which are incorporated herein by reference.

5) Nucleating Agent

It is preferable to incorporate a nucleating agent into the image-forming layer. Examples of the nucleating agents, examples of the methods for adding them, and examples of the amount thereof are described in JP-A No. 11-65021, Paragraph 0118; JP-A No. 11-223898, Paragraph 0136 to 0193; JP-A No. 2000-284399 (the compounds each represented by any one of the formulae (H), (1) to (3), (A), and (B)); JP-A No. 2000-347345 (the compounds represented by the formulae (III) to (V) and the example compounds of Chemical Formula 21 to 24); etc. Further, examples of nucleation promoting agents are described in JP-A No. 11-65021, Paragraph 0102, and JP-A No. 11-223898, Paragraphs 0194 and 0195.

Formic acid or a formate salt may be used as a strong fogging agent. The amount of the formic acid or the formate salt per 1 mol of silver is preferably 5 mmol or smaller, more preferably 1 mmol or smaller, on the image-forming layer side.

In the photothermographic material of the invention, the nucleating agent is preferably used in combination with an acid generated by hydration of diphosphorus pentaoxide or a salt thereof. Examples of the acid and the salt include metaphosphoric acid, pyrophosphoric acid, orthophosphoric acid, triphosphoric acid, tetraphosphoric acid, hexametaphosphoric acid, and salts thereof. Particularly preferred are orthophosphoric acid, hexametaphosphoric acid, and salts thereof. Specific examples of the salts include sodium orthophosphate, sodium dihydrogen orthophospate, sodium hexametaphosphate, and ammonium hexametaphosphate.

The amount of the acid generated by the hydration of diphosphorus pentaoxide or the salt thereof may be selected depending on the sensitivity, the fogging properties, etc. The amount of the acid or the salt to be applied per 1 $m^2$ of the photosensitive material is preferably 0.1 to 500 $mg/m^2$, more preferably 0.5 to 100 $mg/m^2$.

In the invention, the reducing agent, the hydrogen-bonding compound, the development accelerator, and the polyhalogen compound are preferably used in the form of a solid dispersion. Preferable methods for producing the solid dispersions are disclosed in JP-A No. 2002-55405, the disclosures of which are incorporated herein by reference.

(Preparation and Application of Coating Liquid)

The coating liquid for the image-forming layer is prepared preferably at a preparation temperature of 30 to 65° C., more preferably 35° C. or higher but lower than 60° C., furthermore preferably 35 to 55° C. The temperature of the coating liquid immediately after addition of polymer latex is preferably maintained at 30 to 65° C.

(Layer Structure and Components)

The image-forming layer of the invention comprises at least one layer provided on the support. When the image-forming layer is a single layer, the image-forming layer includes an organic silver salt, a photosensitive silver halide, a reducing agent, and a binder. The image-forming layer may further include additional components such as a toning agent, a coating auxiliary, and other auxiliaries, in accordance with the necessity. When the image-forming layer comprises two or more layers, the first image-forming layer (usually the layer adjacent to the support) includes an organic silver salt and a photosensitive silver halide, and other components are each contained in the second image-forming layer and/or the first image-forming layer. When the photothermographic material of the invention is used as a multicolor photothermographic material, the material may comprise a combination of such two layers for each color or comprise a single layer including all components as described in U.S. Pat. No. 4,708,928, the disclosure of which is incorporated by reference herein. When a plurality of dyes are used in the multicolor photothermographic material, the respective emulsion layers are separated from each other generally by functional or non-functional barrier layers provided between the respective photosensitive layers as described in U.S. Pat. No. 4,460,681, the disclosure of which is incorporated by reference herein.

The photothermographic material of the invention may have a non-photosensitive layer or non-photosensitive layers, in addition to the image-forming layer. The non-photosensitive layers can be classified, based on the configuration thereof, as (a) a surface protecting layer provided on the image-forming layer (on the side farther from the support), (b) intermediate layer(s) provided between plural image-forming layers and/or between the image-forming layer and a surface protecting layer, (c) an undercoating layer provided between the image-forming layer and the support, and (d) a back layer provided on the side of the support opposite to the image-forming layer.

In addition, a layer serving as an optical filter may be provided as a non-photosensitive layer (a) or (b). An anti-halation layer may be provided as a non-photosensitive layer (c) or (d).

1) Surface Protective Layer

The photothermographic material of the invention may be provided with a surface protective layer for the purpose of, for example, preventing adhesion of the image-forming layer. The surface protective layer may have a monolayered structure or a multilayered structure.

The surface protective layer is described, for example, in paragraph Nos. 0119 to 0120 of JP-A No. 11-65021, and JP-A No. 2000-171936, the disclosures of which are incorporated herein by reference.

As the binder for the surface protective layer, gelatin is preferred. It is also preferable to use polyvinyl alcohol (PVA) singly or in combination with gelatin. Examples of usable gelatins include inert gelatin (e.g., Nitta gelatin 750) and phthalated gelatin (e.g., Nitta gelatin 801). PVA may be selected from ones described in paragraph Nos. 0009 to 0020 of JP-A 2000-171936 (the disclosure of which is incorporated herein by reference), preferably from: PVA-105, which is a completely saponified product, PVA-205, which is a partially saponified product, PVA-335, which is a partially saponified product, MP-203, which is a modified polyvinyl alcohol (all are manufactured by Kuraray Co., Ltd.), and the like. The coating amount (per square meter of the support) of polyvinyl alcohol of the protective layer (per one layer) is preferably 0.3 $g/m^2$ to 4.0 $g/m^2$, more preferably 0.3 $g/m^2$ to 2.0 $g/m^2$.

The coating amount (per square meter of the support) of the total binder (including water-soluble polymers and latex polymers) of the protective layer (per one layer) is preferably 0.3 $g/m^2$ to 5.0 $g/m^2$, more preferably 0.3 $g/m^2$ to 2.0 $g/m^2$.

The surface protective layer preferably includes a slipping agent such as liquid paraffin or an aliphatic ester. The slipping agent is used in an amount of 1 $mg/m^2$ to 200 $mg/m^2$, preferably 10 $mg/m^2$ to 150 $mg/m^2$, more preferably 20 $mg/m^2$ to 100 $mg/m^2$.

Non-photosensitive Intermediate Layer

The non-photosensitive intermediate layer is provided in between the image-forming layer and the non-photosensitive layer containing a thickner. Besides the binder, the non-photosensitive intermediate layer may contain after-mentioned additives such as development accelerators or development inhibitors, dyes, pigments, plasticizers, lubricating agents, crosslinking agents, and surfactants.

The binder of the non-photosensitive intermediate layer is preferably a hydrophobic polymer latex. The binder is more preferably a polymer containing 10 mass % to 70 mass % of a monomer component represented by the following formula (M).

$$CH_2{=}CR^{01}{-}CR^{02}{=}CH_2 \qquad \text{Formula (M)}$$

In the formula (M), $R^{01}$ and $R^{02}$ each independently represent a hydrogen atom, an alkyl group having 1 to 6 carbon atoms, a halogen atom, or a cyano group. In a preferable embodiment, $R^{01}$ and $R^{02}$ both represent hydrogen atoms. In another preferable embodiment, one of $R^{01}$ and $R^{02}$ represents a hydrogen atom while the other represents a methyl group.

When $R^{01}$ or $R^{02}$ represents an alkyl group, the alkyl group preferably has 1 to 4 carbon atoms, more preferably has 1 to 2 carbon atoms. When $R^{01}$ or $R^{02}$ represents a halogen atom, the halogen atom is preferably a fluorine atom, a chlorine atom, or a bromine atom, more preferably a chlorine atom.

In a preferable embodiment, $R^{01}$ and $R^{02}$ both represent hydrogen atoms. In another preferable embodiment, one of $R^{01}$ and $R^{02}$ represents a hydrogen atom and the remainder represents a methyl group.

Specific examples of monomers represented by the formula (M) include 2-ethyl-1,3-butadiene, 2-n-propyl-1,3-butadiene, 2,3-dimethyl-1,3-butadiene, 2-methyl-1,3-butadiene, 2-chloro-1,3-butadiene, 1-bromo-1,3-butadiene, 2-fluoro-1,3-butadiene, 2,3-dichloro-1,3-butadiene, and 2-cyano-1,3-butadiene.

The binder of the invention is a polymer comprising a monomer represented by the formula (M) as a copolymerized component. The copolymerization ratio of the monomer represented by the formula (M) in the polymer is 10 mass % to 70 mass %, preferably 15 mass % to 65 mass %, more preferably 20 mass % to 60 mass %. When the copolymerization ratio of the monomer represented by the formula (M) is less than 10 mass %, the amount of fusible component in the binder is reduced, whereby processing fragility becomes worse.

On the other hand, when the copolymerization ratio of the monomer represented by the formula (M) exceeds 70 mass %, the amount of fusible component in the binder increases, and the mobility of the binder increases. Therefore, image storability becomes worse.

As the acid group, a carboxylic acid, a sulfonic acid, and phosphoric acid are preferable, and a carboxylic acid is especially preferable. The copolymerization ratio of the acid group is preferably 1 to 20 mass %, and more preferably 1 to 10 mass %. Specific examples of the monomer containing an acid group include acrylic acid, methacrylic acid, itaconic acid, sodium p-styrenesulfonate, isoprenesulfonic acid, and phosphorylethyl methacrylate. Among them, acrylic acid and methacrylic acid are preferable, and acrylic acid is especially preferable.

The glass transition temperature (Tg) of the binder of the invention is preferably in the range of −30° C. to 70° C., more preferably −10° C. to 50° C., still more preferably 0° C. to 40° C. in view of film forming properties and image storability. A blend of two or more types of polymers can be used as the binder. When two or more polymers are used, the average Tg obtained by summing up the Tg of each polymer weighted by its proportion is preferably within the foregoing range. Also, when phase separation occurs or when a core-shell structure is adopted, the weighted average Tg is preferably within the foregoing range.

The polymer used for the binder of the invention can be easily obtained by a solution polymerization method, a suspension polymerization method, an emulsion polymerization method, a dispersion polymerization method, an anionic polymerization method, a cationic polymerization method, or the like. Above all, an emulsion polymerization method in which the polymer is obtained as a latex is the most preferable. For example, an emulsion polymerization method comprises conducting polymerization under stirring at about 30° C. to about 100° C. (preferably 60° C. to 90° C.) for 3 to 24 hours by using water or a mixed solvent of water and a water-miscible organic solvent (such as methanol, ethanol, or acetone) as a dispersion medium, a monomer mixture in an amount of 5 mass % to 150 mass % based on the amount of the dispersion medium, an emulsifier and a polymerization initiator. Various conditions such as the dispersion medium, the monomer concentration, the amount of initiator, the amount of emulsifier, the amount of dispersant, the reaction temperature, and the method for adding monomer are suitably determined considering the type of the monomers to be used. Furthermore, it is preferable to use a dispersant as necessary.

Generally, the emulsion polymerization method can be conducted according to the disclosures of the following documents: *Gosei Jushi Emarujon* (Synthetic Resin Emulsions) (edited by Taira Okuda and Hiroshi Inagaki and published by Kobunshi Kankokai (1978)); *Gosei Ratekkusu no Oyo* (Applications of Synthetic Latexs) (edited by Takaaki Sugimura, Yasuo Kataoka, Soichi Suzuki and Keiji Kasahara and published by Kobunshi Kankokai (1993)); and *Gosei Ratekkusu no Kagaku* (Chemistry of Synthetic Latexes) (edited by Soichi Muroi and published by Kobunshi Kankokai (1970)), the disclosures of which are incorporated herein by reference. The emulsion polymerization method for synthesizing the polymer latex of the invention may be a batch polymerization method, a monomer (continuous or divided) addition method, an emulsion addition method, a seed polymerization method, or the like. Among them, a batch polymerization method, a monomer (continuous or divided) addition method, and an emulsion addition method are preferable in view of the productivity of latex.

The polymerization initiator may be any polymerization initiator having radical generating ability. The polymerization initiator may be selected from inorganic peroxides such as persulfates and hydrogen peroxide, peroxides described in the organic peroxide catalogue of NOF Corporation, and azo compounds as described in the azo polymerization initiator catalogue of Wako Pure Chemical Industries, Ltd. Among them, water-soluble peroxides such as persulfates and water-soluble azo compounds as described in the azo polymerization initiator catalogue of Wako Pure Chemical Industries, Ltd., are preferable; ammonium persulfate, sodium persulfate, potassium persulfate, azobis(2-methylpropionamidine) hydrochloride, azobis(2-meth-yl-N-(2-hydroxyethyl)propionamide), and azobiscyanovaleric acid are more preferable; and peroxides such as ammonium persulfate, sodium persulfate, and potassium persulfate are especially preferable from the viewpoints of image storability, solubility and cost.

The amount of the polymerization initiator to be added is, based on the total amount of monomers, preferably 0.3 mass % to 2.0 mass %, more preferably 0.4 mass % to 1.75 mass %, and especially preferably 0.5 mass % to 1.5 mass %. When the amount of the polymerization initiator is less than 0.3 mass %, the image storability is lowered; and when it exceeds 2.0 mass %, the latex is likely to aggregate, thereby lowering the coating properties.

The polymerization emulsifier may be selected from anionic surfactants, nonionic surfactants, cationic surfactants, and ampholytic surfactants. Among them, anionic surfactants are preferable from the viewpoints of dispersibility and image storability. Sulfonic acid type anionic surfactants are more preferable because polymerization stability can be ensured even with a small addition amount and they have resistance to hydrolysis. Long chain alkyldiphenyl ether disulfonic acid salts (whose typical example is PELEX SS-H manufactured by Kao Corporation) are still more preferable, and low electrolyte types such as PIONIN A-43-S (manufactured by Takemoto Oil & Fat Co., Ltd.) are especially preferable.

The amount of sulfonic acid type anionic surfactant as the polymerization emulsifier is preferably 0.1 mass % to 10.0 mass %, more preferably 0.2 mass % to 7.5 mass %, and especially preferably 0.3 mass % to 5.0 mass %, based on the total amount of monomers. When the amount of the polymerization emulsifier is less than 0.1 mass %, the stability at the time of emulsion polymerization cannot be ensured. When it exceeds 10.0 mass %, the image storability is lowered.

It is preferable to use a chelating agent in synthesizing the polymer latex to be used in the invention. The chelating agent is a compound capable of coordinating (chelating) a polyvalent ion such as a metal ion (for example, an iron ion) or an alkaline earth metal ion (for example, a calcium ion). The chelating agent may be selected from compounds described in Japanese Patent Publication (JP-B) No. 6-8956, U.S. Pat. No. 5,053,322, and JP-A Nos. 4-73645, 4-127145, 4-247073, 4-305572, 6-11805, 5-173312, 5-66527, 5-158195, 6-118580, 6-110168, 6-161054, 6-175299, 6-214352, 7-114161, 7-114154, 7-120894, 7-199433, 7-306504, 9-43792, 8-314090, 10-182571, 10-182570 and 11-190892, the disclosures of which are incorporated herein by reference.

The chelating agent is preferably selected from inorganic chelate compounds (such as sodium tripolyphosphate, sodium hexametaphosphate, and sodium tetrapolyphosphate), aminopolycarboxylic-acid-based chelate compounds (such as nitrilotriacetic acid and ethylenediaminetetraacetic acid), organic-phosphonic-acid-based chelate compounds (such as compounds described in *Research Disclosure,* No. 18,170, JP-A Nos. 52-102726, 53-42730, 56-97347, 54-121127, 55-4024, 55-4025, 55-29883, 55-126241, 55-65955, 55-65956, 57-179843 and 54-61125, and West German Patent No. 1,045,373, the disclosures of which are incorporated herein by reference), polyphenol-based chelating agents, and polyamine-based chelate compounds. Aminopolycarboxylic acid derivatives are especially preferable.

Preferred examples of aminopolycarboxylic acid derivatives include compounds in the appended table of EDTA (*-Konpurekisan no Kagaku-*) (EDTA (-Chemistry of Complexons-) (published by Nankodo Co., Ltd., 1977), the disclosure of which is incorporated herein by reference. Some of the carboxyl groups of these compounds may be in the form of a salt of an alkali metal (such as sodium or potassium) or an ammonium salt. The aminocarboxylic acid derivative may be selected from iminodiacetic acid, N-methyliminodiacetic acid, N-(2-aminoethyl)iminodiacetic acid, N-(carbamoylmethyl)iminodiacetic acid, nitriletriacetic acid, ethylenediamine-N,N'-diacetic acid, ethylenediamine-N,N'-di-α-propionic acid, ethylenediamine-N,N'-di-β-propionic acid, N,N'-ethylene-bis-(α-o-hydroxyphenyl)glycine, N,N'-di(2-hydroxybenzyl)ethylenediamine-N,N'-diacetic acid, ethylenediamine-N,N'-diacetic acid-N,N'-diacetohydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,l-2,3-diaminobutane-N,N,N',N'-tetraacetic acid, meso-2,3-diaminobutane-N,N,N',N'-tetraacetic acid, 1-phenylethylenediamine-N,N,N',N'-tetraacetic acid, d,l-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-di-amine-N,N,N',N'-tetraacetic acid, trans-cyclo-hexane-1,2-diamine-N,N,N',N'-tetraacetic acid, cis-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetraacetic acid, o-phenylenediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis (ethyliminodiacetic acid), 2,2'-ethylenedioxy-bis (ethyliminodiacetic acid), ethylenediamine-N,N'-diacetic acid-N,N'-di-α-propionic acid, ethylenediamine-N,N'-diacetic acid-N,N'-di-β-propionic acid, ethylenediamine-N,N,N',N'-tetrapropionic acid, diethylenetriamine-N,N,N',N'',N''-pentaacetic acid, triethylenetetramine-N,N,N',N'',N''',N'''-hexaacetic acid, and 1,2,3-triaminopropane-N,N,N',N'',N''',N'''-hexaacetic acid. Also, ones in which a part of carboxyl groups of these compounds is substituted with a salt of alkali metal (for example, sodium and potassium) or an ammonium salt can be enumerated.

The amount of the chelating agent to be added is preferably 0.01 mass % to 0.4 mass %, more preferably 0.02 mass % to 0.3 mass %, and especially preferably 0.03 mass % to 0.15 mass %, based on the total amount of monomers. When the addition amount of the chelating agent is less than 0.01 mass %, metal ions entering during the preparation of the polymer latex are not sufficiently trapped, and the stability of the latex against aggregation is lowered, whereby the coating properties become worse. When it exceeds 0.4 mass %, the viscosity of the latex increases, whereby the coating properties are lowered.

In the preparation of the polymer latex to be used in the invention, it is preferable to use a chain transfer agent. By adding the chain transfer agent, it is possible to control the gelling rate. The chain transfer agent may be selected from ones described in *Polymer Handbook* (3rd Edition) (Wiley-Interscience, 1989), the disclosure of which is incorporated herein by reference. Sulfur compounds are more preferable because they have high chain transfer ability and because the required amount is small. Especially, hydrophobic mercaptane-based chain transfer agents such as tert-dodecylmercaptane and n-dodecylmercaptane are preferable.

The amount of the chain transfer agent to be added is preferably 0.2 mass % to 2.0 mass %, more preferably 0.3 mass % to 1.8 mass %, especially preferably 0.4 mass % to 1.6 mass %, based on the total amount of monomers.

Besides the foregoing compounds, in the emulsion polymerization, additives may be used such as electrolytes, stabilizers, thickeners, defoaming agents, antioxidants, vulcanizers, antifreezing agents, gelling agents, and vulcanization accelerators. The additives may be selected from the additives described in *Synthetic Rubber Handbook.*

(Specific Examples of Polymer)

Specific examples (Exemplary Compounds (P-1) to (P-9)) of the polymer usable in the invention are shown in Table 1. However, the examples should not be construed as limiting the invention.

TABLE 1

| | Styrene | Isoprene | Acid group monomer | | |
|---|---|---|---|---|---|
| Compound No. | Copolymerization ratio (mass %) | Copolymerization ratio (mass %) | Kind | Copolymerization ratio (mass %) | Tg (° C.) |
| P-1 | 60.4 | 36.6 | Acrylic acid | 3 | 15.5 |
| P-2 | 63 | 34 | Acrylic acid | 3 | 20.2 |
| P-3 | 65 | 32 | Acrylic acid | 3 | 23.9 |
| P-4 | 59.5 | 37.5 | Acrylic acid | 3 | 13.9 |
| P-5 | 45 | 50 | Acrylic acid | 5 | −6.6 |
| P-6 | 70 | 26 | Acrylic acid | 4 | 35.8 |
| P-7 | 45 | 53 | Acrylic acid | 2 | −11.2 |

TABLE 1-continued

| Compound No. | Styrene Copolymerization ratio (mass %) | Isoprene Copolymerization ratio (mass %) | Acid group monomer Kind | Acid group monomer Copolymerization ratio (mass %) | Tg (° C.) |
|---|---|---|---|---|---|
| P-8 | 60 | 35 | Methacrylic acid | 5 | 21.2 |
| P-9 | 50 | 46 | Methacrylic acid | 4 | 1.5 |
| P-10 | 37 | 56 | Methacrylic acid | 7 | −12.4 |
| P-11 | 70.5 | 27 | Methacrylic acid | 2.5 | 35.2 |
| P-12 | 65.5 | 30 | Itaconic acid | 4.5 | 31.8 |
| P-13 | 60 | 34.5 | Itaconic acid | 5.5 | 24 |
| P-14 | 47 | 50 | Itaconic acid | 3 | −4.6 |
| P-15 | 53.5 | 42.5 | Sodium p-styrenesulfonate | 4 | 6.9 |
| P-16 | 66 | 29 | Sodium p-styrenesulfonate | 5 | 32.2 |
| P-17 | 45.5 | 52 | Sodium p-styrenesulfonate | 2.5 | −8.8 |

In the coating liquid of the polymer latex to be used in the invention, an aqueous solvent can be used as the solvent, and a water-miscible organic solvent can be used additionally. Examples of usable water-miscible organic solvents include alcohols (for example, methyl alcohol, ethyl alcohol, and propyl alcohol), cellosolves (for example, methyl cellosolve, ethyl cellosolve, and butyl cellosolve), ethyl acetate, and dimethylformamide. The amount of the organic solvent to be added is preferably not more than 50% of the entire solvent, more preferably not more than 30% of the entire solvent.

Furthermore, in the polymer latex to be used in the invention, the polymer concentration is, based on the amount of the latex liquid, preferably 10 mass % to 70 mass %, more preferably 20 mass % to 60 mass %, and especially preferably 30 mass % to 55 mass %.

In a preferable embodiment, the polymer latex in the invention has an equilibrium water content of not more than 2 mass % at 25° C. and 60% RH. The equilibrium water content is more preferably 0.01 mass % to 1.5 mass %, and further preferably 0.02 mass % to 1.0 mass %.

The latex particle in the invention may have a mean particle size in the range of 1 nm to 50,000 nm, preferably 5 nm to 1,000 nm, more preferably 10 nm to 500 nm, further preferably 50 nm to 200 nm. The particle size distribution of the dispersed particles is not particularly restricted, and may be a wide or monodisperse distribution. It is preferable to use two or more kinds of particles each having a monodisperse distribution so as to adjust the physical properties of the coating liquid.

In the invention, the non-photosensitive intermediate layer may further include hydrophilic polymers such as gelatin, polyvinyl alcohol, methyl cellulose, hydroxypropyl cellulose, and carboxymethyl cellulose as necessary. The amount of such a hydrophilic polymer to be added is preferably not more than 50 mass %, and more preferably not more than 20 mass %, based on the total amount of binder in the non-photosensitive intermediate layer.

The total coating amount of binder of the non-photosensitive intermediate layer is preferably in the range of 0.1 $g/m^2$ to 10 $g/m^2$, more preferably 0.3 $g/m^2$ to 8.0 $g/m^2$.

3) Antihalation Layer

In the photothermographic material of the invention, an antihalation layer may be disposed such that the antihalation layer is farther from the exposure light source than the image-forming layer is.

The antihalation layer is described, for example, in JP-A No. 11-65021, Paragraphs 0123 to 0124, JP-A Nos. 11-223898, 9-230531, 10-36695, 10-104779, 11-231457, 11-352625, and 11-352626, the disclosures of which are incorporated herein by reference.

The antihalation layer includes an antihalation dye having absorption in the exposure wavelength range. When the exposure wavelength is within the infrared range, an infrared-absorbing dye may be used as the antihalation dye, and the infrared-absorbing dye is preferably a dye which does not absorb visible light.

When a dye having absorption in the visible light range is used to prevent the halation, in a preferable embodiment, the color of the dye does not substantially remain after image formation. It is preferable to achromatize the dye by heat at the heat development. In a more preferable embodiment, a base precursor and a thermally-achromatizable dye are added to a non-photosensitive layer so as to impart the antihalation function to the non-photosensitive layer. These techniques are described, for example in JP-A No. 11-231457, the disclosure of which is incorporated by reference herein.

The amount of the achromatizable dye to be applied may be determined depending on the purpose of the dye. Generally, the amount of the achromatizable dye is selected such that the optical density (the absorbance) exceeds 0.1 at the desired wavelength. The optical density is preferably 0.15 to 2, more preferably 0.2 to 1. The amount of the dye required for obtaining such an optical density is generally 0.001 $mg/m^2$ to 1 $g/m^2$.

When the dye is achromatized in this manner, the optical density after the heat development can be lowered to 0.1 or lower. In an embodiment, two or more achromatizable dyes are used in combination in a thermally achromatizable recording material or in a photothermographic material. Similarly, two or more base precursors may be used in combination.

In the thermal achromatization, it is preferable to use an achromatizable dye, a base precursor, and a substance which can lower the melting point of the base precursor by 3° C. or more when mixed with the base precursor, in view of the thermal achromatizability, as described in JP-A No. 11-352626, the disclosure of which is incorporated by reference herein. Examples of the substance include diphenylsulfone, 4-chlorophenyl(phenyl)sulfone, and 2-naphtyl benzoate.

4) Back Layer

Examples of the back layer usable in the invention are described in JP-A No. 11-65021, Paragraphs 0128 to 0130, the disclosure of which is incorporated herein by reference.

In the invention, a coloring agent having an absorption peak within the wavelength range of 300 to 450 nm may be added to the photosensitive material so as to improve the color tone of silver and to suppress the image deterioration with time. Examples of the coloring agent are described in JP-A Nos. 62-210458, 63-104046, 63-103235, 63-208846, 63-306436, 63-314535, 01-61745, and 2001-100363, the disclosures of which are incorporated by reference herein.

Such a coloring agent is generally added in an amount in the range of 0.1 $mg/m^2$ to 1 $g/m^2$. In an embodiment, a coloring agent is added to a back layer disposed on the opposite side to the image-forming layer.

It is preferable to use a dye having an absorption peak at 580 to 680 nm in order to control base color tone. Preferable examples of the dye include azomethine type oil-soluble dyes such as described in JP-A Nos. 4-359967 and 4-359968, and phthalocyanine type water-soluble dyes such as described in JP-A No. 2003-295388, which each have a small absorption intensity in the shorter wavelength range. The disclosures of the above patent documents are incorporated herein by reference. The dye for this purpose may be added to any layer, preferably to a non-photosensitive layer on the image-forming layer side or on the back side.

The photothermographic material of the invention is preferably a so-called single-sided photosensitive material, which comprises at least one image-forming layer including the silver halide emulsion on one side of the support, and a back layer on the other side of the support.

5) Polymer Latex

When the photothermographic material of the invention is used for printing, in which dimensional change is problematic, it is preferable to use a polymer latex in a surface protective layer and/or a back layer. Such a polymer latex is described, for example, in *Gosei Jushi Emulsion,* (compiled by Taira Okuda and Hiroshi Inagaki, issued by Kobunshi Kanko Kai (1978)); *Gosei Latex no Oyo,* (compiled by Takaaki Sugimura, Yasuo Kataoka, Souichi Suzuki, and Keishi Kasahara, issued by Kobunshi Kanko Kai (1993); *Gosei Latekkusu no Kagaku* (written by Soichi Muroi, issued by Kobunshi Kanko Kai (1970)), the disclosures of which are incorporated herein by reference. Specific examples thereof include latex of methyl methacrylate (33.5 mass %)-ethyl acrylate (50 mass %)-methacrylic acid (16.5 mass %) copolymer, latex of methyl methacrylate (47.5 mass %)-butadiene (47.5 mass %)-itaconic acid (5 mass %) copolymer, latex of ethyl acrylate-methacrylic acid copolymer, latex of methyl methacrylate (58.9 mass %)-2-ethylhexyl acrylate (25.4 mass %)-styrene (8.6 mass %)-2-hydroxyethyl methacrylate (5.1 mass %)-acrylic acid (2.0 mass %) copolymer, and latex of methyl methacrylate (64.0 mass %)-styrene (9.0 mass %)-butyl acrylate (20.0 mass %)-2-hydroxyethyl methacrylate (5.0 mass %)-acrylic acid (2.0 mass %) copolymer. Further, regarding the binder for the surface protective layer, the combinations of polymer latexes described in JP-A No. 2000-267226, the technique described in paragraph Nos. 0021 to 0025 of JP-A No. 2000-267226, the technique described in paragraph nos. 0027 to 0028 of Japanese Patent Application No. 11-6872, and the technique described in paragraph Nos. 0023 to 0041 of JP-A No. 2000-19678 may also be applied, the disclosures of which are incorporated herein by reference. The proportion of polymer latex to the total amount of binder in the surface protective layer is preferably 10 mass % to 90 mass %, more preferably 20 mass % to 80 mass %.

6) Film Surface pH

The photothermographic material of the invention before heat development preferably has a film surface pH of 7.0 or lower. The film surface pH is more preferably 6.6 or lower. The lower limit of the film surface pH may be approximately 3, though it is not particularly restricted. The film surface pH is still more preferably 4 to 6.2. It is preferable to adjust the film surface pH using an organic acid such as a phthalic acid derivative, a nonvolatile acid such as sulfuric acid, or a volatile base such as ammonia, from the viewpoint of lowering the film surface pH. In order to achieve a low film surface pH, it is preferable to use ammonia since ammonia is high in volatility and can be removed during coating or before heat development. It is also preferable to use ammonia in combination with a nonvolatile base such as sodium hydroxide, potassium hydroxide, or lithium hydroxide. Methods for measuring the film surface pH are described in JP-A No. 2000-284399, Paragraph 0123, the disclosure of which is incorporated herein by reference.

7) Film Hardener

A film hardener may be included in layers such as the image-forming layer, the protective layer, and the back layer. Examples of the film hardeners are described in T. H. James, *The Theory of the Photographic Process, Fourth Edition,* Page 77 to 87 (Macmillan Publishing Co., Inc., 1977), the disclosure of which is incorporated by reference herein. Preferred examples of the film hardeners include: chromium alums; 2,4-dichloro-6-hydroxy-s-triazine sodium salt; N,N-ethylenebis(vinylsulfonacetamide); N,N-propylenebis(vinylsulfonacetamide); polyvalent metal ions described in Page 78 of the above reference; polyisocyanates described in U.S. Pat. No. 4,281,060, JP-A No. 6-208193, etc.; epoxy compounds described in U.S. Pat. No. 4,791,042, etc.; and vinylsulfone compounds described in JP-A No. 62-89048, etc. The disclosures of the above patent documents are incorporated herein by reference.

The film hardener is added in the form of a solution, and the solution is added to the coating liquid for the protective layer preferably in the period of 180 minutes before coating to immediately before coating, more preferably in the period of 60 minutes before coating to 10 seconds before coating. The method and conditions of mixing the film hardener into the coating liquid are not particularly limited as long as the advantageous effects of the invention can be sufficiently obtained. In an embodiment, the film hardner is mixed with the coating liquid in a tank while controlling the addition flow rate and the feeding amount to the coater, such that the average retention time calculated from the addition flow rate and the feeding amount to the coater is the desired time. In another embodiment, the film hardner is mixed with the coating liquid by a method using a static mixer described, for example, in N. Harnby, M. F. Edwards, and A. W. Nienow, translated by Koji Takahashi, *Ekitai Kongo Gijutsu,* Chapter 8 (Nikkan Kogyo Shimbun, Ltd., 1989), the disclosure of which is incorporated herein by reference.

8) Surfactant

Surfactants described in JP-A No. 11-65021 (the disclosure of which is incorporated herein by reference in its entirety), Paragraph 0132, solvents described in ibid, Paragraph 0133, supports described in ibid, Paragraph 0134, antistatic layers and conductive layers described in ibid, Paragraph 0135, methods for forming color images described in ibid, Paragraph 0136, and slipping agents described in JP-A No. 11-84573 (the disclosure of which is incorporated herein by reference in its entirety), Paragraph 0061 to 0064 and JP-A No. 2001-83679 (the disclosure of which is incorporated herein by reference in its entirety) Paragraph 0049 to 0062, can be used in the invention.

In the invention, the fluorine-based surfactant may be used on the image-forming layer side and/or on the back side, and is preferably used on both the image-forming layer side and the back side. It is particularly preferable to use a combination of the surfactant and the above-described conductive layer containing a metal oxide. In this case, sufficient performance can be achieved even if the fluorine-based surfactant in the electrically conductive layer side is reduced or removed.

The amount of the fluorine-based surfactant used in each of the emulsion surface and the back surface is preferably 0.1 to 100 mg/m$^2$, more preferably 0.3 to 30 mg/m$^2$, further preferably 1 to 10 mg/m$^2$.

9) Antistatic Agent

The photothermographic material of the invention preferably comprises an electrically conducting layer containing an electrically conductive material such as a metal oxide or an electrically conductive polymer. The electrically conducting layer may be the same layer as a layer selected from the undercoat layer, the back surface protective layer, and the like, or may be provided as a separate layer which is different from those layers. The conductive material in the antistatic layer is preferably a metal oxide whose conductivity has been heightened by incorporation of oxygen defects and/or hetero-metal atoms.

The metal oxide is preferably ZnO, $TiO_2$, or $SnO_2$. It is preferable to add Al or In to ZnO. It is preferable to add Sb, Nb, P, a halogen atom, or the like to $SnO_2$. It is preferable to add Nb, Ta, or the like to $TiO_2$. $SnO_2$ to which Sb has been added is particularly preferable conductive substance for the electrically conducting layer. The amount of the hetero atom is preferably 0.01 to 30 mol %, more preferably 0.1 to 10 mol %. The particles of the metal oxide may be in a spherical shape, in a needle shape, or in a plate shape. The metal oxide particles are preferably needle-shaped particles with the ratio of the major axis to the minor axis of 2.0 or higher in view of the conductivity, and the ratio is more preferably 3.0 to 50. The amount of the metal oxide is preferably 1 to 1,000 mg/m$^2$, more preferably 10 to 500 mg/m$^2$, furthermore preferably 20 to 200 mg/m$^2$. The antistatic layer may be provided on the image-forming layer side or on the back side. In a preferable embodiment, the antistatic layer is provided between the support and the back layer. Specific examples of the antistatic layer are described in JP-A No. 11-65021, Paragraph 0135; JP-A Nos. 56-143430, 56-143431, 58-62646, and 56-120519; JP-A No. 11-84573, Paragraph 0040 to 0051; U.S. Pat. No. 5,575,957; and JP-A No. 11-223898, Paragraph 0078 to 0084; the disclosures of which are incorporated herein by reference.

10) Support

The support comprises preferably a heat-treated polyester, particularly a polyethylene terephthalate, which has been subjected to a heat treatment at 130 to 185° C. so as to relax the internal strains of the film generated during biaxial stretching, thereby eliminating the heat shrinkage strains during heat development. In the case of a photothermographic material for medical use, the support may be colored with a blue dye (e.g., Dye-1 described in Examples of JP-A No. 8-240877, the disclosure of which is incorporated herein by reference) or uncolored. The support is preferably undercoated, for example, with a water-soluble polyester described in JP-A No. 11-84574, a styrene-butadiene copolymer described in JP-A No. 10-186565, a vinylidene chloride copolymer described in JP-A No. 2000-39684 or Japanese Patent Application No. 11-106881, Paragraph 0063 to 0080, the disclosures of which are incorporated herein by reference. When the support is coated with the image-forming layer or the back layer, the support preferably has a moisture content of 0.5 mass % or lower.

11) Other Additives

The photothermographic material of the invention may further include additives such as antioxidants, stabilizing agents, plasticizers, UV absorbers, and coating aids. The additives may be added to any one of the image-forming layer and layers other than the image-forming layer. The additives may be used with reference to WO 98/36322, EP-A No. 803764A1, JP-A Nos. 10-186567 and 10-18568, the disclosures of which are incorporated herein by reference.

12) Coating Method

The photothermographic material of the invention may be formed by any coating method. Specific examples of the coating method include extrusion coating methods, slide coating methods, curtain coating methods, dip coating methods, knife coating methods, flow coating methods, extrusion coating methods using a hopper described in U.S. Pat. No. 2,681,294, the disclosure of which is incorporated herein by reference. The coating method is preferably an extrusion coating method described in Stephen F. Kistler and Petert M. Schweizer, *Liquid Film Coating,* Page 399 to 536 (CHAPMAN & HALL, 1997) (the disclosure of which is incorporated herein by reference), or a slide coating method, more preferably a slide coating method. Examples of slide coaters for the slide coating methods are described in the above reference, Page 427, FIG. 11b.1. Two or more layers may be simultaneously formed by any of the methods described in the above reference, Page 399 to 536, and methods described in U.S. Pat. No. 2,761,791 and British Patent No. 837,095, the disclosures of which are incorporated herein by reference. Particularly preferred coating methods used in the invention include those described in JP-A Nos. 2001-194748, 2002-153808, 2002-153803, and 2002-182333, the disclosures of which are incorporated herein by reference.

In the invention, the coating liquid for the image-forming layer is preferably a so-called thixotropy fluid. The thixotropy fluid may be used with reference to JP-A No. 11-52509, the disclosure of which is incorporated herein by reference. The viscosity of the coating liquid for the image-forming layer is preferably 400 to 100,000 mPa·s at a shear rate of 0.1 $S^{-1}$, more preferably 500 to 20,000 mPa·s at a shear rate of 0.1 $S^{-1}$. Further, the viscosity of the coating liquid is preferably 1 to 200 mPa·s at a shear rate of 1,000 $S^{-1}$, more preferably 5 to 80 mPa·s at the shear rate of 1,000 $S^{-1}$.

In the preparation of the coating liquid, it is preferable to use a known in-line mixing apparatus or a known in-plant mixing apparatus when two or more liquids are mixed. The in-line mixing apparatus described in JP-A No. 2002-85948 and the in-plant mixing apparatus described in JP-A No. 2002-90940 can be preferably used in the invention. The disclosures of the above patent documents are incorporated by reference herein.

The coating liquid is preferably subjected to a defoaming treatment to obtain an excellent coating surface. Preferred methods for the defoaming treatment are described in JP-A No. 2002-66431, the disclosure of which is incorporated herein by reference.

In or before the application of the coating liquid, the support is preferably subjected to electrical neutralization so as to prevent adhesion of dusts, dirts, etc. caused by the electrification of the support. Preferred examples of the neutralizing methods are described in JP-A No. 2002-143747, the disclosure of which is incorporated herein by reference.

When a non-setting type coating liquid for the image-forming layer is dried, it is important to precisely control drying air and drying temperature. Preferred drying methods are described in detail in JP-A Nos. 2001-194749 and 2002-139814, the disclosures of which are incorporated herein by reference.

The photothermographic material of the invention is preferably heat-treated immediately after coating and drying, so as to increase the film properties. In a preferable embodiment, the heating temperature of the heat treatment is controlled such that the film surface temperature is 60 to 100° C. The heating time is preferably 1 to 60 seconds. The film surface temperature in the heat treatment is more preferably 70 to 90° C., and the heating time is more preferably 2 to 10 seconds. Preferred examples of the heat treatments are described in JP-A No. 2002-107872, the disclosure of which is incorporated herein by reference.

Further, the production methods described in JP-A Nos. 2002-156728 and 2002-182333 (the disclosures of which are incorporated herein by reference) can be preferably used to stably produce the photothermographic material of the invention continuously.

The photothermographic material of the invention is preferably a monosheet type material, which can form an image on the material without using another sheet such as an image-receiving material.

13) Packaging Material

It is preferable to pack the photosensitive material of the invention in a packaging material having a low oxygen permeability and/or a low water permeability so as to prevent deterioration of the photographic properties during storage or to prevent curling. The oxygen permeability is preferably 50 ml/atm·m$^2$·day or lower at 25° C., more preferably 10 ml/atm·m$^2$·day or lower at 25° C., furthermore preferably 1.0 ml/atm·m$^2$·day or lower at 25° C. The water permeability is preferably 10 g/atm·m$^2$·day or lower, more preferably 5 g/atm·m$^2$·day or lower, furthermore preferably 1 g/atm·m$^2$·day or lower.

Specific examples of the packaging material having a low oxygen permeability and/or a low water permeability include materials described in JP-A Nos. 8-254793 and 2000-206653, the disclosures of which are incorporated herein by reference.

14) Other Technologies

Other technologies usable for the photothermographic material of the invention include those described in EP-A Nos. 803764A1 and 883022A1, WO 98/36322, and JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2000-187298, 2000-10229, 2000-47345, 2000-206642, 2000-98530, 2000-98531, 2000-112059, 2000-112060, 2000-112104, 2000-112064, and 2000-171936, the disclosures of which are incorporated herein by reference.

In the case a multi-color photothermographic material, the image-forming layers are generally separated from each other by providing functional or non-functional barrier layers between them as described in U.S. Pat. No. 4,460,681, the disclosure of which is incorporated herein by reference.

The multicolor photothermographic material may comprise a combination of two layers for each color or a single layer including all the components as described in U.S. Pat. No. 4,708,928, the disclosure of which is incorporated herein by reference.

Image Forming Method

1) Exposure

The exposure light source may be a red to infrared emission laser such as an He—Ne laser and a red semiconductor laser, or a blue to greed emission laser such as an $Ar^+$ laser, an He—Ne laser, an He—Cd laser, and a blue semiconductor laser. The laser is preferably a red to infrared emission semiconductor laser, and the peak wavelength of the laser is 600 to 900 nm, preferably 620 to 850 nm.

In recent years, a blue semiconductor laser and a module comprising an SHG (Second Harmonic Generator) and a semiconductor laser have been developed, and thus laser output units with short wavelength ranges have attracted a lot of attention. Blue semiconductor lasers can form a highly fine image, can increase recording density, is long-lived, and has stable output, whereby the demand for blue semiconductor lasers is expected to be increased. The peak wavelength of the blue laser is preferably 300 to 500 nm, more preferably 400 to 500 nm.

In a preferable embodiment, the laser light is emitted in vertical multimode by high frequency superposition, etc.

2) Heat Development

The photothermographic material of the invention may be developed by any method, but is generally exposed image-wise and then heat-developed. The development temperature is preferably 80 to 250° C., more preferably 100 to 140° C. The development time is preferably 1 to 30 seconds, more preferably 5 to 18 seconds.

In a preferable embodiment, the photothermographic material of the invention is heated while conveyed. The conveyance speed is preferably 23 mm/sec or higher, more preferably 25 mm/sec or higher, still more preferably 27 mm/sec or higher, from the viewpoint of rapid image formation.

Heat development may be conducted by a drum heater or a plate heater, preferably by a plate heater. A heat development method using a heat development apparatus comprising a plate heater described in JP-A No. 11-133572 (the disclosure of which is incorporated herein by reference) can be preferably used in the invention. The heat development apparatus comprises a heat developing section, and a visible image is formed by: forming a latent image on a photothermographic material, and bringing the material into contact with a heating unit in the heat developing section. In the heat development apparatus, the heating unit comprises the plate heater, a plurality of press rollers facing each other are arranged along one surface of the plate heater, and the photothermographic material is passed between the press rollers and the plate heater to be heat-developed. In a preferable embodiment, the plate heater is divided into two to six stages and the temperature of the end part is lowered by approximately 1 to 10° C. For example, four plate heaters may be independently controlled at 112° C., 119° C., 121° C., and 120° C. Such a method is described also in JP-A No. 54-30032, the disclosure of which is incorporated by reference herein. In the method, water and organic solvents included in the photothermographic material can be removed, and deformation of the support caused by rapid heating can be prevented.

To reduce the size of the heat development apparatus and the heat development time, more stable control of the heater is preferred. In an embodiment, the heat development of the leading end of the photothermographic material is started before the rear end is exposed. Rapid processing type imagers preferred in the invention are described in JP-A Nos. 2002-289804 and 2002-287668, the disclosures of which are incorporated herein by reference. When such an imager is used, for example, the photothermographic material can be heat-developed in 14 seconds by a plate heater having three stages controlled at 107° C., 121° C., and 121° C. respectively, and the first sheet of the material can be outputted in about 60 seconds. In such rapid development, it is preferable to use the photothermographic material of the invention, which is high in the sensitivity and hardly affected by ambient temperature.

3) System

Fuji Medical Dry Laser Imager FM-DPL and DRYPIX 7000 are known as laser imagers for medical use comprising an exposure region and a heat developing region. FM-DPL is described in *Fuji Medical Review,* No. 8, Page 39 to 55 (the disclosure of which is incorporated herein by reference), and the technologies disclosed therein can be applied to the invention. The photothermographic material of the invention can be used for the laser imager in AD Network, proposed by Fuji Film Medical Co., Ltd. as a network system according to DICOM Standards.

Application of the Invention

The photothermographic material of the invention forms black and white images of silver and is preferably used as a photothermographic material for medical diagnosis, industrial photography, printing, or COM.

EXAMPLES

The present invention is to be described specifically by way of Examples. However, Examples should not be construed as limiting the invention.

Example 1

1. Preparation of PET Support

1) Film Preparation

PET with an inherent viscosity IV=0.66 (measured in phenol/tetrachloroethane=6/4 (weight ratio) at 25° C.) was prepared using terephthalic acid and ethylene glycol according to a usual method. After pelleting the product, it was dried at 130° C. for 4 hours, melted at 300° C., and then extruded from a T die and cooled rapidly to prepare a non-stretched film.

The film was stretched longitudinally by 3.3 times at 110° C. using rolls of different circumferential speeds and then stretched laterally by 4.5 times at 130° C. by a tenter. Subsequently, it was thermally set at 240° C. for 20 sec and then relaxed by 4% in the lateral direction at the same temperature. Then, after slitting the chuck portion of the tenter, both ends thereof were knurled, and the film was taken up under 4 kg/cm$^2$, to obtain a roll with a thickness of 175 μm.

2) Surface Corona Treatment

Both surfaces of the support were treated by a solid state corona processing machine model 6 KVA manufactured by Pillar Co. at room temperature at 20 m/min. Based on the measured current and voltage, it was found that a treatment at 0.375 kV·A·min/m$^2$ was applied to the support. The processing frequency was 9.6 kHz and the gap clearance between the electrode and the dielectric roll was 1.6 mm.

3) Undercoating

| (1) Preparation of undercoating layer coating liquid | |
|---|---|
| Formulation (1) (for undercoating layer on the image-forming layer side) | |
| PESRESIN A-520 (30 mass % solution) manufactured by Takamatsu Oils and Fats Co., Ltd. | 46.8 g |
| VYLONAL MD-1200 manufactured by Toyo Boseki Co. | 10.4 g |
| 1 mass % solution of polyethylene glycol mono nonyl phenyl ether (average ethylene oxide number = 8.5) | 11.0 g |
| MP-1000 (fine PMMA polymer particles, average particle diameter 0.4 μm) manufactured by Soken Kagaku Co. | 0.91 g |
| Distilled water | 931 ml |
| Formulation (2) (for first layer on back surface) | |
| Styrene-butadiene copolymer latex (solid content 40 mass %, styrene/butadiene weight ratio = 68/32) | 130.8 g |
| Aqueous 8 mass % solution of sodium salt of 2.4-dichloro-6-hydroxy-S-triazine | 5.2 g |
| Aqueous 1 mass % solution of sodium lauryl benzene sulfonate | 10 ml |
| Polystyrene particle dispersion (average particle diameter 2 μm, 20 mass %) | 0.5 g |
| Distilled water | 854 ml |
| Formulation (3) (for second layer on back surface) | |
| $SnO_2$/SbO (9/1 mass ratio, average particle diameter 0.5 μm, 17 mass % dispersion) | 84 g |
| Gelatin | 7.9 g |
| METROSE TC-5 (aqueous 2 mass % solution) manufactured by Shinetsu Chemical Industry Co. | 10 g |
| Aqueous 1 mass % solution of sodium dodecylbenzene sulfonate | 10 ml |
| NaOH (1 mass %) | 7 g |
| PROXEL (manufactured by Avecia Co.) | 0.5 g |
| Distilled water | 881 ml |

After applying the corona discharging treatment described above to both surfaces of the biaxially stretched polyethylene terephthalate support having a thickness of 175 μm, the undercoating coating liquid formulation (1) described above was coated on one side (side on which image-forming layer was to be provided) by a wire bar in a wet coating amount of 6.6 ml/m$^2$ (per one side), and then dried at 180° C. for 5 min. Then, the undercoating coating liquid formulation (2) described above was coated on the rear face (back side) thereof by a wire bar in a wet coating amount of 5.7 ml/m$^2$ and dried at 180° C. for 5 min. Further, the undercoating coating liquid formulation (3) described above was coated on the rear face (back side) by a wire bar in a wet coating amount of 8.4 ml/m$^2$, and dried at 180° C. for 6 min to prepare an undercoated support.

2. Layers on Back Side (Back Layer)

A container was kept at 40° C. The following materials were mixed in the container: 30 g of gelatin, 34 ml of a 2 mass % solution of a metallic phthalocyanine dye 1, 12.6 cc of a 1 mass % aqueous solution of a magenta color toning dye 1, 20 g of a monodispersed polymethyl methacrylate fine particles (mean particle size: 8 μm, particle size standard deviation: 0.4), 0.1 g of benzoisothiazoline, and 570 ml of water. As a result, the gelatin was dissolved. Furthermore, 2.3 ml of a 1 mol/l sodium hydroxide aqueous solution was mixed with the gelatin solution. Immediately before coating, 80 ml of a 4 mass % aqueous solution of N,N-ethylenebis (vinyl-sulfonacetamide) was mixed with the gelatin solution.

(Back Surface Protective Layer)

1) Preparation of Slipping Agent Emulsion or Dispersion:

(Preparation of Comparative Slipping Agent Emulsion A)

1.0 kg of a comparative compound A (liquid paraffin, KEYDOL, manufactured by The Witco Chemical Corp.) was mixed with 2.4 L of water, 30 ml of phenoxyethanol, 10 g of methyl p-hydroxybenzoate, and 1.0 kg of gelatin at 50° C. for 20 minutes by stirring. 250 ml of a 10 mass % aqueous solution of oleoyl methyl taurine sodium was added, and the mixture was stirred by a dissolver at 5,000 rpm for 60 minutes, thereby conducting emulsification. Water of 40° C. was added to the resulting emulsion to increase the total amount to 10 kg. The mean particle size of the particles in the resulting dispersion was measured by a light scattering particle size analyzer LA-920 manufactured by Horiba, Ltd. and found to be 0.22 μm.

(Preparation of Comparative Slipping Agent Emulsion B)

An emulsion B was prepared in the same manner as the preparation of the comparative emulsion A, except that the liquid paraffin was replaced by dipentaerythritol hexaisostearate. The resulting dispersion included particles having a mean particle size of 0.20 μm.

(Preparation of Comparative Slipping Agent Dispersion C)

In a 2L stainless-steel dispersing machine, 60 g of dipentaerythritol hexa-n-stearate (melting point: 77° C.) and 40 g of a dispersant WA-2 were heated to 100° C. and uniformly mixed to obtain a viscous mixture. 800 g of hot water of 95° C. was added to this melt mixed liquid, and the liquid was subjected to dispersing operation at a high speed by using a homogenizer (at 10,000 rpm for 10 minutes). The dispersing machine was cooled while continuing stirring to lower the internal temperature gradually, thereby obtaining a comparative solid dispersion C. The resulting dispersion included particles having a mean particle size of 0.15 μm.

(Preparation of Slipping Agent Solid Dispersions 1 to 4 of the Invention)

In a 2L stainless-steel dispersing machine, 60 g of carnauba wax (melting point: 83° C.) and 40 g of a compound WA-2 were heated to 100° C. and uniformly mixed to obtain a viscous mixture. 800 g of hot water of 95° C. was added to this melt mixed liquid, and the liquid was subjected to dispersing operation at a high speed by using a homogenizer (at 10,000 rpm for 10 minutes). The dispersing machine was cooled while continuing stirring to lower the internal temperature gradually, thereby obtaining a solid dispersion 1. This dispersion included particles having a mean particle size of 0.2 μm.

A solid dispersion 2 was obtained in the same manner as the preparation of the solid dispersion 1, except that the carnauba wax was replaced by a microcrystalline wax (HI-MIC1080, manufactured by Nippon Seiro Co., Ltd., melting point: 83° C.). This dispersion included particles having a mean particle size of 0.22 μm.

A solid dispersion 3 was obtained in the same manner as the preparation of the solid dispersion 1, except for using a microcrystalline wax (HI-MIC1090, manufactured by Nippon Seiro Co., Ltd., melting point: 88° C.) in place of the carnauba wax. A solid dispersion 4 was obtained in the same manner as the preparation of the solid dispersion 1, except for using a high-melting paraffin wax (FNP-0085, manufactured by Nippon Seiro Co., Ltd., melting point: 86° C.) in place of the carnauba wax. The solid dispersions 3 and 4 each included particles having a mean particle size of 0.20 μm.

2) Preparation of Coating Liquid for Back Surface Protective Layer:

A container was kept at 40° C. In the container, 40 g of gelatin, 35 mg of benzoisothiazolinone, and 840 ml of water were mixed, so that gelatin was dissolved. Furthermore, 5.8 ml of a 1 mol/l sodium hydroxide aqueous solution, the slipping agent emulsion (the kind and addition amount thereof are shown in Table 2), 10 ml of a 5 mass % aqueous solution of a di(2-ethylhexyl) sulfosuccinate sodium salt, 20 ml of a 3 mass % aqueous solution of poly(sodium styrenesulfonate), a fluorine compound (the kind and addition amount thereof are shown in Table 2), and 32 g of a 19 mass % latex of a methyl methacrylate/styrene/butyl acrylate/hydroxyethyl methacrylate/acrylic acid copolymer (copolymerization mass ratio=57/8/28/5/2) latex were mixed with the gelatin solution. Immediately before coating, 25 ml of a 4 mass % aqueous solution of N,N-ethylenebis(vinylsulfonacetamide) was mixed with the gelatin solution to form a coating liquid for a back surface protective layer.

(Coating of Layers on the Back Surface)

The coating liquid for a back layer and the coating liquid for a back surface protective layer were coated on the back surface of the foregoing undercoated support by a simultaneous multilayer coating method such that the gelatin amount in the back layer was 1.04 g/m$^2$ and the gelatin amount in the back surface protective layer was 1.7 g/m$^2$. Then, the coated liquids were dried to form layers on the back side.

3. Image-forming Layer, Intermediate Layer and Surface Protective Layer:

3-1. Preparation of Coating Material:

1) Silver Halide Emulsion

<Preparation of Silver Halide Emulsion 1>

3.1 ml of a 1 mass % potassium bromide solution was added to 1421 ml of distilled water. Then, 3.5 ml of sulfuric acid at 0.5 mol/l concentration and 31.7 g of phthalated gelatin were added thereto. The mixture was stirred in a stainless steel reaction pot while its temperature was kept at 30° C. Separately, a solution A was prepared by adding distilled water to 22.22 g of silver nitrate such that the total volume became 95.4 ml. A solution B was prepared by adding distilled water to 15.3 g of potassium bromide and 0.8 g of potassium iodide such that the total volume became 97.4 ml. The entire solution A and the entire solution B were added to the reaction pot at a constant flow rate over 45 sec.

Then, 10 ml of an aqueous 3.5 mass % hydrogen peroxide solution was added thereto and, further, 10.8 ml of an aqueous 10 mass % benzimidazole solution was added thereto. Separately, a solution C was prepared by adding distilled water to 51.86 g of silver nitrate such that the total volume became 317.5 ml. A solution D was prepared by adding distilled water to 44.2 g of potassium bromide and 2.2 g of potassium iodide such that the total volume became 400 ml. The solutions C and D were added to the above mixture by a controlled double jet method; the entire solution C was added at a constant flow rate over 20 min, and the solution D was added while pAg of the solution D was maintained at 8.1.

Potassium hexachloro iridate (III) was added to the above mixture 10 min after the start of addition of the solutions C and D such that its concentration became $1\times10^{-4}$ mol per one mol of silver. Further, an aqueous solution of potassium hexacyano ferrate (II) was added in an amount of $3\times10^{-4}$ mol per one mol of silver 5 sec after the completion of addition of the solution C. The pH of the mixture was adjusted to 3.8 using sulfuric acid at 0.5 mol/l concentration, and stirring was stopped. Then, sedimentation, desalting, and water washing were conducted. The pH was adjusted to 5.9 using sodium hydroxide at 1 mol/l concentration to prepare a silver halide dispersion having a pAg of 8.0.

The silver halide dispersion was kept at 38° C. while stirred. 5 ml of 0.34 mass % solution of 1,2-benzoisothiazoline-3-one in methanol was added thereto. 40 min later, the temperature of the dispersion was elevated to 47° C. 20 min after the temperature elevation, a solution of sodium benzenethiosulfonate in methanol was added thereto such that the concentration of sodium benzenethiosulfonate became $7.6\times10^{-5}$ mol per one mol of silver. 5 min later, a solution of a tellurium sensitizer C in methanol was added thereto such that the concentration of tellurium sensitizer C became $2.9\times10^{-4}$ mol per one mol of silver. Then, the dispersion was subjected to aging for 91 min.

Then, a methanol solution of spectral sensitizing dyes A and B in a molar ratio of 3:1 was added to the dispersion such that the total quantity of the sensitizing dyes A and B became $1.2\times10^{-3}$ mol per one mol of silver. One min later, 1.3 ml of a 0.8 mass % solution of N,N'-dihydroxy-N",N"-diethylmelamine in methanol was added to the dispersion. 4 min later, a solution of 5-methyl-2-mercaptobenzimidazole in methanol, a solution of 1-phenyl-2-heptyl-5-mercapto-1,3,4-triazole in methanol, and a solution of 1-(3-methylureidophenyl)-5-mercaptotetrazole in water were added to the dispersion such that the concentration of 5-methyl-2-mercaptobenzimidazole became $4.8\times10^{-3}$ mol per one mol of silver, the concentration of 1-phenyl-2-heptyl-5-mercapto-1,3,4-triazole became $5.4\times10^{-3}$ mol per one mol of silver, and the concentration of an aqueous solution of 1-(3-methylureidophenyl)-5-mercaptotetrazole was $8.5\times10^{-3}$ mol per one mol of silver. In this way, a silver halide emulsion 1 was obtained.

The grains in the silver halide emulsion thus prepared were silver iodobromide grains with an average equivalent sphere diameter of 0.042 μm and a variation coefficient of equivalent sphere diameter of 20% homogeneously containing 3.5 mol % of iodide. The grain diameter and the like were determined based on the average of 1000 grains using an electron microscope. The [100] face ratio of the grain was determined by the Kubelka-Munk method, and was found to be 80%.

<Preparation of Silver Halide Emulsion 2>

A silver halide emulsion 2 was prepared in the same manner as in the preparation of the silver halide emulsion 1 except that the liquid temperature upon grain formation was changed from 30° C. to 47° C., that the solution B was obtained by adding distilled water to 15.9 g of potassium bromide to make the total volume 97.4 ml, that the solution D was obtained by adding distilled water to 45.8 g of potassium bromide to make the total volume 400 ml, that the addition time of the solution C was changed to 30 min, and that potassium hexacyano ferrate (II) was omitted. Sedimentation, desalting, water washing, and dispersing operations were conducted in the same manner as in the preparation of the silver halide emulsion 1. Spectral sensitization, chemical sensitization, and addition of 5-methyl-2-mercaptobenzimidazole and 1-phenyl-2-heptyl-5-mercapto-1,3,4-triazole were conducted in the same manner as in the preparation of the silver halide emulsion 1 except that the addition amount of the tellurium sensitizer C was changed to $1.1\times10^{-4}$ mol per one mol of silver, that the addition amount of the methanol solution of the spectral sensitizing dyes A and B in the molar ratio of 3:1 was changed to $7.0\times10^{-4}$ mol per one mol of silver in terms of the total amount of the sensitizing dyes A and B, that the addition amount of 1-phenyl-2-heptyl-5-mercapto-1,3,4-triazole was changed to $3.3\times10^{-3}$ mol per one mol of silver, and that the addition amount of 1-(3-methylureidophenyl)-5-mercaptotetrazole was changed to $4.7\times10^{-3}$ mol per one mol of silver. The silver halide emulsion 2 was obtained in this manner.

The emulsion grains of the silver halide emulsion 2 were pure silver bromide cubic grains with an average equivalent sphere diameter of 0.080 μm and a variation coefficient of the equivalent sphere diameter of 20%.

<Preparation of Silver Halide Emulsion 3>

A silver halide emulsion 3 was prepared in the same manner as in the preparation of the silver halide emulsion 1 except for changing the liquid temperature upon grain formation from 30° C. to 27° C.

Sedimentation, desalting, water washing, and dispersion operations were conducted in the same manner as in the preparation of the silver halide emulsion 1. A silver halide emulsion 3 was obtained in the same manner as in the preparation of the silver halide emulsion 1 except that the addition amount of the tellurium sensitizer C was changed to $5.2\times10^{-4}$ mol per one mol of silver, that a solid dispersion (in aqueous gelatin solution) of the spectral sensitizing dyes A and B in the molar ratio of 1:1 was added in an amount of $6.0\times10^{-3}$ mol per one mol of silver in terms of the total amount of the sensitizing dyes A and B instead of the methanol solution of the spectral sensitizing dyes A and B, that $5\times10^{-4}$ mol of bromoauric acid per one mol of silver and $2\times10^{-3}$ mol of potassium thiocyanate per one mol of silver were added 3 min after the addition of the tellurium sensitizer. The emulsion grains of the silver halide emulsion 3 were silver iodobromide grains with an average equivalent sphere diameter of 0.034 μm and with a variation coefficient of the equivalent sphere diameter of 20% homogeneously containing 3.5 mol % of iodide.

(Preparation of Mixed Emulsion A for Coating Liquid)

70 mass % of the silver halide emulsion 1, 15 mass % of the silver halide emulsion 2, and 15 mass % of the silver halide emulsion 3 were mixed, and an aqueous 1 mass % solution of benzothiazolium iodide was added thereto such that the concentration of the benzothiazolium iodide became $7\times10^{-3}$ mol per one mol of silver.

Then, compounds 1, 20, and 26 as compounds whose 1-electron oxidized forms formed by 1-electron oxidation can release 1 electron or more electrons each in an amount of $2\times10^{-3}$ mol per one mol of silver were added to the mixed emulsion.

Thereafter, water was added such that the content of the silver halide per 1 kg of the mixed emulsion for coating liquid was 38.2 g in terms of the silver amount. Further, 1-(3-methylureidophenyl)-5-mercaptotetrazole was added to the mixed emulsion such that the content of 1-(3-methylureidophenyl)-5-mercaptotetrazole per 1 kg of the mixed emulsion was 0.34 g.

2) Preparation of Fatty Acid Silver Salt Dispersion (Preparation of Recrystallized Behenic Acid)

100 kg of behenic acid manufactured by Henkel Co. (trade name of product; EDENOR C 22-85R) was mixed with 1200 kg of isopropyl alcohol, and dissolved at 50° C., filtered through a 10 μm filter, and then cooled to 30° C. to be recrystallized. The cooling rate at recrystallization was set at 3° C./hr. The resultant crystal was centrifugally filtered, washed with shower of 100 kg of isopropyl alcohol and then dried. When the obtained crystal was esterified and measured by GC-FID, it was found that behenic acid content was 96 mol %, lignoceric acid content was 2 mol %, arachidic acid content was 2 mol %, and erucic acid content was 0.001 mol %.

<<Preparation of Fatty Acid Silver Salt Dispersion>>

88 kg of the recrystallized behenic acid, 422 L of distilled water, 49.2 L of a 5 mol/L aqueous solution of NaOH and 120 L of t-butyl alcohol were mixed and allowed to react at 75° C. for one hour under stirring to form a sodium behenate solution B. Separately, 206.2 L of an aqueous solution (pH 4.0) containing 40.4 kg of silver nitrate was prepared and kept at 10° C. To a mixture of 635 L of distilled water and 30 L of t-butyl alcohol contained in a reaction vessel kept at 30° C. were added the entire volume of the above-mentioned sodium behenate solution B and the entire volume of the aqueous silver nitrate solution under sufficient stirring at constant flow rates over the periods of 93 minutes and 15 seconds, and 90 minutes, respectively; in this operation, only the aqueous silver nitrate solution was added during a period within 11 minutes from the initiation of the addition of the aqueous silver nitrate solution, and then the addition of the sodium behenate solution B was started, and then the addition of the aqueous silver nitrate solution was completed, so that only the sodium behenate solution B was added during a period within 14 minutes and 15 seconds from the completion of the addition of the aqueous silver nitrate solution. In this operation, the outside temperature was controlled so that the temperature in the reaction vessel was maintained at 30° C. and the liquid temperature was kept constant. The pipe of the addition system for the sodium behenate solution B was warmed by circulating warmed water in the space between the outer pipe and the inner pipe of a double pipe, and temperature was controlled such that the liquid temperature at the outlet orifice of the addition nozzle was 75° C. The pipe of the addition system for the aqueous silver nitrate solution was maintained at a constant temperature by circulating cold water in the space between the outer pipe and the inner pipe of a double pipe. The addition position of the sodium behenate solution B and the addition position of the aqueous silver nitrate solution were arranged symmetrically with respect to the stirring axis as a center, and the positions had such heights as not to contact with the reaction solution.

After finishing the addition of the sodium behenate solution B, the mixture was left under stirring for 20 minutes at the same temperature, and then the temperature was increased to 35° C. over 30 minutes, followed by aging for 210 minutes. Immediately after finishing the aging, the solid content was separated by centrifugal filtration and washed with water until an electric conductivity of the filtrate became 30 μS/cm. Thus, a fatty acid silver salt was obtained. The obtained solid content was stored as a wet cake without being dried.

When the shape of the obtained silver behenate grains was evaluated by electron microscopic photography, it was found that the grains were crystals having a=0.21 μm, b=0.4 μm, and c=0.4 μm in average values, an average aspect ratio of 2.1, and an average equivalent-sphere diameter variation coefficient of 11% (a, b and c have the meanings defined above).

To the wet cake corresponding to 260 kg of the dry solid content were added 19.3 kg of polyvinyl alcohol (trade name: PVA-217) and water to make the total amount 1000 kg, and the mixture was made into slurry by a dissolver fin and further pre-dispersed by a pipeline mixer (PM-10 type, manufactured by Mizuho Industrial Co., Ltd.).

Then, the pre-dispersed liquid was dispersed three times by using a disperser (trade name: Microfluidizer M-610, manufactured by Microfluidex International Corporation, using Z type interaction chamber) with a pressure controlled at 1150 kg/cm$^2$ to obtain a silver behenate dispersion. A dispersion temperature of 18° C. was achieved by providing coiled heat exchangers fixed in front of and behind the interaction chamber and controlling the temperature of refrigerant.

3) Preparation of Reducing Agent Dispersion

<Preparation of Reducing Agent 1 Dispersion>

10 kg of water was added to a mixture of 10 kg of a reducing agent 1 (2,2'-methylenebis-(4-ethyl-6-tert-butylphenol)) and 16 kg of an aqueous 10 mass % solution of modified polyvinyl alcohol (POVAL MP203, manufactured by Kuraray Co.) and they were mixed thoroughly to form a slurry. The slurry was fed by a diaphragm pump, and was dispersed for 3 hrs by a horizontal sand mil (UVM-2; manufactured by Imex Co.) filled with zirconia beads with an average diameter of 0.5 mm. Then 0.2 g of sodium salt of benzoisothiazolinone and water were added thereto such that the concentration of the reducing agent became 25 mass %. The obtained dispersion was heated to 60° C. and kept at 60° C. for 5 hours to form a reducing agent 1 dispersion. The reducing agent particles contained in the thus obtained reducing agent dispersion had a median diameter of 0.40 μm and a maximum particle diameter of 1.4 μm or less. The obtained reducing agent dispersion was filtered through a polypropylene filter of 3.0 μm pore size so that contaminants such as dusts were removed. The reducing agent dispersion was then stored.

<Preparation of Reducing Agent 2 Dispersion>

10 kg of water was added to a mixture of 10 kg of a reducing agent 2 (6,6'-di-t-butyl-4,4'-dimethyl-2,2'-butylidene diphenol) and 16 kg of an aqueous 10 mass % solution of modified polyvinyl alcohol (POVAL MP203, manufactured by Kuraray Co.) and they were mixed thoroughly to form a slurry. The slurry was fed by a diaphragm pump, and was dispersed for 3 hrs and 30 min by a horizontal sand mil (UVM-2; manufactured by Imex Co.) filled with zirconia beads with an average diameter of 0.5 mm. Then 0.2 g of sodium salt of benzoisothiazolinone and water were added thereto such that the concentration of the reducing agent became 25 mass %. The obtained dispersion was heated to 40° C. and maintained at 40° C. for 1 hour. Then, the temperature of the dispersion was raised to 80° C. and maintained at 80° C. for 1 hour to form a reducing agent 2 dispersion. The reducing agent particles contained in the thus obtained reducing agent dispersion had a median diameter of 0.50 μm and a maximum particle diameter of 1.6 μm or less. The obtained reducing agent dispersion was filtered through a polypropylene filter of 3.0 μm pore size so that contaminants such as dusts were removed. The reducing agent dispersion was then stored.

4) Preparation of Hydrogen-Bonding Compound 1 Dispersion 10 kg of water was sufficiently mixed with 10 kg of a hydrogen-bonding compound 1 (tri(4-t-butylphenyl)phosphine oxide) and 16 kg of a 10 mass % aqueous solution of a modified polyvinyl alcohol POVAL MP203 available from Kuraray Co., Ltd., to form a slurry. The slurry was transported by a diaphragm pump to a horizontal-type sand mill UVM-2 manufactured by Imex Co., which was packed with zirconia beads having an average diameter of 0.5 mm, and dispersed for 4 hours. Then, 0.2 g of benzoisothiazolinone sodium salt and water were added to the dispersed slurry such that the content of the hydrogen-bonding compound was 25 mass %. Thus-obtained dispersion liquid was maintained at 40° C. for 1 hour, and further maintained at 80° C. for 1 hour to obtain a hydrogen-bonding compound 1 dispersion. The hydrogen-bonding compound 1 dispersion included hydrogen-bonding compound particles having a median size of 0.45 μm and a maximum particle size of 1.3 μm or smaller. The hydrogen-bonding compound 1 dispersion was filtrated by a polypropylene filter having a pore diameter of 3.0 μm to remove extraneous substances such as dust, and then stored.

5) Preparation of Development Accelerator 1 Dispersion 10 kg of water was sufficiently mixed with 10 kg of a development accelerator 1 and 20 kg of a 10 mass % aqueous solution of a modified polyvinyl alcohol POVAL MP203 available from Kuraray Co., Ltd., to form a slurry. The slurry was transported by a diaphragm pump to a horizontal-type sand mill UVM-2 manufactured by Imex Co., which was packed with zirconia beads having an average diameter of 0.5 mm, and dispersed for 3.5 hours. Then, 0.2 g of benzoisothiazolinone sodium salt and water were added to the dispersed slurry such that the content of the development accelerator was 20 mass %, to obtain a development accelerator 1 dispersion. The development accelerator 1 dispersion included development accelerator particles having a median size of 0.48 μm and a maximum particle size of 1.4 μm or less. The development accelerator 1 dispersion was filtrated by a polypropylene filter having a pore diameter of 3.0 μm to remove extraneous substances such as dust, and then stored.

6) Preparation of Development Accelerator 2 Dispersion and Color Tone Controlling Agent 1 Dispersion A 20 mass % solid dispersion of a development accelerator 2 and a 15 mass % solid dispersion of a color tone controlling agent 1 were respectively prepared in a similar manner to the preparation of the development accelerator 1.

7) Preparation of Polyhalogen Compound

<Preparation of Organic Polyhalogen Compound 1 Dispersion>

10 kg of an organic polyhalogen compound 1 (tribromo methanesulfonyl benzene), 10 kg of an aqueous 20 mass % solution of modified polyvinyl alcohol (POVAL MP203, manufactured by Kuraray Co.), 0.4 kg of an aqueous 20 mass % solution of sodium triisopropyl naphthalene sulfonate, and 14 kg of water were mixed thoroughly to form a slurry. The slurry was fed by a diaphragm pump and dispersed in a horizontal type sand mill filled with zirconia beads with an average diameter of 0.5 mm (UVM-2: manufactured by Imex Co.) for 5 hours and then 0.2 g of sodium salt of benzoisothiazolinone and water were added thereto such that the concentration of the organic polyhalogen compound became 26 mass %. An organic polyhalogen compound 1 dispersion was obtained in this way.

The obtained organic polyhalogen compound particles contained in the organic polyhalogen compound dispersion had a median diameter of 0.41 μm and a maximum particle diameter of 2.0 μm or less. The obtained organic polyhalogen compound dispersion was filtered through a polypropylene filter having a pore size of 10.0 μm so that contaminants such as dusts were removed. The organic polyhalogen compound dispersion was then stored.

(Preparation of Organic Polyhalogen Compound 2 Dispersion)

10 kg of an organic polyhalogen compound 2 (N-butyl-3-tribromomethanesulfonyl benzamide), 20 kg of an aqueous 10 mass % solution of modified polyvinyl alcohol (POVAL MP203, manufactured by Kuraray Co.), and 0.4 kg of an aqueous 20 mass % solution of sodium triisopropyl naphthalene sulfonate were mixed thoroughly to form a slurry. The slurry was fed by a diaphragm pump and dispersed in a horizontal type sand mill filled with zirconia beads with an average diameter of 0.5 mm (UVM-2: manufactured by Imex Co.) for 5 hours and then 0.2 g of sodium salt of benzoisothiazolinone and water were added thereto such that the concentration of the organic polyhalogen compound became 30 mass %. The dispersion was heated to 40° C. and maintained at 40° C. for 5 hours to form a polyhalogen compound 2 dispersion. The obtained organic polyhalogen compound particles contained in the organic polyhalogen compound dispersion had a median diameter of 0.40 μm and a maximum particle diameter of 1.3 μm or less. The obtained organic polyhalogen compound dispersion was filtered through a polypropylene filter having a pore size of 3.0 μm so that contaminants such as dusts were removed. The organic polyhalogen compound was then stored.

8) Preparation of Phthalazine Compound 1 Solution 8 kg of a modified polyvinyl alcohol MP203 available from Kuraray Co., Ltd. was dissolved in 174.57 kg of water. To the solution were added 3.15 kg of a 20 mass % aqueous solution of sodium triisopropylnaphthalenesulfonate and 14.28 kg of a 70 mass % aqueous solution of the phthalazine compound 1 (6-isopropylphthalazine), to prepare a 5 mass % phthalazine compound 1 solution.

9) Preparation of Mercapto Compounds

<Preparation of Aqueous Mercapto Compound 1 Solution>

7 g of a mercapto compound 1 (1-(3-sulfophenyl)-5-mercaptotetrazole sodium salt) was dissolved in 993 g of water to obtain a 0.7 mass % aqueous solution of the mercapto compound 1.

<Preparation of Aqueous Mercapto Compound 2 Solution>

20 g of a mercapto compound 2 (1-(3-methylureidophenyl)-5-mercaptotetrazole) was dissolved in 980 g of water to obtain a 2.0 mass % aqueous solution of the mercapto compound 2.

10) Preparation of SBR Latex Liquid 287 g of distilled water, 7.73 g of a surfactant PIONINE A-43-S available from Takemoto Oil & Fat Co., Ltd. (solid content 48.5. mass %), 14.06 ml of a 1 mol/l NaOH solution, 0.15 g of tetrasodium ethylenediaminetetraacetate, 255 g of styrene, 11.25 g of acrylic acid, and 3.0 g of tert-dodecylmercaptan were placed in a polymerization kettle of a gas monomer reactor TAS-2J manufactured by Taiatsu Techno Corporation. The polymerization kettle was closed and the contents were stirred at a stirring rate of 200 rpm. The resultant mixture was degassed by a vacuum pump, the inner atmosphere of the kettle was replaced with nitrogen gas several times, 108.75 g of 1,3-butadiene was added to the mixture, and the inner temperature was raised to 60° C. Then, a solution prepared by dissolving 1.875 g of ammonium persulfate in 50 ml of water was added to the mixture and stirred for 5 hours.

The mixture was heated to 90° C. and further stirred for 3 hours, and the inner temperature was reduced to the room temperature after the reaction. To the resultant mixture were added 1 mol/l solution of NaOH and 1 mol/l solution of $NH_4OH$ such that the mole ratio of $Na^+$ ion/$NH_4^+$ ion was 1/5.3, whereby the pH value of the mixture was adjusted to 8.4. Then, the mixture was filtrated by a polypropylene filter having a pore diameter of 1.0 μm to remove extraneous substances such as dust, whereby 774.7 g of an SBR latex was obtained. As a result of a measurement of the halogen ion content of the SBR latex by an ion chromatography, the chloride ion content was found to be 3 ppm. As a result of a measurement the chelating agent content of the SBR latex by a high performance liquid chromatography, the chelating agent content was found to be 145 ppm.

The latex had an average particle diameter of 90 nm, Tg of 17° C., a solid content of 44 mass %, an equilibrium moisture content of 0.6 mass % under the conditions of 25° C. and 60% RH, and an ionic conductivity of 4.80 mS/cm (measured at 25° C. by a conductivity meter CM-30S available from DKK-TOA Co).

3-2. Preparation of Coating Liquid

1) Preparation of Image-forming Layer Coating Liquids 1 to 9

To 1,000 g of the fatty acid silver dispersion, 135 ml of water, 28.5 cc of a 2% by mass metallic phthalocyanine dye 1 aqueous solution, 25 g of the organic polyhalide compound 1 dispersion, 39 g of the organic polyhalide compound 2 dispersion, 171 g of the phthalazine compound 1 solution, 1,060 g of the SBR latex (Tg: 17° C.) liquid, 75 g of the reducing agent 1 dispersion, 78 g of the reducing agent 2 dispersion, 55 g of the hydrogen bonding compound 1 dispersion, 4.8 g of the development accelerator 1 dispersion, 5.2 g of the development accelerator 2 dispersion, 2.1 g of the color tone controlling agent 1 dispersion, 4 ml of the mercapto compound 1 aqueous solution, and 4 ml of the mercapto compound 2 aqueous solution were successively added. Immediately before coating, 140 g of the silver halide mixed emulsion A was mixed with the above mixture thoroughly to form an image-forming layer coating liquid, which was then fed to a coating die as it was and coated.

The viscosity of the foregoing image-forming layer coating liquid was measured by a B-type viscometer manufactured by Tokimec Inc. and found to be 40 [mPa·s] at 40° C. (No. 1 rotor at 60 rpm).

The viscosity of the coating liquid was measured at 38° C. by using Haake's RheoStress RS150, and found to be 30, 43, 41, 28 and 20 [mPa·s] at a shear rate of 0.1, 1, 10, 100 and 1,000 [1/sec], respectively.

The zirconium content in the coating liquid was 0.30 mg per 1 g of silver.

2) Preparation of Intermediate Layer Coating Liquid:

1,000 g of polyvinyl alcohol PVA-205 (manufactured by Kuraray Co., Ltd.), 27 ml of a 5% by mass aqueous solution of di(2-ethylhexyl) sulfosuccinate sodium salt, and 4,200 ml of a 19% by mass latex of a methyl methacrylate/styrene/butyl acrylate/hydroxyethyl methacrylate/acrylic acid copolymer (copolymerization mass ratio=57/8/28/5/2) were mixed. To this mixture, 27 ml of a 5% by mass aqueous solution of AEROSOL OT (manufactured by American Cyanamid Company), 135 ml of a 20% by mass aqueous solution of diammonium phthalate, and water were added to increase the total amount to 10,000 g. The pH value of the mixture was set at 7.5 by using NaOH to form an intermediate layer coating liquid, which was then fed to a coating die to give a coating amount of 8.9 ml/$m^2$.

The viscosity of the coating liquid was measured by a B-type viscometer at 40° C. (No. 1 rotor at 60 rpm) and found to be 58 [mPa·s].

3) Preparation of Coating Liquid for First Layer of Surface Protective Layer:

100 g of inert gelatin and 10 mg of benzoisothiazolinone were dissolved in 840 ml of water. This mixture was mixed with 180 g of a 19 mass % latex of a methyl methacrylate/styrene/butyl acrylate/hydroxyethyl methacrylate/acrylic acid copolymer (copolymerization mass ratio=57/8/28/5/2), 46 ml of a 15% mass % methanol solution of phthalic acid, and 5.4 mL of a 5 mass % di(2-ethylhexyl) sulfosuccinate sodium salt aqueous solution. Immediately before coating, the mixture was mixed with 40 ml of a 4 mass % chromium alum solution by a static mixer and fed to a coating die to give a coating amount of 26.1 ml/$m^2$.

The viscosity of the coating liquid was measured by a B-type viscometer at 40° C. (No. 1 rotor at 60 rpm) and found to be 20 [mPa·s].

4) Preparation of Coating Liquid for Second Layer of Surface Protective Layer:

100 g of inert gelatin and 10 mg of benzoisothiazolinone were dissolved in 800 ml of water. This mixture was mixed with 40 g of a 10 mass % emulsion of liquid paraffin, the slipping agent emulsion (the kind and addition amount thereof are shown in Table 2), 180 g of a 19 mass % latex of a methyl methacrylate/styrene/butyl acrylate/hydroxyethyl methacrylate/acrylic acid copolymer (copolymerization mass ratio=57/8/28/5/2), 40 ml of a 15 mass % solution of phthalic acid in methanol, 28 ml of a 5 mass % aqueous solution of di(2-ethylhexyl) sulfosuccinate sodium salt, 4 g of polymethyl methacrylate fine particles (mean particle size: 0.7 μm, the mean particle diameter corresponding to 30% point on the cumulative volume-weighted particle size distribution), and 21 g of polymethyl methacrylate fine particles (mean particle size: 3.6 μm, the mean particle diameter corresponding to 60% point on the cumulative volume-weighted particle size distribution), thereby forming a coating liquid for surface protective layer. The coating liquid was fed to a coating die to give a coating amount of 8.3 ml/$m^2$.

The viscosity of the coating liquid was measured by a B-type viscometer at 40° C. (No. 1 rotor at 60 rpm) and found to be 19 [mPa·s].

3. Preparation of Photothermographic Material:

On the undercoated surface opposite to the back surface, the image-forming layer, the intermediate layer, the first layer of the surface protective layer, and the second layer of the surface protective layer were coated in this order. The coating operation was conducted by the slide speed coating method in a simultaneous multilayer coating manner, thereby giving a sample of a photothermographic material.

In the coating operation, the temperature of the image-forming layer coating liquid and the intermediate layer coating liquid was set at 31° C., the temperature the coating liquid for the first layer of the surface protective layer was set at 36° C., and the temperature of the coating liquid for the second layer of the surface protective layer was set at 37° C.

The chemical structures of the compounds used in the examples of the invention are shown below.

Spectral sensitizer A

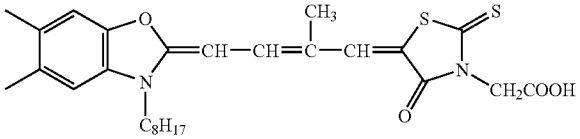

Spectral sensitizer B

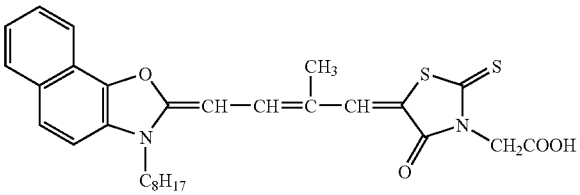

Tellurium sensitizer C

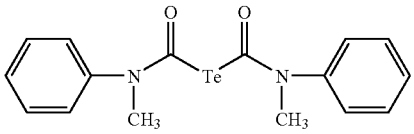

Metallic phthalocyanine dye 1

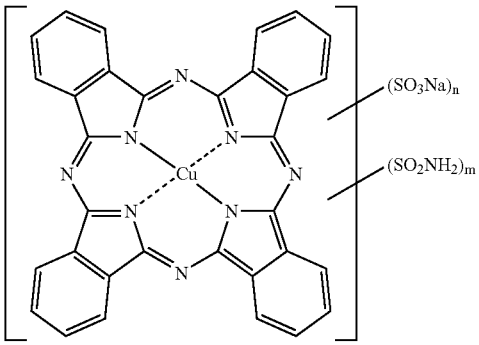

n = 0.5~2.0
m = 0.5~2.5

Magenta color toning dye 1

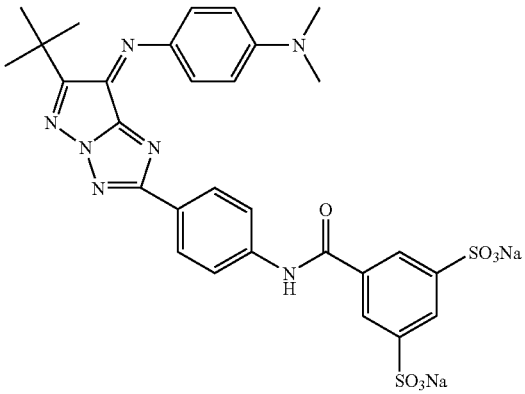

-continued

Reducing agent 1

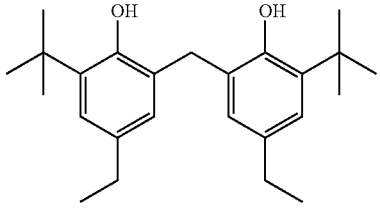

Reducing agent 2

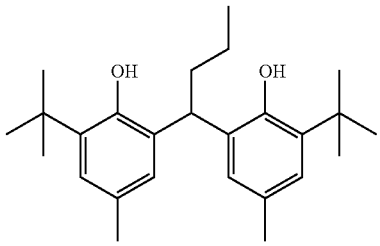

Hydrogen-bonding compound 1

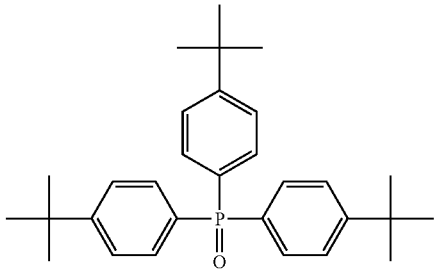

Polyhalogen compound 1

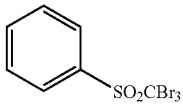

Polyhalogen compound 2

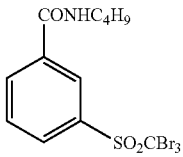

Mercapto compound 1

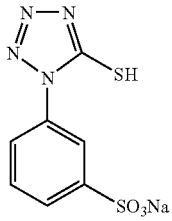

Mercapto compound 2

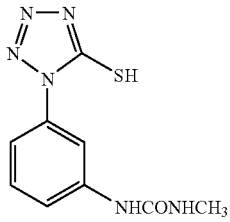

-continued

Phthalazine compound 1

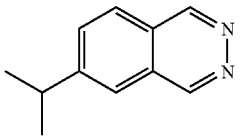

Development accelerator 1

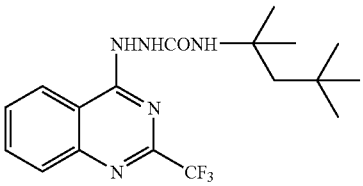

Development accelerator 2

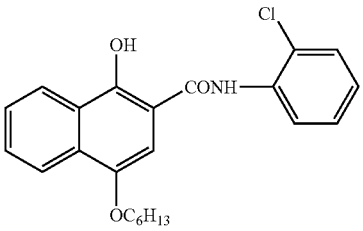

Color tone controlling agent 1

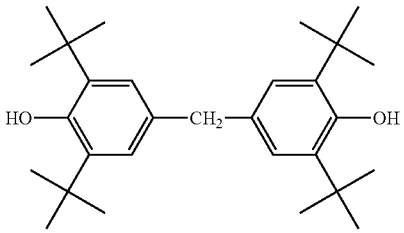

4. Evaluation of Photographic Performance

1) Preparation

Each of the obtained samples was cut into the half size (43 cm in length×35 cm in width), and then packed in the following packaging material in an environment of 25° C., 50% RH. Thereafter, each sample was stored at normal temperature for 2 weeks, and then the following evaluations were conducted.

<Packaging Material>

Laminate film comprising (PET 10 μm)-(PE 12 μm)-(aluminum foil 9 μm)-(Ny 15 μm)-(polyethylene 50 μm containing 3 mass % of carbon):

oxygen permeability: 0.02 ml/atm·$m^2$·25° C.·day moisture permeability: 0.10 g/atm·$m^2$·25° C.·day 2) Exposure and Development of Photothermographic Material Each sample was exposed by using a dry laser imager DRYPIX7000 (manufactured by Fuji Medical Co., Ltd.) (equipped with a 660 nm semiconductor laser having a maximum output of 50 mW) and thermally developed for 14 seconds in total (using three panel heaters set respectively at 107° C., 121° C. and 121° C.).

The conveyance velocity of the sample was 28 mm/sec.

3) Evaluation Items (Measurement of Coefficient of Dynamic Friction)

The photothermographic material was placed on a smooth plane such that the image-forming layer side faced upward. Stainless-steel beads (diameter: 5 mm) were placed on the upper surface of the photothermographic material. A weight of 250 g was applied on to the stainless-steel beads. The force exerted on the stainless-steel beads was measured when the photothermographic material was moved at a rate of 0.1 cm/sec. Similarly, the force exerted on the stainless-steel beads was measured when the photothermographic material was moved at a rate of and 10 cm/sec. The coefficient of dynamic friction was measured based on the measured values.

(Measurement of Rate of Evaporation)

10 mg of the slipping agent of the invention was weighed out and placed on a thermobalance. The temperature of the sample was raised from room temperature to 120° C. at a rate of 5° C./min under a nitrogen atmosphere, and the sample was kept at 120° C. for 70 minutes. The weight lost by evaporation during a period (60 minutes) from 10 minutes after the temperature increase (to 120° C.) to 70 minutes after the temperature increase was measured. The lost weight was divided by the initial weight to give a rate (%) of evaporation.

(Evaluation of Cut Surface)

The photographic material was cut by using a cutter blade having a clearance of 50 μm. The cut surface of the photographic material was observed and occurrence of fibers protruding from the cut surface was visually evaluated.

A: Clean cut without fibers

B: A few fibers are observable, but the cut surface is practically acceptable

C: Ragged cut with a lot of fibers (Evaluation of Image Unevenness)

A uniform density image having a density of 1.2 was formed under the foregoing exposure and development conditions, and organoleptic (visual) evaluation of the density unevenness was conducted.

A: The density is uniform.

B: The density is slightly uneven, but the unevenness is at practically acceptable level.

C: The density unevenness is remarkable and the unevenness is practically problematic.

4) Evaluation Results

The results are shown in Table 2.

As is clear from the results shown in Table 2, the photographic materials of the invention gave clear cut and were excellent in image density uniformity. Also, the compounds of the invention showed advantageous evaporation characteristics, thus suppressing stains in the thermal developing machine.

TABLE 2

| Sample No. | Slipping agent Kind | Slipping agent Meting point (° C.) | Slipping agent Addition amount (mg/m²) | Fluorine compound Kind | Fluorine compound Addition amount (mg/m²) | Coefficient of dynamic friction 0.1 cm/sec | Coefficient of dynamic friction 10 cm/sec | Rate of evaporation (%) | Cut surface state | Image unevenness | Remark |
|---|---|---|---|---|---|---|---|---|---|---|---|
| 1 | Not Added | — | — | F-29 | 1.0 | 0.56 | 0.50 | — | C | C | Comp. Ex. |
| 2 | Comparative compound A | <10° C. | 35 | F-29 | 1.0 | 0.22 | 0.23 | 0.6 | A | B | Comp. Ex. |
| 3 | Comparative compound B | <10° C. | 35 | F-29 | 1.0 | 0.19 | 0.27 | 0.02 | C | A | Comp. Ex. |
| 4 | Comparative compound C | 77° C. | 35 | F-29 | 1.0 | 0.19 | 0.28 | 0.02 | C | A | Comp. Ex. |
| 5 | Solid dispersion 1 | 83° C. | 35 | F-29 | 1.0 | 0.22 | 0.26 | 0.05 | B | A | Invention |
| 6 | Solid dispersion 1 | 83° C. | 35 | — | — | 0.22 | 0.25 | 0.05 | B | B | Invention |
| 7 | Solid dispersion 2 | 83° C. | 35 | F-29 | 1.0 | 0.18 | 0.19 | 0.15 | A | A | Invention |
| 8 | Solid dispersion 2 | 83° C. | 35 | — | — | 0.18 | 0.18 | 0.15 | A | B | Invention |
| 9 | Solid dispersion 3 | 88° C. | 35 | F-29 | 1.0 | 0.19 | 0.20 | 0.08 | A | A | Invention |
| 10 | Solid dispersion 3 | 88° C. | 35 | — | — | 0.19 | 0.19 | 0.08 | A | B | Invention |
| 11 | Solid dispersion 4 | 86° C. | 35 | F-29 | 1.0 | 0.20 | 0.21 | 0.09 | A | A | Invention |
| 12 | Solid dispersion 4 | 86° C. | 35 | — | — | 0.20 | 0.20 | 0.09 | A | B | Invention |

As described above, the invention provides a photothermographic material having excellent processing and cutting properties and improved image uniformity. The invention further provides a method for forming an image.

What is claimed is:

1. A photothermographic material comprising a support, and an image-forming layer and a non-image-forming layer provided on the support, wherein the image-forming layer comprises a photosensitive silver halide, a non-photosensitive organic silver salt, a reducing agent, and a binder;

the non-image-forming layer includes a slipping agent having a melting point of 81° C. to 120° C.; and a coefficient (K1) of dynamic friction measured at a velocity of 0.1 cm/sec and a coefficient (K2) of dynamic friction measured at a velocity of 10 cm/sec have a relation represented by formula (I):

$$1.20>K1/K2>0.85 \qquad \text{Formula (1).}$$

2. The photothermographic material according to claim 1, wherein the melting point of the slipping agent is 85° C. to 110° C.

3. The photothermographic material according to claim 1, wherein the slipping agent is a fatty acid ester or a microcrystalline wax.

4. The photothermographic material according to claim 1, wherein the slipping agent contained in the photothermographic material is in the form of a solid particle dispersion.

5. The photothermographic material according to claim 1, wherein the rate of evaporation of the slipping agent is 0.5 mass % or lower.

6. The photothermographic material according to claim 1, wherein the photothermographic material comprises a fluorine-containing compound having an alkyl fluoride group having at least two carbon atoms and 12 or less fluorine atoms.

7. The photothermographic material according to claim 6, wherein the alkyl fluoride group is a group represented by formula (A):

$$\text{-Rc-Re-W} \qquad \text{Formula (A)}$$

wherein in the formula (A), Rc represents an alkylene group having 1 to 4 carbon atoms, Re represents a perfluoroalkylene group having 2 to 6 carbon atoms, and W represents a hydrogen atom, a fluorine atom, or an alkyl group.

8. The photothermographic material according to claim 7, wherein the fluorine-containing compound has two or more alkyl fluoride groups represented by formula (A).

9. The photothermographic material according to claim 6, wherein the fluorine-containing compound is contained in the non-image-forming layer, and the photothermographic material further comprises a matting agent on the same side of the support as a side having the non-image-forming layer.

10. The photothermographic material according to claim 9, wherein the matting agent is a polymer.

11. The photothermographic material according to claim 1, wherein the photothermographic material further comprises a non-photosensitive intermediate layer provided between the image-forming layer and the non-image-forming layer, and the non-photosensitive intermediate layer contains 50 mass % or more of a polymer latex.

12. The photothermographic material according to claim 11, wherein the polymer latex includes 10 mass % to 70 mass % of a monomer component represented by formula (M):

$$CH_2{=}CR^{01}{-}CR^{02}{=}CH_2 \qquad \text{Formula (M)}$$

wherein in the formula (M), $R^{01}$ and $R^{02}$ each independently represent a hydrogen atom, an alkyl group having 1 to 6 carbon atoms, a halogen atom, or a cyano group.

13. The photothermographic material according to claim 12, wherein $R^{01}$ and $R^{02}$ both represent hydrogen atoms, or one of $R^{01}$ and $R^{02}$ represents a hydrogen atom and the other represents a methyl group.

14. An image-forming method comprising heating the photothermographic material of claim 1 at 100° C. to 140° C. for 5 sec to 18 sec.

15. The image-forming method according to claim 14, wherein the photothermographic material is conveyed at a velocity of at least 23 mm/sec at the time of heat development.

* * * * *